US006612683B2

(12) United States Patent
Takahashi et al.

(10) Patent No.: US 6,612,683 B2
(45) Date of Patent: Sep. 2, 2003

(54) INK SUPPLY RECOVERY SYSTEM, INK-JET PRINTING APPARATUS AND IMAGE PICK-UP DEVICE HAVING RECORDING MECHANISM

(75) Inventors: Keiji Takahashi, Tokyo (JP); Tetsuji Kurata, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/946,531

(22) Filed: Sep. 6, 2001

(65) Prior Publication Data

US 2002/0075364 A1 Jun. 20, 2002

(30) Foreign Application Priority Data

Sep. 12, 2000 (JP) ..... 2000-277331

(51) Int. Cl.[7] ..... B41J 2/165
(52) U.S. Cl. ..... 347/30; 347/29; 347/85
(58) Field of Search ..... 347/30, 29, 31, 347/33, 36, 23, 101, 108, 104, 85, 86, 2

(56) References Cited

U.S. PATENT DOCUMENTS

| | | | | |
|---|---|---|---|---|
| 5,701,146 A | 12/1997 | Akiyama et al. | ..... | 347/26 |
| 5,798,775 A | 8/1998 | Takahashi et al. | ..... | 347/33 |
| 5,903,287 A | 5/1999 | Ishikawa et al. | ..... | 347/24 |
| 6,109,724 A | 8/2000 | Takahashi et al. | ..... | 347/23 |
| 6,109,725 A | 8/2000 | Saikawa et al. | ..... | 347/33 |
| 6,132,023 A | 10/2000 | Akiyama et al. | ..... | 347/17 |
| 6,227,646 B1 | 5/2001 | Yano et al. | ..... | 347/23 |

FOREIGN PATENT DOCUMENTS

| | | |
|---|---|---|
| EP | 0 364 284 | 4/1990 |
| EP | 0 803 362 | 10/1997 |
| JP | 07-089097 | 4/1995 |

OTHER PUBLICATIONS

European Search Report dated Dec. 14, 2001, 01121828.6–2302—De Groot, R.

Inui et al., U.S. application No. 09/845,285, filed May 1, 2001 pending.

*Primary Examiner*—Shih-wen Hsieh

(74) *Attorney, Agent, or Firm*—Fitzpatrick, Cella, Harper & Scinto

(57) ABSTRACT

An ink supply recovery system comprises a pack body including a main tank and a waste ink receptacle. The pack body is detachably mounted on a printer body. The printer body includes a sub-tank mounted on a carriage, a cap for capping ink ejection openings of a printing head, and a cylinder pump. The pump has a reciprocally movable piston, a cylinder body having air and ink suction chambers, defined on opposite sides of the piston, respectively connectable with a negative pressure introducing portion of the sub-tank, the cap via an input port and the waste ink receptacle via an output port, and a port switching mechanism which switches the input and output ports open and close associating with movement of the piston. Movement of the piston of the cylinder pump is controlled at a predetermined timing.

17 Claims, 39 Drawing Sheets

| STEP | OPERATION | OPERATION | JOINT LIFTER | | PISTON | | WIPER |
|---|---|---|---|---|---|---|---|
| | | | POSI-TION | MOVEMENT | POSI-TION | MOVEMENT | POSI-TION |
| | | | | | | | |
| S1 | STAND-BY | (HP) | 0.0 | | 0.0 | | 0.0 |
| S2 | CR INITIALIZE | CAP OPEN | -0.6 | -0.6 | 0.0 | | 0.0 |
| S3 | ↓ | (CR INITIALIZE) | -0.6 | | 0.0 | | 0.0 |
| S4 | JOINT | TO PUMP SUPPLY START POSITION | -0.6 | | -1.0 | -1.0 | 2.6 |
| S5 | ↓ | J-HP-OFF DETECTION (CAP CLOSE) | 0.1 | 0.7 | -1.0 | | 2.6 |
| S6 | ↓ | JOINT UP (ATMOSPHERE COMMUNICATION VALVE CLOSE) | 4.3 | 4.2 | -1.0 | | 2.6 |
| S7 | SUPPLY | P-HP-OFF DETECTION | 4.3 | | 0.2 | 1.2 | 0.0 |
| S8 | ↓ | INK SUPPLY (DISCHARGE) | 4.3 | | 19.0 | 18.8 | 0.0 |
| S9 | ↓ | WAIT (1.5 SEC STOP) | 4.3 | | 19.0 | | 0.0 |
| S10 | SUCTION | TO JOINT SUCTION POSITION | 2.3 | -2.0 | 19.0 | | 0.0 |
| S11 | ↓ | SUCTION | 2.3 | | 14.0 | -5.0 | 0.0 |
| S12 | EMPTY SUCTION | ATMOSPHERE COMMUNICATION VALVE OPEN | 1.5 | -0.8 | 14.0 | | 0.0 |
| S13 | ↓ | P-HP DETECTION | 1.5 | | 0.0 | -14.0 | 0.0 |
| S14 | ↓ | WIPER PROTRUSION | 1.5 | | -1.0 | -1.0 | 2.6 |
| S15 | CAP OPEN | J-HP DETECTION | 0.0 | -1.5 | -1.0 | | 2.6 |
| S16 | ↓ | CAP OPEN | -0.6 | -0.6 | -1.0 | | 2.6 |
| S17 | WIPING | (CR WIPING) | -0.6 | | -1.0 | | 2.6 |
| S18 | ↓ | WIPER RETRACT | -0.6 | | 0.0 | 1.0 | 0.0 |
| S19 | PRINTING | (PRINTING) | -0.6 | | 0.0 | | 0.0 |
| *DURING CONTINUOUS PRINTING | ↓ | | -0.6 | | 0.0 | | 0.0 |
| S20 | WIPING | WIPER PROTRUSION | -0.6 | | -1.0 | -1.0 | 2.6 |
| S21 | ↓ | (CR WIPING) | -0.6 | | -1.0 | | 2.6 |
| S22 | ↓ | WIPER RETRACT | -0.6 | | 0.0 | 1.0 | 0.0 |
| S23 | ↓ | (CR-HP) | -0.6 | | 0.0 | | 0.0 |
| END S24 | STAND-BY | CAP CLOSE | 0.0 | 0.6 | 0.0 | | 0.0 |
| | | | | | | | |

FIG.29

| JOINT LIFTER | DRIVING POSITION | PUMP PISTON | DRIVING POSITION |
|---|---|---|---|
| UPPER LIMIT | 4.80 | RIGHT END | 19.50 |
| SUPPLY | 4.30 | SUCTION START | 19.00 |
| SUCTION | 2.30 | IDLE SUCTION START | 15.00 |
| IDLE SUCTION | 1.50 | HP STAND-BY | 0.00 |
| HP STAND-BY | 0.00 | WIPER PROTRUSION | -1.00 |
| PRINTING | -0.60 | SUPPLY START | -1.00 |
| LOWER END | -1.10 | LEFT END | -1.50 |

INK SUPPLY RECOVERY SYSTEM, INK-JET PRINTING APPARATUS AND IMAGE PICK-UP DEVICE HAVING RECORDING MECHANISM

This application is based on Patent Application No. 2000-277331 filed Sep. 12, 2000 in Japan, the content of which is incorporated hereinto by reference.

BACKGROUND OF THE INVENTION

1. Field of the Invention

The present invention relates generally to an ink supply recovery system and an ink supply recovery method performing ink supply and recovery of suction of the ink using a pit-in ink supply system and to an ink-jet printing apparatus having the ink supply recovery system. More particularly, the invention relates to an improvement for down-sizing of an ink supply recovery system and an ink-jet printing apparatus having the ink supply recovery system. Also, the invention relates to an image pick-up device having a recording mechanism including the down-sized ink supply recovery system.

2. Description of the Related Art

As an ink-jet printing apparatus, conventionally, there is a so-called serial scanning system having a movable carriage in a main scanning direction, on which a printing head as printing means and an ink tank as an ink container are exchangeably mounted. This printing system sequentially performs printing of image on a printing medium by repeating primary scanning of the carriage mounting the printing head and the ink tank and auxiliary scanning of the printing medium.

Considering realization of an ultra-compact printer suitable for PDAs or cameras, size of the carriage per se becomes small. Therefore, an ink storage capacity of the ink tank to be mounted on such a small carriage inherently becomes quite small.

When the capacity of the ink tank on the carriage is extremely small as set forth above, frequency of exchanging of the ink tank becomes high or to potentially cause necessity of exchanging of the ink tank during printing operation.

Therefore, in order to solve such problems, there has been proposed an ink supply system, in which whenever the carriage is placed at a predetermined stand-by position, an ink is supplied from a main tank provided independently of the carriage to a sub-tank on the carriage at an appropriate timing. Such ink supply system will be referred hereinafter as "pit-in ink supply system" for convenience of disclosure.

With such pit-in ink supply system, for example, at every occurrence of printing of one sheet of printing medium, the carriage is placed at the predetermined stand-by state to connect the sub-tank on the carriage with the main tank at an appropriate timing for supplying ink from the main tank to the sub-tank in connected condition. Thus, the problem of ink storage capacity of the sub-tank on the carriage can be solved.

On the other hand, in the foregoing pit-in ink supply system, an ink absorbing body, such as sponge or the like, is arranged in the sub-tank and a resupply of ink is carried out by introducing a negative pressure into the sub-tank through an air intake opening thereby introducing the ink from the main tank into the sub-tank through an ink introducing.

On the other hand, in the ink-jet printing system, when air penetrates into the inside of nozzles of the printing head and viscosity of the ink is increased by evaporation, or in other reason, the nozzles cause ink ejection failure to make it impossible to eject ink droplet from the nozzles. Therefore, a capping member covering a face of the printing head and suction means for sucking the ink from the nozzles of the printing head are provided for sucking and removing the ink not contributing for printing the image, from the tip end of the nozzles at certain timing.

In such pit-in ink supply system, a construction for suction of air for resupplying ink, suction recovery of the ink from the printing head and further recovery of ink supply for discharging of the sucked ink, become necessary. A portion of such construction occupies large proportion with respect to the overall printer.

Therefore, as set forth above, in order to realize an ultra-compact ink-jet printer adapted to compact electronic devices, such as those for PDAs, cameras or the like, it is important how to make the structural portion for recovering ink supply compact.

Particularly, in this case, a suction pump can be a bottle neck in down-sizing since such suction pump is required to perform suction of air and suction of ink.

Moreover, in the pit-in ink supply system of the printer for such compact electronic devices, it is expected to perform resupply of the ink and suction recovery every time of printing on one printing medium, normally. Therefore, it is also important how to complete a series of processes for ink supply and suction recovery efficiently in a short period.

SUMMARY OF THE INVENTION

The present invention has been worked out in view of the problems in the prior art as set forth above. Therefore, it is an object of the present invention to provide an ink supply recovery system which can realize down-sizing and can efficiently perform a series of supply recovery.

In a first aspect of the present invention, there is provided an ink supply recovery system comprising:

- a pack body including a main tank connected to an ink joint and storing an ink, and a waste ink receptacle means for receiving waste ink, the pack body being detachably mounted on a printer body;

on the printer body,

- a sub-tank mounted on a carriage, the sub-tank having a negative pressure introducing portion arranged with a porous membrane and an ink intake portion connectable with the ink joint, and taking ink into inside from the ink intake portion by a negative pressure introduced from the negative pressure introducing portion;
- a cap for capping ink ejection openings of a printing head ejecting the ink supplied from the sub-tank;
- a cylinder pump having
  - a reciprocally movable piston,
  - a cylinder body having an air suction chamber, defined on one side of the piston, connectable with the negative pressure introducing portion and an ink suction chamber, defined on the other side of the piston, connected with the cap via an input port and connectable with the waste ink receptacle means via an output port, and
  - port switching means for switching the input port and the output port open and close associating with movement of the piston; and
  - drive control means for controlling movement of the piston of the cylinder pump, switching of the port switching means, contacting and releasing of the cap relative to the printing head, contacting and releasing of the ink joint relative to the ink intake portion of the sub-tank, and contacting and releasing between the negative pressure introducing portion of the sub-tank and the air suction chamber.

Here, the drive control means may include means for contacting the cap with the printing head, jointing the ink joint with the ink intake portion of the sub-tank, connecting the negative pressure introducing portion of the sub-tank with the air suction chamber, closing the input port and opening the output port by the port switching means, and in this condition, moving the piston for reducing pressure in the air suction chamber and pressurizing the ink suction chamber so as to perform resupplying of ink from the main tank to the sub-tank and discharging of ink from the ink suction chamber to the waste ink receptacle means.

The drive control means may include means for contacting the cap with the printing head, releasing the ink joint from the ink intake portion of the sub-tank, disconnecting the negative pressure introducing portion of the sub-tank with the air suction chamber, opening the input port and closing the output port by the port switching means, and in this condition, moving the piston for pressurizing the air suction chamber and reducing pressure in the ink suction chamber so as to perform a suction recovery operation for sucking ink from ink ejection openings of the printing head.

The drive control means may include means for opening the atmosphere communication valve after a suction recovery operation of ink, and in this condition, moving the piston for pressurizing the air suction chamber and reducing pressure in the ink suction chamber so as to perform an idle suction recovery operation.

The pack body may include a wiper which can be projected and retracted for wiping of an ink ejection opening forming surface of the printing head, and the drive control means may include means for performing wiping by moving the carriage in a condition where the wiper is projected.

The ink intake portion may be a needle form formed with a through hole.

The piston rod of the piston of the cylinder pump may extend outside of a cylinder body through the ink suction chamber.

The port switching means may comprise a switching valve disposed within the ink suction chamber.

The printing medium may be incorporated in the pack body.

The printing head may eject ink by applying thermal energy to ink.

In a second aspect of the present invention, there is provided an ink supply recovery method comprising the steps of:

loading a pack body including a main tank connected to an ink joint and storing ink and a waste ink receptacle means on a printer main body, the printer main body including a sub-tank which is mounted on a carriage, has a negative pressure introducing portion arranged with a porous membrane and an ink intake portion, and supplies ink to a printing head, a cap for capping ink ejection openings of the printing head, and a cylinder pump including a reciprocally movable piston, a cylinder body having an air suction chamber defined on one side of the piston and connectable with the negative pressure introducing portion and an ink suction chamber defined on the other side of the piston, connected with the cap via an input port and connectable with the waste ink receptacle means via an output port, and port switching means for performing switching open and close of the input port and the output port associating with movement of the piston;

then contacting the cap on the printing head;

jointing the ink joint to the ink intake portion of the sub-tank;

interconnecting the negative pressure introducing portion of the sub-tank and the air suction chamber;

closing the input port and opening the output port by the port switching means; and in this condition moving the piston for reducing pressure in the air suction chamber and pressurizing the ink suction chamber for resupplying ink from the main tank to the sub-tank and discharging ink from the ink suction chamber to the waste ink receptacle means.

In a third aspect of the present invention, there is provided an ink supply recovery method comprising the steps of:

loading a pack body including a main tank connected to an ink joint and storing ink and a waste ink receptacle means on a printer main body, the printer main body including a sub-tank which is mounted on a carriage, has a negative pressure introducing portion arranged with a porous membrane and an ink intake portion, and supplies ink to a printing head, a cap for capping ink ejection openings of the printing head, and a cylinder pump including a reciprocally movable piston, a cylinder body having an air suction chamber defined on one side of the piston and connectable with the negative pressure introducing portion and an ink suction chamber defined on the other side of the piston, connected with the cap via an input port and connectable with the waste ink receptacle means via an output port, and port switching means for performing switching open and close of the input port and the output port associating with movement of the piston;

in this condition, contacting the cap on the printing head;

releasing the ink joint from the ink intake portion of the sub-tank;

disconnecting the negative pressure introducing portion of the sub-tank with the air suction chamber;

opening the input port and closing the output port by the port switching means; and in this condition, moving the piston for pressurizing the air suction chamber and reducing pressure in the ink suction chamber for performing a suction recovery operation for sucking ink from the ink ejection openings of the printing head.

Here, the printer main body may further include an atmospheric communication valve for opening and closing an atmosphere communication opening formed in the cap, the method may further comprises the steps of:

opening the atmosphere communication valve after the suction recovery operation of the ink; and in this condition, moving the piston for pressurizing the air suction chamber and reducing pressure in the ink suction chamber so as to perform an idle suction recovery operation.

Here, the pack body may further include a wiper, which is projectable or retractable, for wiping an ink ejection openings forming surface of the printing head, the method may further comprises a step of;

performing wiping by moving the carriage in the condition where the wiper is projected.

The above and other objects, effects, features and advantages of the present invention will become more apparent from the following description of embodiments thereof taken in conjunction with the accompanying drawings.

BRIEF DESCRIPTION OF THE DRAWINGS

FIG. 22 is a perspective view shown a construction of a joint lifer, carriage and so on;

FIG. 29 is a table diagram showing one example of an operation sequence of the ink supply recovery process;

DETAILED DESCRIPTION OF PREFERRED EMBODIMENTS

Hereinafter, embodiments of the present invention will be explained based on the drawings.

In the present specification, "printing" (also referred to as "recording" in some cases) means not only a condition of forming significant information such as characters and drawings, but also a condition of forming images, designs, patterns and the like on printing medium widely or a condition of processing the printing mediums, regardless of significance or unmeaning or of being actualized in such manner that a man can be perceptive through visual perception.

Also, a "printer" and a "recording apparatus" mean not only one complete apparatus for carrying out a printing but also an apparatus having a function for printing.

Further, the "printing medium" means not only paper used in a conventional printing apparatus but also everything capable of accepting inks, such like fabrics, plastic films, metal plates, glasses, ceramics, wood and leathers, and in the following, will be also represented by a "sheet" or simply by "paper".

Further, in the present specification, a "camera" indicates an apparatus or device that optically photographs an image and converts the photographed image into electrical signals, and in the following explanation, is also referred to as a "photographing section".

Still further, an "ink" (also referred to as "liquid" in some cases) should be interpreted in a broad sense as well as a definition of the above "printing" and thus the ink, by being applied on the printing mediums, shall mean a liquid to be used for forming images, designs, patterns and the like, processing the printing medium or processing inks (for example, coagulation or encapsulation of coloring materials in the inks to be applied to the printing mediums).

Meantime, one embodiment of a head to which the present invention is advantageously employed is the embodiment in which thermal energy generated by an electrothermal converter is utilized to cause a film boiling to the liquid resulting in a formation of bubbles.

Basic Structure

Firstly, a basic structure of a device according to the present invention will be explained in view of FIGS. 1 to 14. The device explained in the present embodiments is constituted as an information processing equipment comprising a photographing section for optically photographing an image and then converting the photographed image into electric signals (hereinafter, also referred to as "camera section") and an image recording section for recording image on the basis of thus obtained electric signals (hereinafter, also referred to as "printer section"). Hereinafter, the information processing equipment in the present embodiments is explained in the name of a "printer-built-in camera".

Figure 5:
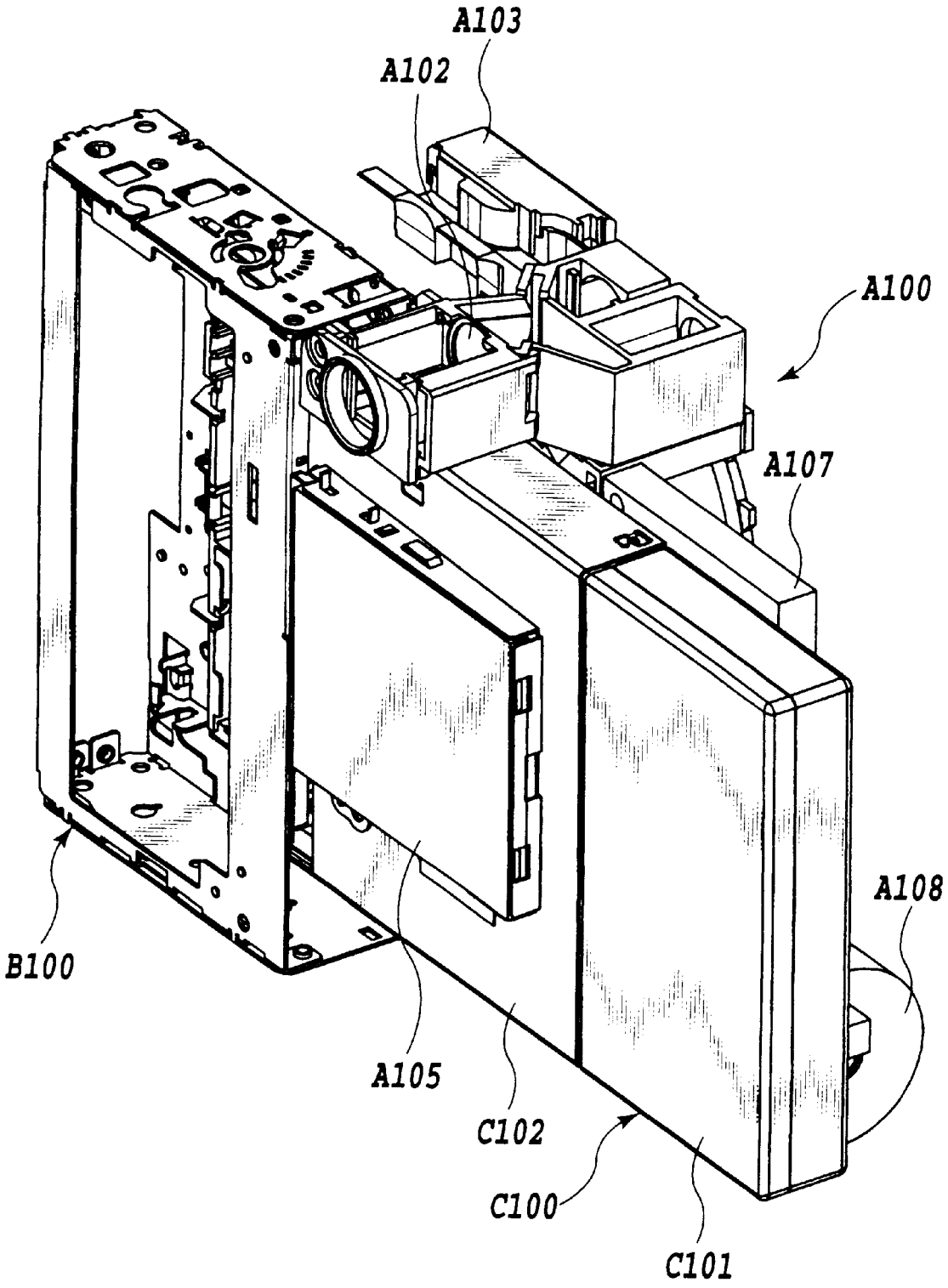
FIG. 5 is a perspective view showing an arrangement of major components within the camera of FIG. 1.

In a main body A001, there is incorporated a printer section (recording apparatus section) B100 at the backside of a camera section A100 in an integral manner. The printer section B100 records an image by using inks and printing medium which are supplied from a medium pack C100. In the present structure, as apparent from FIG. 5 illustrating the main body A001 viewing from the backside with an outer package removed, the medium pack C100 is inserted at the right hand of the main body A001 in FIG. 5 and the printer section B100 is arranged at the left hand of the main body A001 in FIG. 5. In the case of performing a recording by the printer section B100, the main body A001 can be placed facing a liquid crystal display section A105 up and a lens A101 down. In this recording position, a recording head B120 of the printer section B100, which will be described below, is made to be positioned to eject inks in the downward direction. The recording position can be made to be the same position as that of photographing condition by the camera section A100 and thus is not limited to the recording position as mentioned above. However, in view of a stability of a recording operation, the recording position capable of ejecting the inks in the downward direction is preferred.

There follows the explanations of the basic mechanical structure according to the present embodiment under the headings of 1 as "Camera Sections", 2 as "Medium Pack" and 3 as "Printer Section", and of the basic structure of the signal processing under the heading of 4 as "Signal Processing".

1: Camera Section

Figure 1:
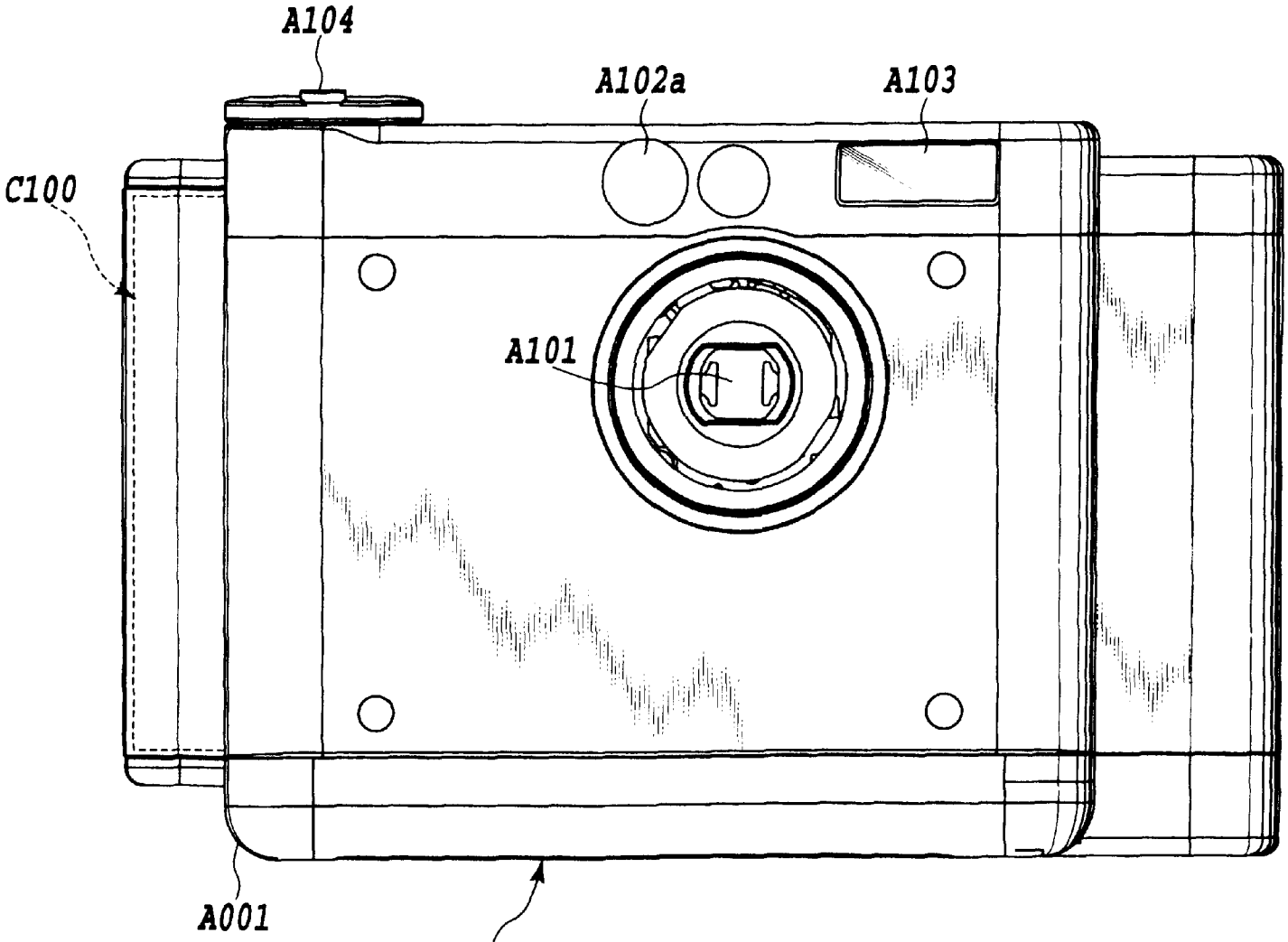
FIG. 1 is a front elevation of a printer-built-in camera, to which the present invention is applicable.
Figure 2:
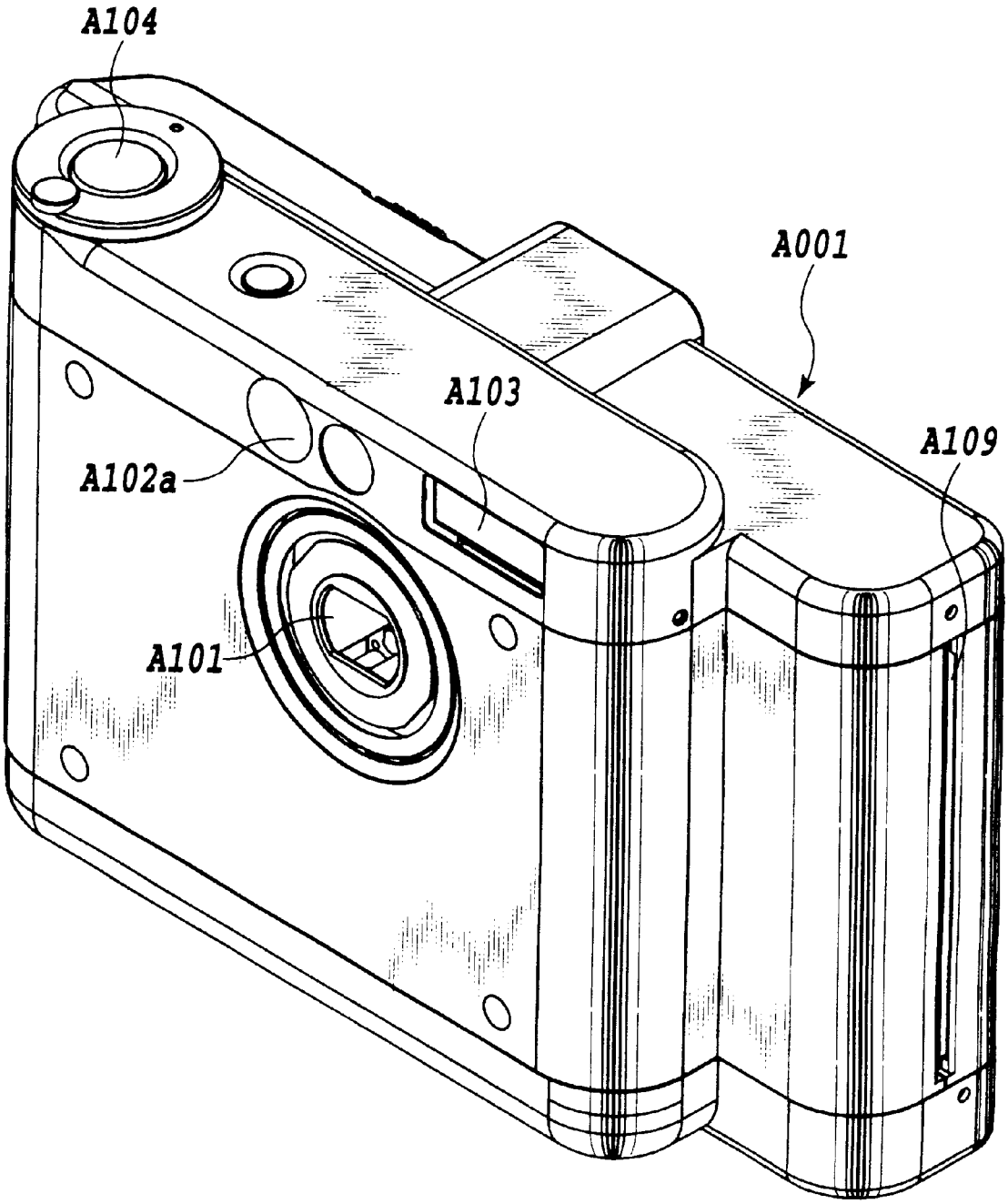
FIG. 2 is a perspective view of the camera of FIG. 1 as viewed from diagonally front side.
Figure 3:
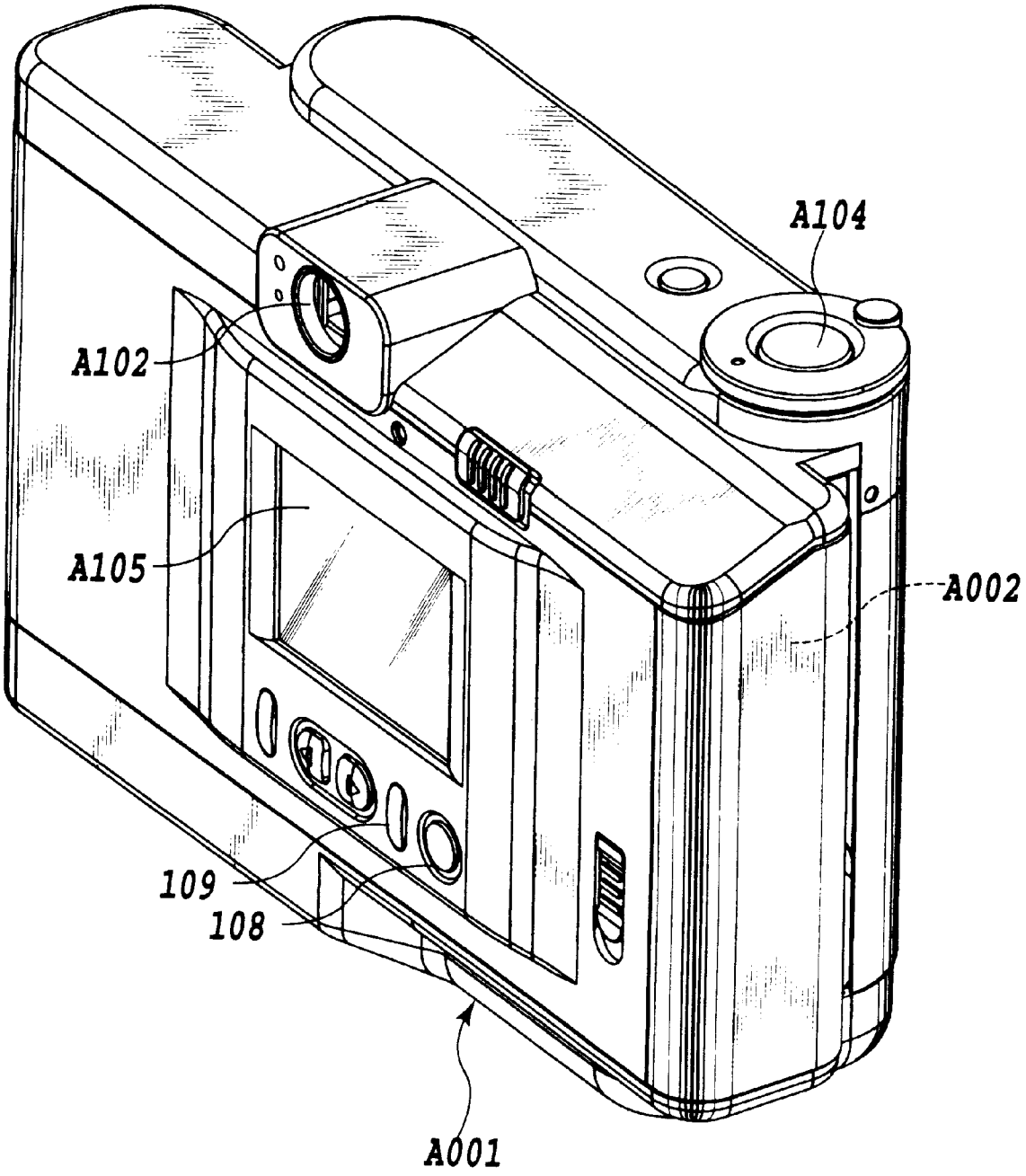
FIG. 3 is a perspective view of the camera of FIG. 1 as viewed from diagonally back side.

The camera section A100, which basically constitutes a conventional digital camera, constitutes the printer-built-in digital camera having an appearance in FIGS. 1 to 3 by being integrally incorporated into the main body A001 together with a printer section B100 described below. In FIGS. 1 to 3, A101 denotes a lens; A102 denotes a viewfinder; A102*a* denotes a window of the viewfinder; A103 denotes a flush; A104 denotes a shutter release button; and A105 denotes a liquid crystal display section (outer display section). The camera section A100, as described below, performs a processing of data photographed by CCD, a recording of the images to a compact flash memory card (CF card) A107, a display of the images and a transmission of various kinds of data with the printer section B100. A109 denotes a discharge part for discharging a printing medium C104 on which the photographed image is recorded. A108, as shown in FIG. 5, is a battery as a power source for the camera section A100 and the printer section B100.

2: Medium Pack

Figure 4:
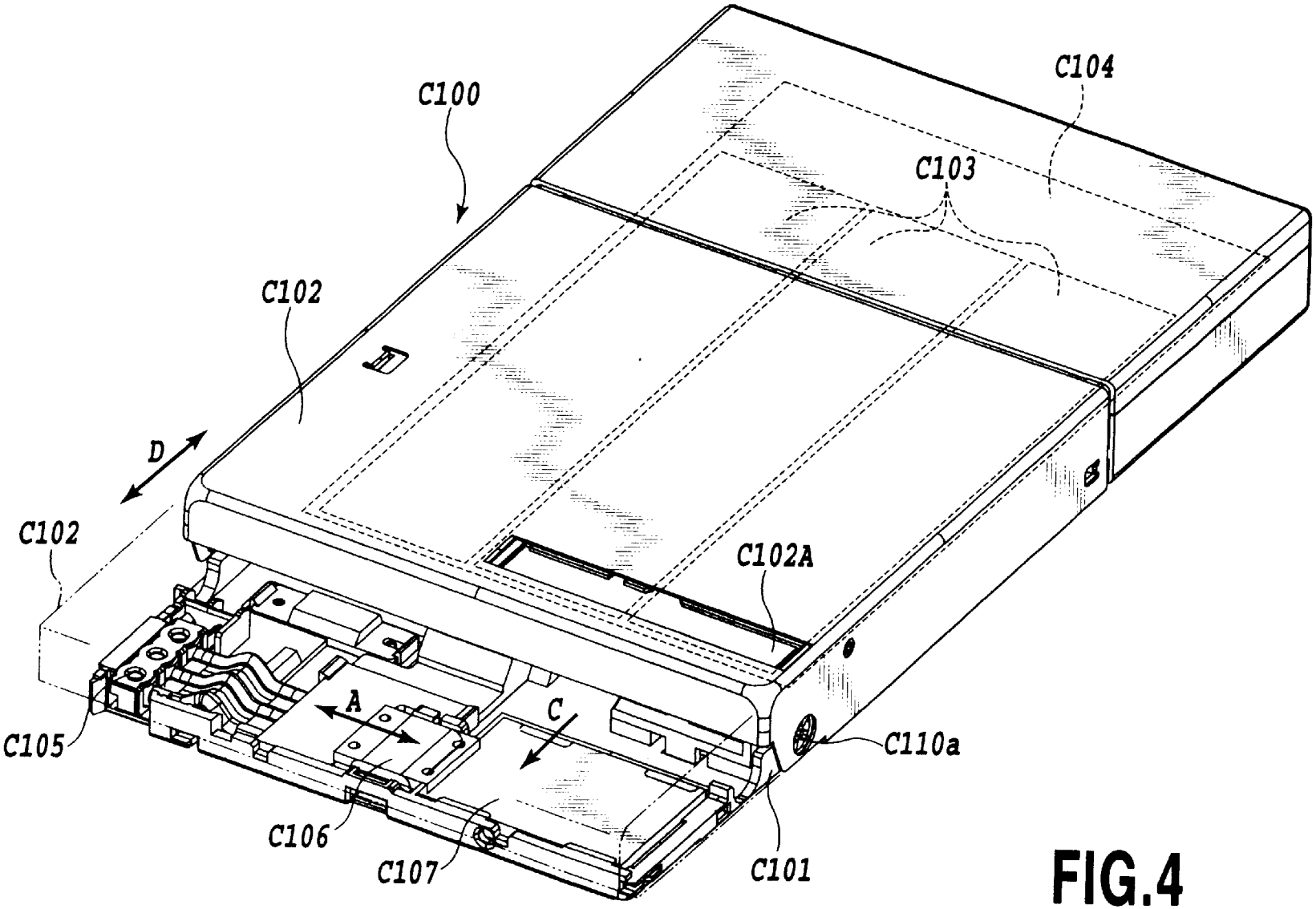
FIG. 4 is a perspective of a medium pack which can be loaded in the camera of FIG. 1.

A medium pack C100 is detachable relating to a main body A001 and, in the present embodiment, is inserted through an inserting section A002 of the main body A001 (see FIG. 3), thereby being placed in the main body A001 as shown in FIG. 1. The inserting section A002 is closed as shown in FIG. 3 when the medium pack C100 is not inserted therein, and is opened when the medium pack is inserted therein. FIG. 5 illustrates a status wherein a cover is removed from the main body A001 to which the medium pack C100 is inserted. As shown in FIG. 4, a shutter C102 is provided with a pack body C101 of the medium pack C100 in such manner being slidable in an arrow D direction. The shutter C102, which slides to stay at a position indicated by the two-dots-and-dashed lines in FIG. 4 when the medium pack C100 is not inserted in the main body A001, while slides to a position indicated by the solid lines in FIG. 4 when the medium pack C100 is placed in the main body A001.

The pack body C101 contains ink packs C103 and printing mediums C104. In FIG. 4, the ink packs C103 are held under the printing mediums C104. In the case of the present embodiment, three ink packs C103 are provided so as to separately hold the inks of Y (yellow), M (magenta) and C (cyan), and about twenty sheets of the printing mediums C104 are stored in pile. A suitable combination of those inks and the printing mediums C104 for recording an image is selected to be stored within the medium pack C100. Accordingly, the various medium packs C100 each having a different combination of the inks and the printing mediums (for example, medium packs for super high-quality image; for normal image; and for sealing (seal partitioning)) are prepared and, according to a kind of images to be recorded and an use of the printing medium on which an image is formed, those medium packs C100 are selectively inserted in the main body A001, thereby being able to perform an ensured recording of the images in compliance with the purpose by employing the most suitable combination of the ink and the printing medium. Further, the medium pack C100 is equipped with the below-mentioned EEPROM to which is recorded the identification data such as kinds or remaining amounts of the inks and the printing mediums contained in the medium pack.

The ink pack C103, upon the medium pack C100 is inserted in the main body A001, is connected to an ink supplying system in the main body A001, through three joints C105 each corresponding to the respective inks of Y, M and C. On the other hand, the printing mediums C104 are separated one by one using a separating mechanism which is not shown in the figures and then sent to a direction of an arrow C by a paper feeding roller C110 (see FIG. 9). A driving force of the paper feeding roller C110 is supplied from an after-mentioned conveying motor M002 (see FIG. 9) provided on the main body A001 through a connecting portion C110*a*.

Further, the pack body C101 comprises a wiper C106 for wiping a recording head of the after-mentioned printer section, and an ink absorption body C107 for absorbing the abolished inks discharged from the printer section. The recording head in the printer section reciprocates in a direction of the main scanning direction as indicated by an arrow A in such manner describing below. When the medium pack C100 is in the status of being removed from the main body A001, the shutter C102 slides to an position indicated by the two-dots-and-dashed lines in FIG. 4 to protect the joints C105, the wiper C106, the ink absorbing body C107 and so on.

3: Printer Section

The printer section B100 according to the present embodiment is a serial type employing an ink jet recording head. This printer section B100 is explained under the headings of 3-1 "Printing Operating Section"; 3-2 "Printing Medium Carrying"; and 3-3 "Ink Supplying System", respectively.

3-1: Printing Operating Section

Figure 6:
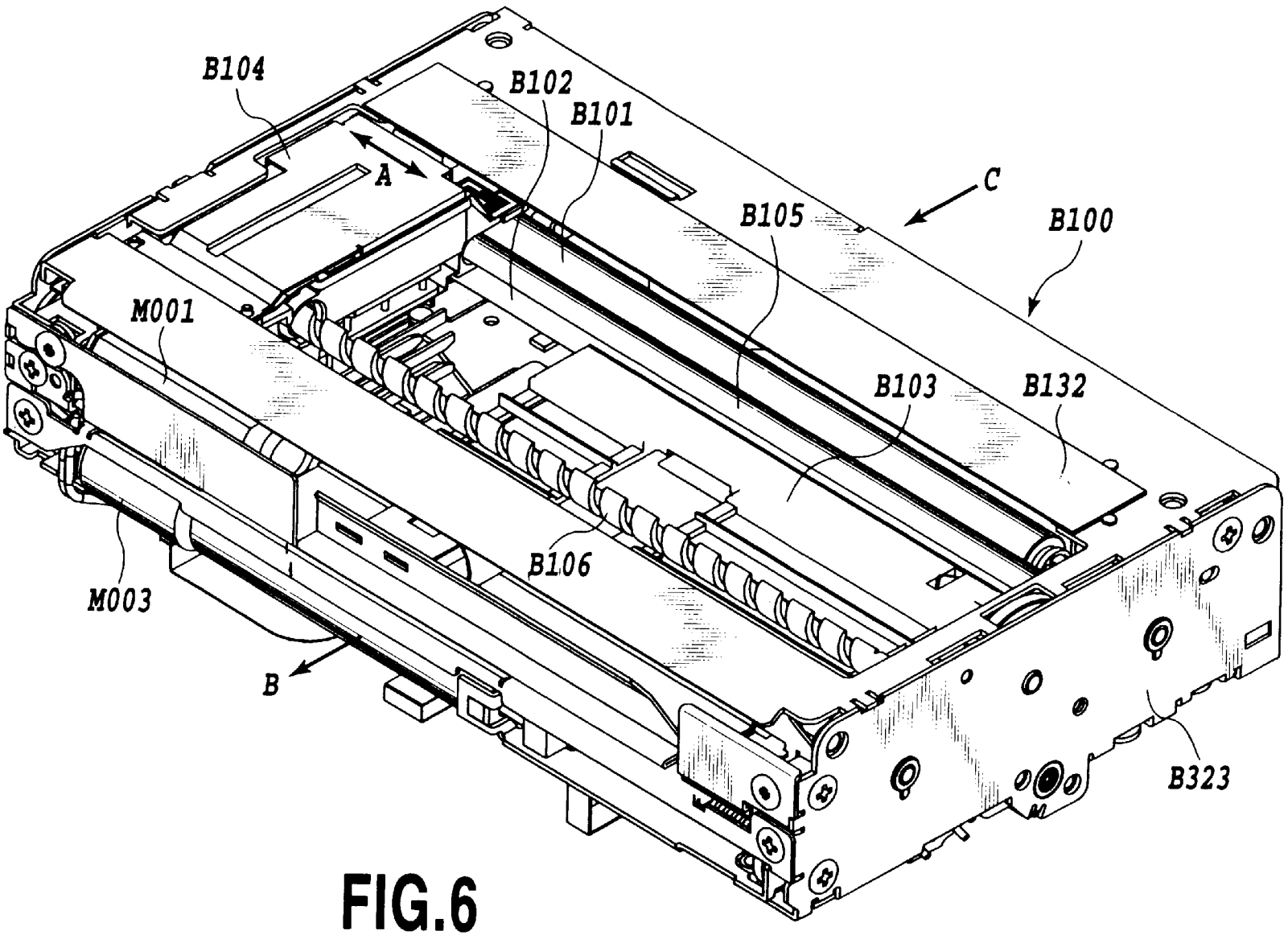
FIG. 6 is a perspective view of a printer portion in FIG. 5.
Figure 7:
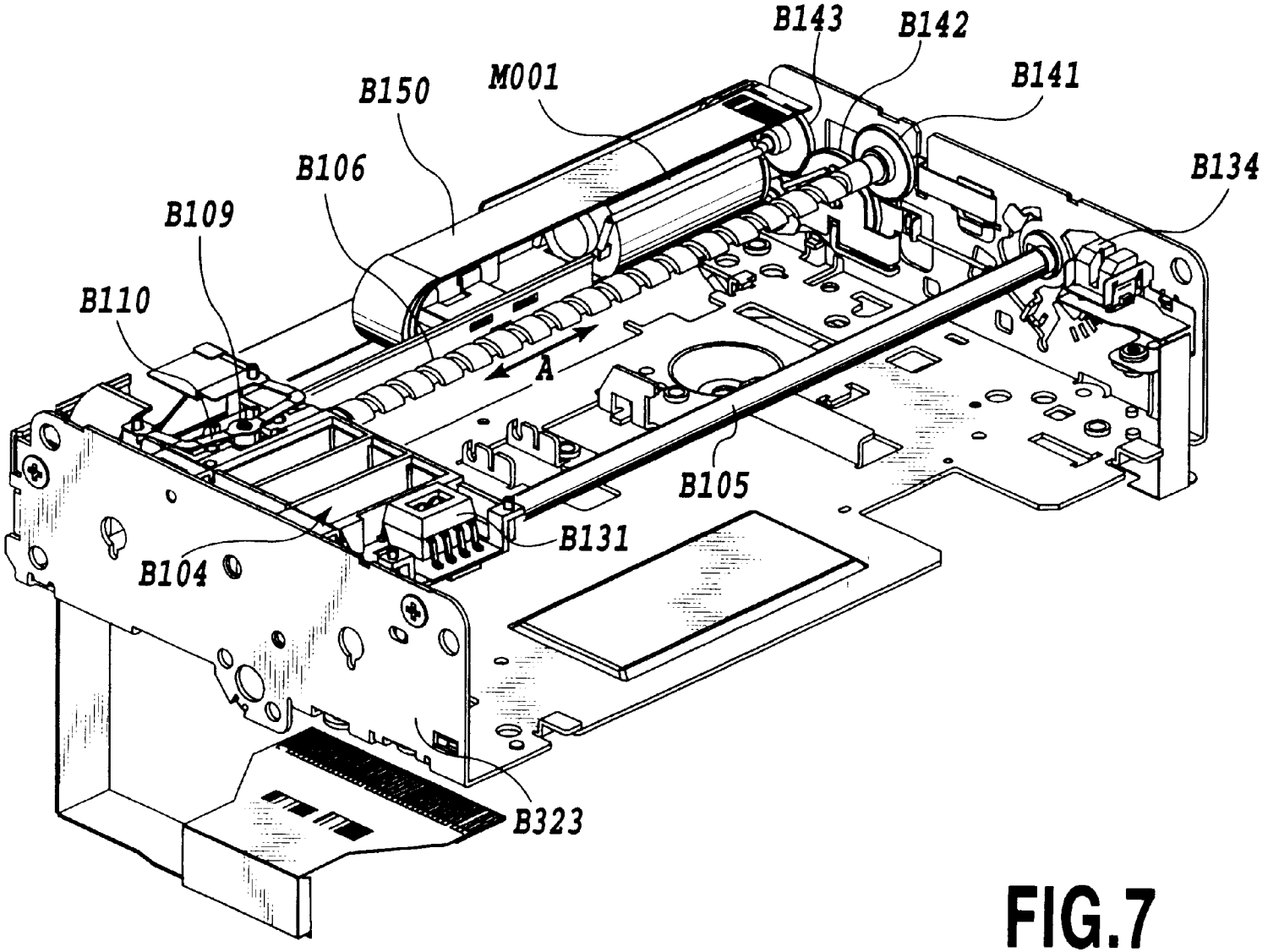
FIG. 7 is a perspective view illustrated in a condition where a part of the printer portion of FIG. 6 is removed.

FIG. 6 is a perspective view illustrating the entire printer section B100, and FIG. 7 is a perspective view illustrating the printer section B100 with a part partially taken out.

At a predetermined position in the main body of the printer section B100, a tip portion of the medium pack C100 is positioned when the medium pack C100 is placed in the main body A001 as shown in FIG. 5. The printing medium C104 sent to the direction of an arrow C from the medium pack C100, while being sandwiched between a LF roller B101 and a LF pinch roller B102 of the below-mentioned printing medium carrying system, is carried to the sub-scanning direction indicated by an arrow B on a pressure plate B103. B104 denotes a carriage which reciprocates toward a main scanning direction indicated by an arrow A along a guiding shaft B105 and a leading screw B106.

Figure 8:
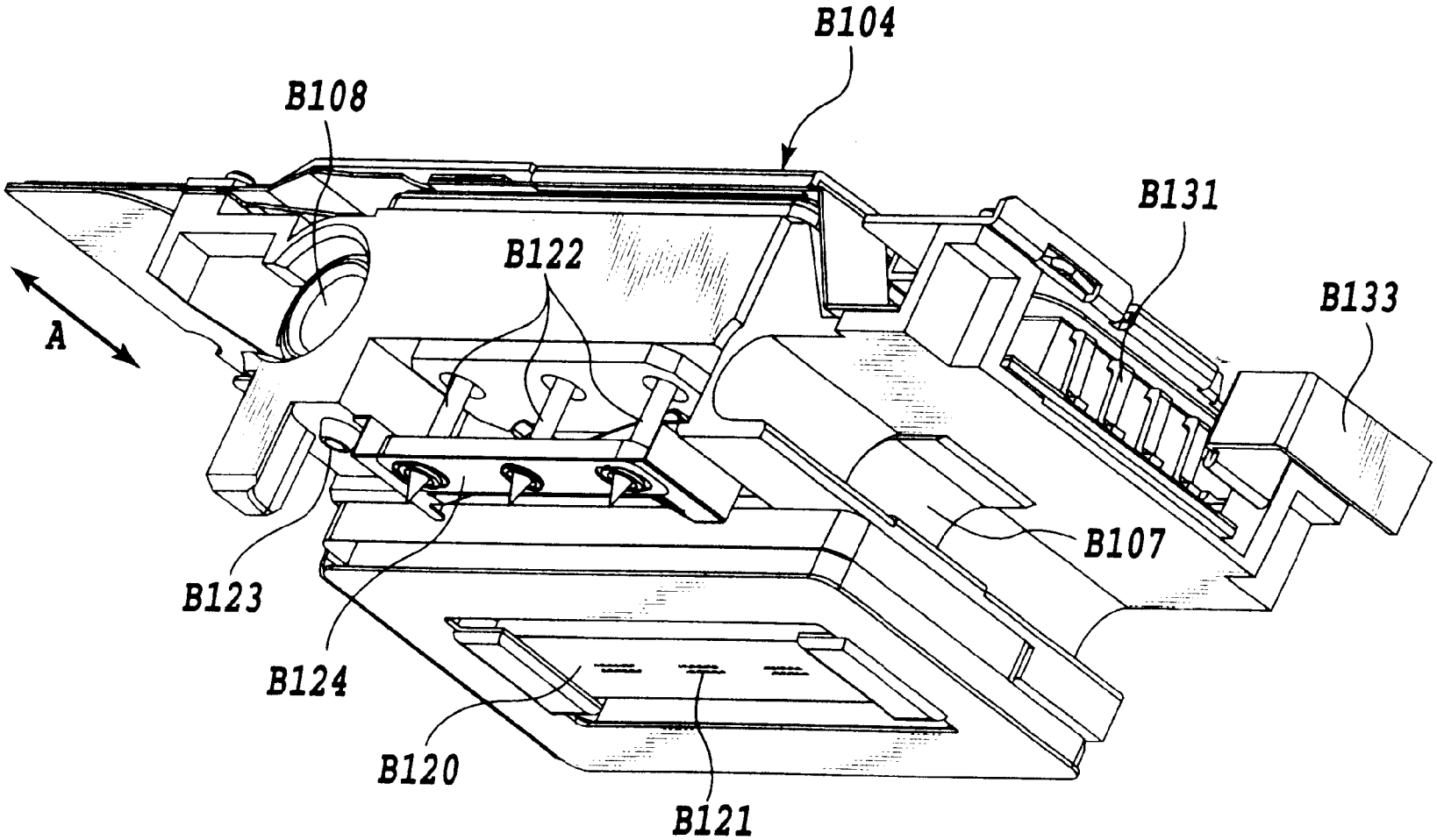
FIG. 8 is a perspective view of a carriage in the printer portion of FIG. 6.

As shown in FIG. 8, the carriage B104 is provided with a bearing B107 for a guiding shaft B105 and a bearing B108 for a leading screw B106. At a fixed position of the carriage B104, as shown in FIG. 7, a screw pin B109 projecting toward an interior of the bearing B108 is installed by a spring B110. A fit of a tip of the screw pin B109 to a helical thread formed on the outer circumference of the leading screw B106 converts a rotation of the leading screw B106 to a reciprocating movement of the carriage B104.

The carriage B104 is equipped with an ink jet recording head B120 capable of ejecting the inks of Y, M and C, and a sub-tank (not shown) for reserving inks to be supplied to the recording head B120. On the recording head B120, a plurality of ink ejection openings B121 (see FIG. 8), which are aligned with the direction crossing with the main scanning direction indicated by the arrow A (in the present embodiment, an orthogonal direction), are formed. The ink ejection openings B121 form nozzles capable of ejecting inks supplied from the sub-tank. As a generating means of energy for discharging the inks, an electro-thermal converting element equipped with each of the nozzles may be used. The electro-thermal converting element generates bubble in the inks within the nozzle by a heating and thus generated foaming energy causes an ejection of the ink droplet from the ink ejection opening B121.

The sub-tank has a capacity smaller than the ink packs C103 contained in the media pack C100 and made to be a sufficient size for storing a required amount of ink for recording an image corresponding to at least one sheet of printing medium C104. In the sub-tank, there are ink reserving sections for each of the inks of Y, M and C, on each of which is formed the ink supplying section and the negative pressure introducing sections, wherein those ink supplying sections are individually connected to the corresponding three hollow needles B122 and those negative pressure introducing sections are also connected to a common air suction opening B123. Such ink supplying sections, as will be mentioned below, are supplied with inks from the ink packs C103 in the medium pack C100 when the carriage B104 moves to a home position as illustrated in FIG. 6.

In the carriage B104 in FIG. 8, B124 denotes a needle cover which is moved to a position for protecting the needles B122 by the force of the springs as illustrated in FIG. 8 when the needles B122 and the joints C105 are not mated each other, and which releases a protection of the needles B122 by being pushed upwardly against the force of the springs in FIG. 8 when the needles B122 and the joints C105 are mated with each other. A movement position of the carriage B104 is detected by an encoder sensor B131 on the carriage B104 and a linear scale B132 (see FIG. 6) on the main body of the printer section B100. Also, a fact that the carriage B104 moves to the home position is detected by a HP (home position) flag B133 on the carriage B104 and a HP sensor B134 (see FIG. 7) on the main body of the printer section B100.

In FIG. 7, at the both ends of the guiding shaft B105, supporting shafts (not shown) are provided at a position eccentric to the center axis of the guiding shaft. The guiding shaft B105 is turned and adjusted upon the supporting shaft, thereby controlling a height of the carriage 104, resulting in achieving an adjustment of a distance between the recording head B120 and the printing medium C104 on the pressure plate B103. The leading screw B106 is rotatably driven by a carriage motor M001 through a screw gear B141, an idler gear B142 and a motor gear B143. B150 denotes a flexible cable for electrically connecting the after-mentioned controlling with the recording head B120.

The recording head B120 moves together with the carriage B104 toward the main scanning direction indicated by the arrow A and concurrently ejects the inks from the ink ejection openings B121 in accordance with the image signals, thereby recording an image corresponding to one band on the printing medium on the pressure plate B103. An alternate repeat of a recording operation of an image corresponding to one band by such recording head B120 and a conveying operation of the predetermined amount of the printing medium toward the sub-scanning direction indicated by the arrow B by means of the below-mentioned printing medium conveying system enables a sequential recording of the images on the printing medium.

3-2: Printing Medium Carrying

Figure 9:
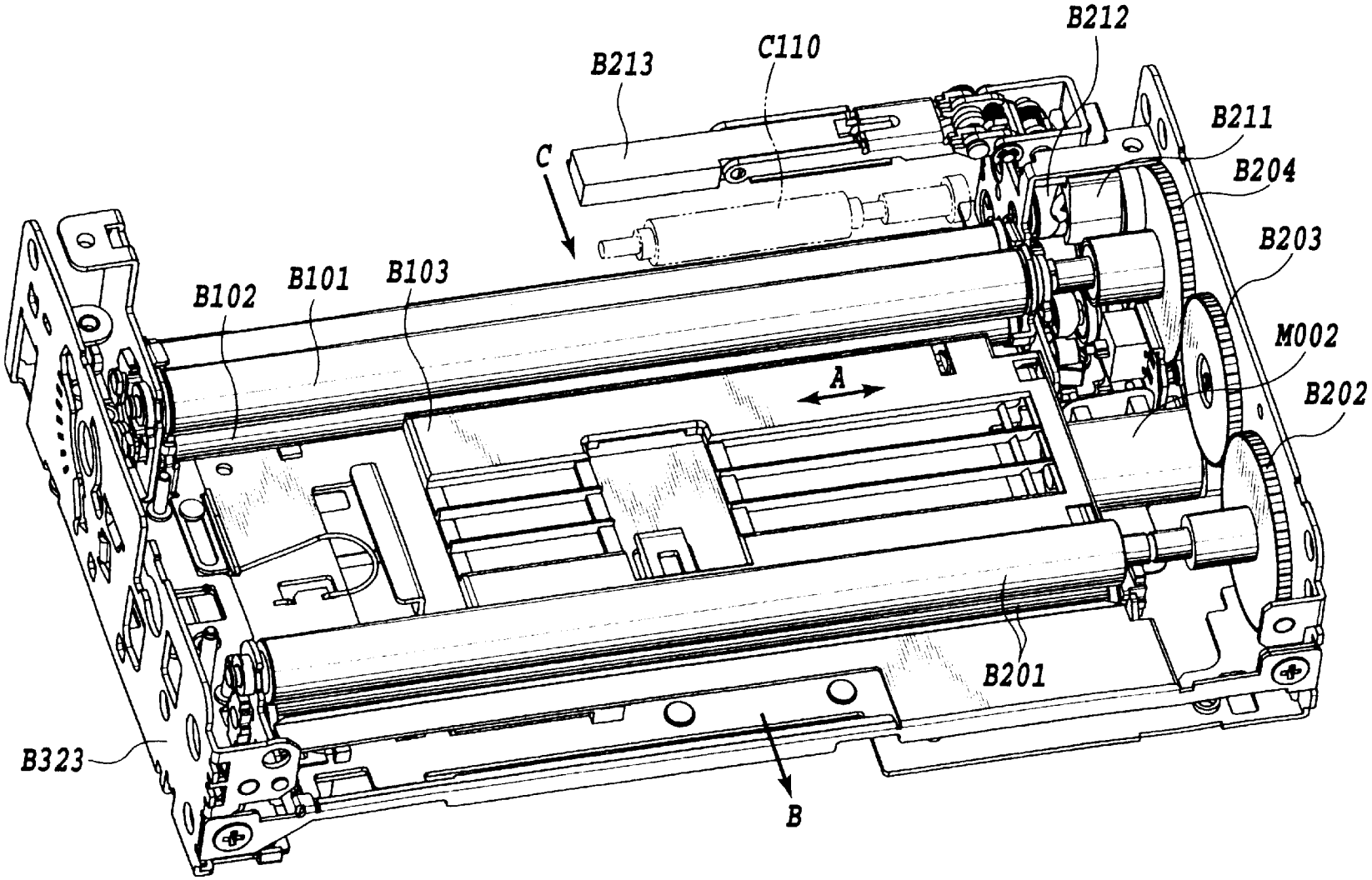
FIG. 9 is a perspective view of components of a printing medium transporting system in the printer portion of FIG. 6.

FIG. 9 is a perspective view showing a component of the printing medium conveying system of the printer section B100. In FIG. 9, B201 denotes a pair of paper delivering rollers, and the upper one of the paper delivering rollers B201 in FIG. 9 is driven by a conveying motor M002 through the paper delivering roller gear B202 and a junction gear B203. Likewise, the aforementioned LF roller B101 is driven by the conveying motor M002 through a LF roller gear B204 and the junction gear B203. The paper delivering roller B201 and the LF roller B101 convey the printing medium C104 toward the sub-scanning direction indicated by the arrow B by a driving force of the conveying motor M002 rotating in the forward direction.

On the other hand, when the conveying motor M002 couterrotates, a pressure plate head B213 and a locking mechanism which is not shown are driven through a switching slider B211 and a switching cam B212, while a driven force is transmitted to the paper feeding roller C110 on the medium pack C100. That is, the pressure plate head B213 pressurizes the printing mediums C104, which are piled up within the medium pack C100, in a downward direction in FIG. 4 by a driven force caused by a reverse rotation of the carrying motor M002, through a window portion C102A (see FIG. 4) of a shutter C102 of the medium pack C100. As a result thereof, the printing medium C104 positioned at the lowest position in FIG. 4 is pressed against the feeding roller C110 in the medium pack C100. Also, the locking mechanism which is not shown locks the medium pack C100 to the main body A001 to inhibit a removal of the medium pack C100. The feeding roller C110 of the medium pack C100 feeds one piece of the printing medium C104 at the lowest position in FIG. 4 toward the direction indicated by the arrow C as a result that the driven force caused by the reverse rotation of the conveying motor M002 is transmitted.

As stated above, only one piece of printing medium C104 is taken out from the medium pack C100 toward the direction indicated by the arrow C by the reverse rotation of the conveying motor M002, and then a forward rotation of the conveying motor M002 conveys the printing medium C104 to the direction indicated by the arrow B.

3-3: Ink Supplying System

Figure 10:
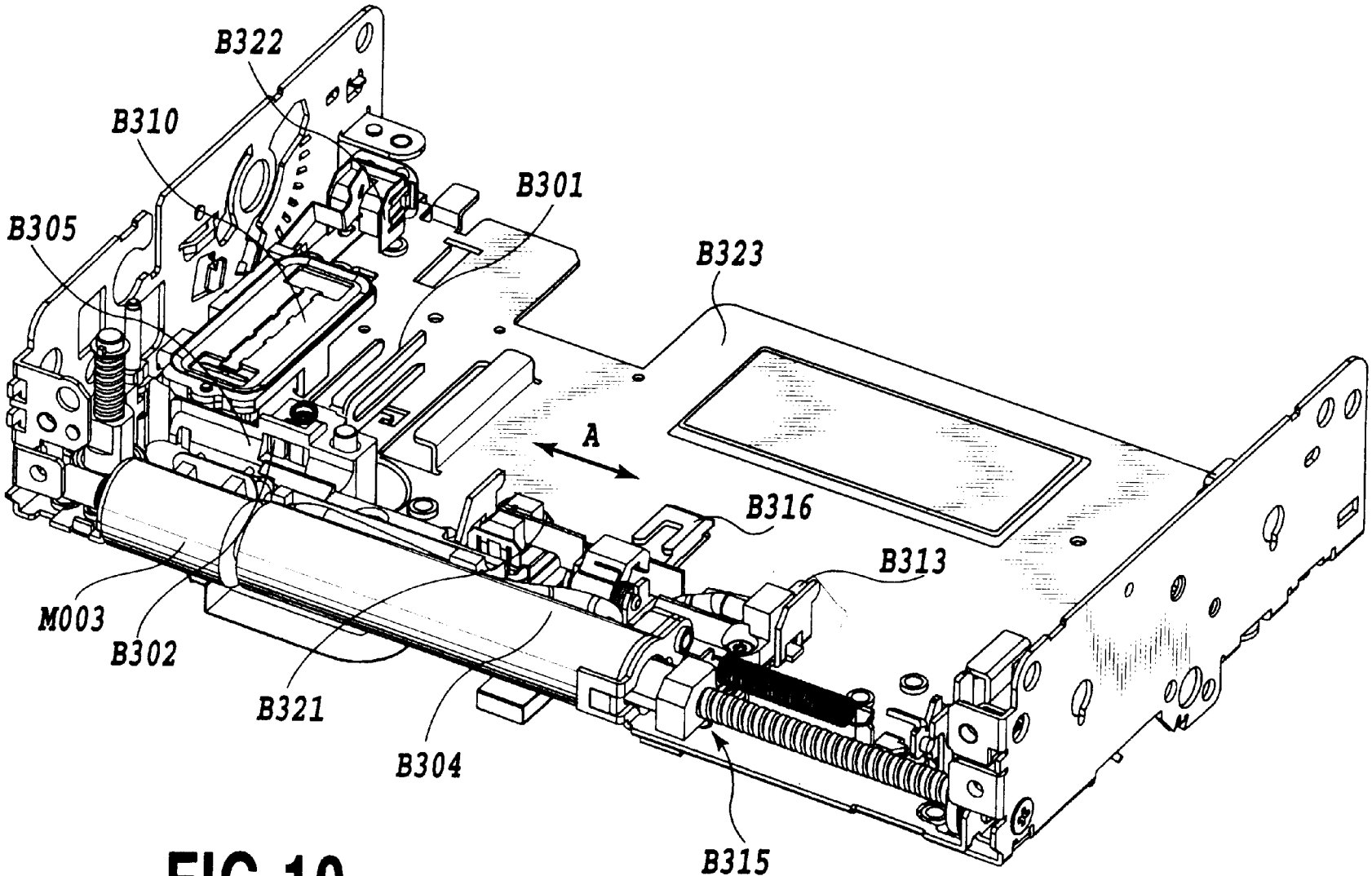
FIG. 10 is a perspective of components of an ink supply system in the printer portion of FIG. 6.
Figure 11:
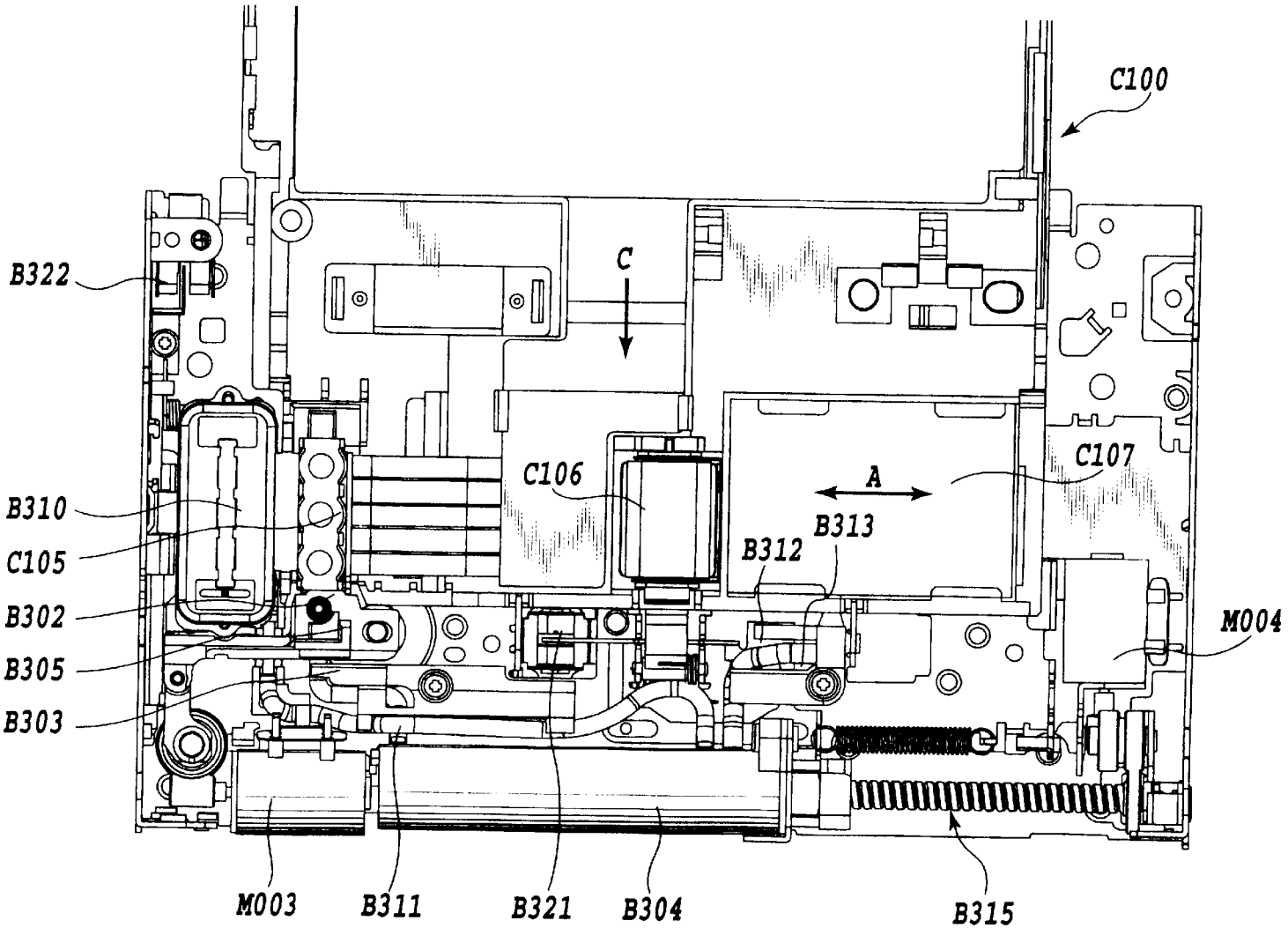
FIG. 11 is a plan view illustrating a condition where a medium pack is loaded in a component of the ink supply system of FIG. 10.

FIG. 10 is a perspective view showing a component part of an ink supplying system of the printer section B100: FIG. 11 is a plane view showing a status that the medium pack C100 is inserted in the component part of the ink supplying system.

A joint C105 of the medium pack C100 installed to the printer section B100 is positioned below the needles B122 (see FIG. 8) on the carriage B104 moved to a home position. The main body of the printer section B100 is equipped with a joint fork B301 (see FIG. 10) positioned below a joint C105, and an upward movement of the joint C105 caused by the joint fork B301 establishes a connection of the joint C105 to the needles B122. As a result thereof, an ink supplying path is formed between the ink packs C103 in the medium pack C100 and the ink supplying sections on the sub-tank on the carriage B104. Further, the main body of the printer section B100 is equipped with a suction joint B302 positioned below an air suction opening B123 (see FIG. 8) of the carriage B104 moved to the home position. This suction joint B302 is connected to a pump cylinder B304 of a pump serving as a negative pressure generating source, through a suction tube B304. The suction joint B302 is connected to the air suction opening B123 on the carriage B104 according to the upward movement caused by a joint lifter B305. In the light of the foregoing, a negative pressure introducing path, between a negative pressure introducing section of the sub-tank on the carriage B104 and the pump cylinder B304, is formed. The joint lifter B305 makes the joint fork B301 move up and down together with the suction joint B302 by a driving power of the joint motor M003.

The negative pressure introducing section of the sub-tank is equipped with a gas-liquid partition member (not shown) which allows a passing through of air but prevents a passing through of the inks. The gas-liquid partition member allows a passing through of the air in the sub-tank to be suctioned through the negative pressure introducing path, and as a result, an ink is supplied to the sub-tank from the medium pack C100. Then, when the ink is sufficiently supplied to the extent that the ink in the sub-tank reaches to the gas-liquid partitioning member, the gas-liquid partitioning member prevents the passing through of the inks, thereby automatically stopping a supply of the inks. The gas-liquid partitioning member is equipped with the ink supplying section in the ink storing sections for the respective inks in the sub-tank, and thus the ink supplying is automatically stopped with respect to each ink storing section.

The main body of the printer section B100 is further equipped with a suction cap B310 capable of capping with respect to the recording head B120 (see FIG. 8) on the carriage B104 which moved to the home position. The suction cap B310 is introduced the negative pressure thereinto from the pump cylinder B304 through suction tube B311, so that the inks can be suctioned and emitted (suction recovery processing) from the ink ejection openings B121 of the recording head B120. Further, the recording head B120, as required, makes the ink, which does not contribute to a recording of an image, ejection into the suction cap B310 (preliminary ejection processing). The ink within the suction cap B310 is discharged into the ink absorption body C107 in the medium pack C110 from the pump cylinder B304 through a waste water liquid tube B312 and a waste liquid joint B313.

The pump cylinder B304 constitutes a pump unit B315 together with a pump motor M004 for enabling a reciprocate drive of the pump cylinder. The pump motor M004 also functions as a driving source by which a wiper lifter B316 (see FIG. 10) is moved up and down. The wiper lifter B316 makes the wiper C106 of the medium pack C100 placed in the printer section B100 move upwardly, thereby displacing the wiper C106 to a position capable of a wiping of the recording head B120.

In FIGS. 10 and 11, B321 denotes a pump HP sensor for detecting if an operating position of the pump, which is constituted by the pump cylinder B304, lies at the home position. Further, B322 denotes a joint HP sensor for detecting if the aforementioned ink supplying path and the negative pressure introducing path were formed. Still further, B323 denotes a chassis for constituting a main body of the printer section B100.

4: Signal Processing

Figure 12:
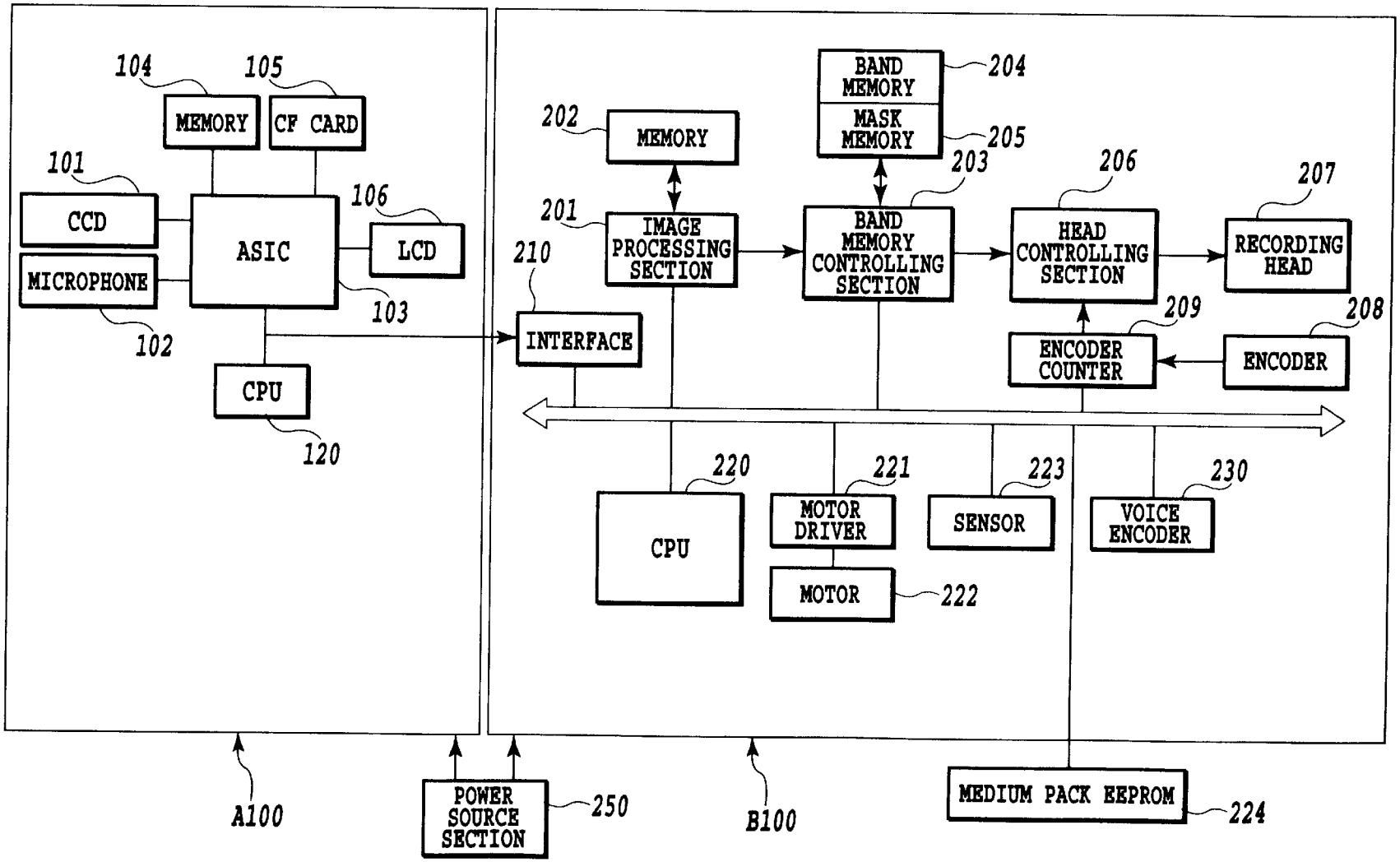
FIG. 12 is a schematic block diagram of a camera portion and the printer portion in the camera of FIG. 1.

FIG. 12 is a block diagram generally showing the camera section A100 and the printer section B100.

In the camera section A100, 101 denotes a CCD as an image element; 102 denotes a microphone for inputting voice; 103 denotes an ASIC (Application Specific IC) for performing various processings; 104 denotes a first memory for temporary storing an image date and the like; 105 denotes a CF (compact flush) card (corresponding to a "CF card A107") for recording the photographed image; 106 denotes a LCD (corresponding to a "liquid crystal display section A105") which displays the photographed image or a replayed image; and 120 denotes a first CPU for controlling the camera section A100.

In the printer section B100, 210 denotes an interface between the camera section A100 and the printer section B100; 201 denotes an image processing section (including a binary processing section for binarizing an image); 202 denotes a second memory to be used in performing the image processing; 203 denotes a band memory controlling section; 204 denotes a band memory; 205 denotes a mask memory; 206 denotes a head controlling section; 207 denotes a recording head (corresponding to the "recording head B120"); 208 denotes an encoder (corresponding to the "encoder sensor B131"); 209 denotes an encoder counter; 220 denotes a second CPU for controlling the printer section B100; 221 denotes motor drivers; 222 denotes motors (corresponding to the motors M001, M002, M003 and M004"); 223 denotes sensors (including the "HP sensors B134, B321 and B322"); 224 denotes an EEPROM contained in the medium pack C100; 230 denotes a voice encoder section and 250 denotes a power source section for supplying electric power to the entire device (corresponding to the "battery A108").

Figure 13:
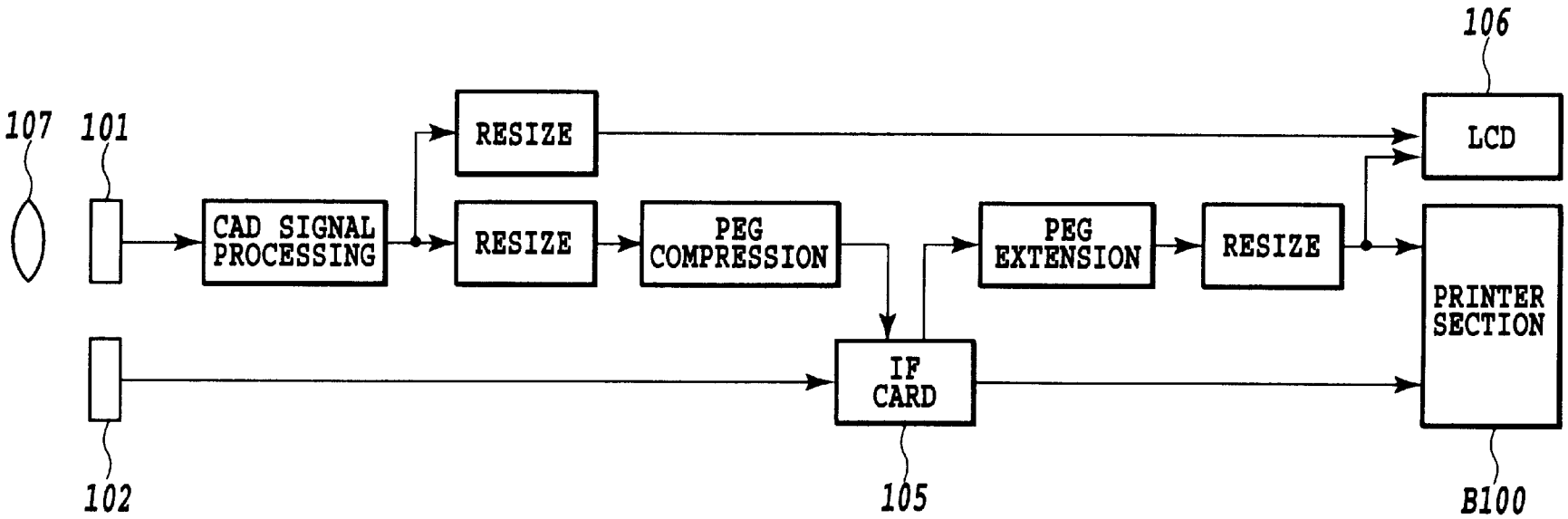
FIG. 13 is an explanatory illustration of a signal processing in the camera portion of FIG. 12.

FIG. 13 is a schematic diagram showing a signal processing in the camera section A100. In a photographing mode, an image photographed by the CCD 101 through a lens 107 is signal-processed (CCD signal processing) by ASIC 103 and then is converted to YUV intensity with two-color-different signal. Further, the photographed image is resized to a predetermined resolution and recorded on a CF card 105 using a compression method by JPEG, for example. Also, a voice is inputted through a microphone 102 and stored in the CF card 105 through the ASIC 103. A recording of the voice can be performed in such manner recording at the same time of photographing, or after photographing so called an after-recording. In a replay mode, the JPEG image is read out from the CF card 105, extended by the JPEG through the ASIC 103 and further resized to be a resolution for displaying, thereby being displayed on the LCD 106.

Figure 14:
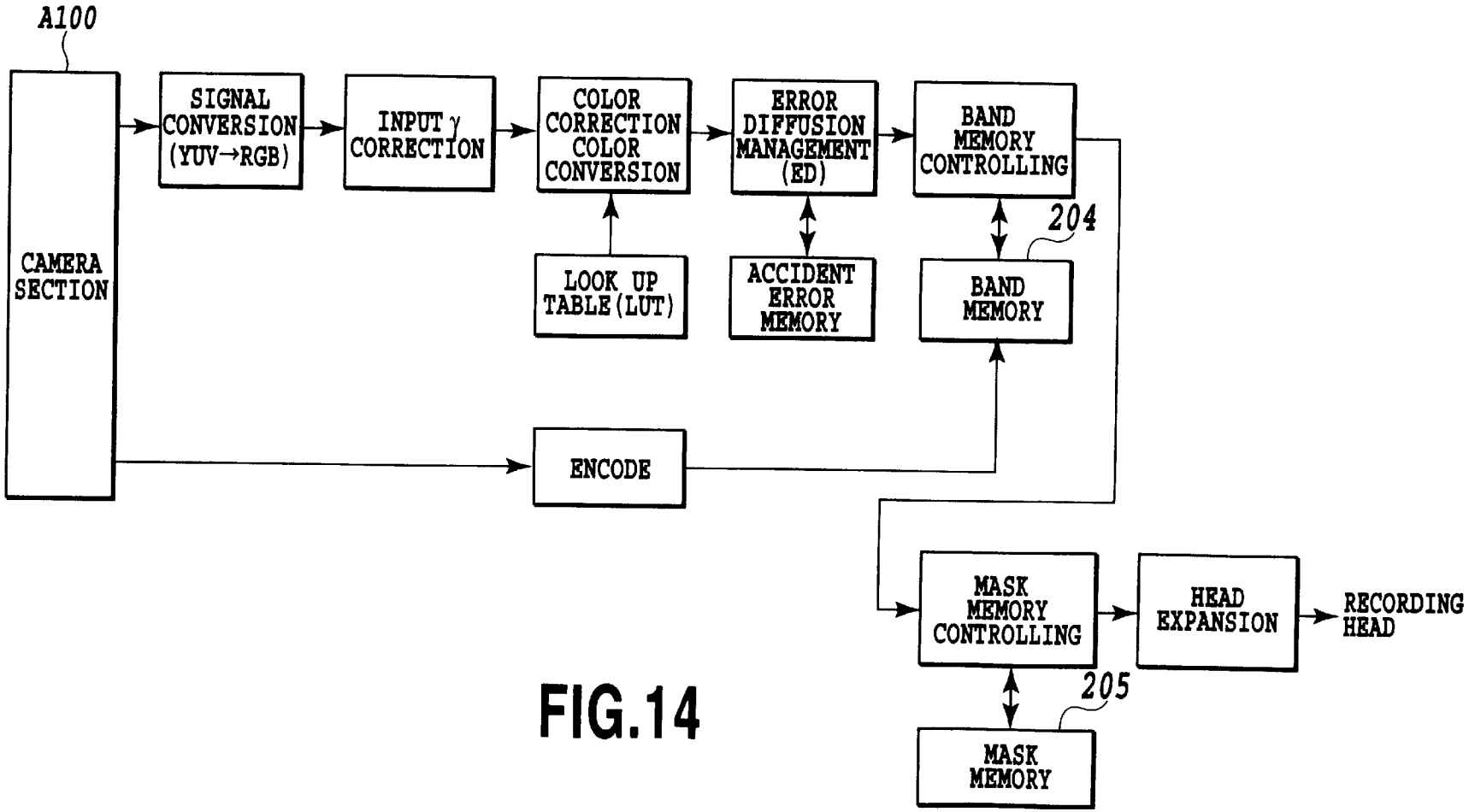
FIG. 14 is an explanatory illustration of a signal processing in the printer portion of FIG. 12.

FIG. 14 is a schematic diagram showing a signal processing performed in the printer section B100.

An image replayed on the camera section A100, that is the image being read out from the CF card 105, is extended by the JPEG as shown in FIG. 13 to resize a resolution to a suitable size for printing. Then, the resized image data (YUV signal), through an interface section 210, is transferred to the printer section B100. As shown in FIG. 14, the printer section B100 performs an image processing of an image data transferred from the camera section A100 by an image processing section 201, thereby performing an conversion of the image data to a RGB signal, an input γ correction in accordance with the features of a camera, a color correction and a color conversion using a look up table (LUT), and an conversion to a binarized signal for printing. When performing the binarizing processing, in order to perform an error diffusion (ED), a second memory 202 is utilized as an error memory. In the case of the present embodiment, though a binarizing processing section in the image processing section 201 performs the error diffusion processing, in other processing may be performed such as a binarizing processing using a dither pattern. The binarized printing data is stored temporary in the band memory 204 by a band memory controlling section 203. An encoder pulse from the encoder 208 enters into the encoder counter 209 of the printer section B100 every time the carriage B104 carrying the recording head 207 and the encoder 208 moves a certain distance. Then, in sync with this encoder pulse, a printing data is read out from the band memory 204 and the mask memory 205, and, based on thus obtained printing data, the head controlling section 206 controls the recording head 207 to perform a recording.

A band memory shown in FIG. 14 is explained as below.

A plurality of nozzles in the recording head 207, for example, is formed in array so as to achieve a density of 1200 dpi (dots/inch). For recording the image by using such recording head 207, upon performing one scanning by the carriage, it is preferred to previously prepare a recording data (a recording data corresponding to one scanning) corresponding to the number of nozzles in the sub-scanning direction (hereinafter, also referred to as a "column (Y direction)") and a recording data corresponding to the recording area in the scanning direction (hereinafter, also referred to as a "row (X direction)", respectively. The recording data is created in the image processing section 201 and then is temporary stored in the band memory 204 by the band memory controlling section 203. After the recording data corresponding to one scan is stored in the band memory 204, the carriage is scanned in the main scanning direction. In so doing, an encoder pulse inputted by the encoder 208 is counted by the encoder counter 209 and, in accordance with this encoder pulse, a recording data is read out from the band memory 204. Then, on the basis of the image data, ink droplets are ejected from the recording head 207. In the case that a bidirectional recording system wherein an image is recorded upon outward scanning and homeward scanning (outward recording and homeward recording) of the recording head 207 is employed, the image data is read out from the band memory 204 depending on the scanning direction of the recording head 207. For example, an address of the image data read out from the band memory 204 is increased sequentially when the outward recording is performed, while an address read out from the band memory 204 is decreased sequentially when the homeward scanning is performed.

In a practical sense, a writing of an image data (C, M and Y) created by the image processing section 201 into the band memory 204 and a subsequent preparation of the image data corresponding to one band enable a scanning of the recording head 207. Then, the image data is read out from the band memory 204 subsequent to a scan of the recording head 207, so that the recording head 207 records the image on the basis of the image data. While the recording operation, an image data to be recorded next is created at the image processing section 201 and thus created image data is written into an area of the band memory 204 corresponding to a recording position.

As has been stated above, the band memory controlling is carried out in such manner that a writing operation in which an recording data (C, M, Y) created by the image processing section 201 is written into the band memory 204 and a reading operation for transferring the recording data (C, M, Y) to the head controlling section 206 in accordance with a scanning movement of the carriage are changed over.

A mask memory controlling in FIG. 14 is explained as below.

This mask memory controlling is required when a multipass recording system is employed. In using the multipass recording system, the recording image corresponding to one line which has a width corresponding to a length of the nozzle array of the recording head 207 is divided to a plurality of scanning of the recording head 207 to record. That is, conveying amount of the printing medium to be intermittently carried to the sub-scanning direction is made to be 1/N of a length of the nozzle array. For example, when N=2, a recording image corresponding to one line is divided into two scans to record (two-pass recording), and when N=4, a recording image corresponding to one line is divided into four scans to record (four-pass recording). In similar fashion, when N=8, it becomes eight-pass recording, and when N=16, it becomes sixteen-pass recording. Therefor, the recording image corresponding to one line will be completed by a plurality of scans of the recording head 207.

Practically, a mask data for assigning the image data to a plurality of scans of the recording head 207 is stored in the mask memory 205, and then based on a conjunction (AND) data between the mask data and the image data, the recording head 207 ejects inks to record the image.

Also, in FIG. 14, a voice data stored in the CF card 105, alike the image data, is transferred to the printer section B100 through an interface 210 by the ASIC 102. The voice data transferred to the printer section B100 is encoded at the voice encoder 230 and then recorded with the image to be printed as a code data. When there is no necessity to input a voice data into a printing image, or when printing an image without a voice data, of course, the encoded voice data is not printed but only the image is printed.

In the present embodiment, the present invention has been explained as a printer built-in camera integral with a camera section A100 and printer section B100. However, it would be possible to make each of the camera section A100 and the printer section B100 a separate device and to form in a similar manner as a structure in which those devices are connected each other by the interface 210 to realize a similar function.

Characteristic Construction

Characteristic construction of the present invention will be explained hereinafter in terms of the preferred embodiments.

Ink Supply Recovery System

Figure 15:
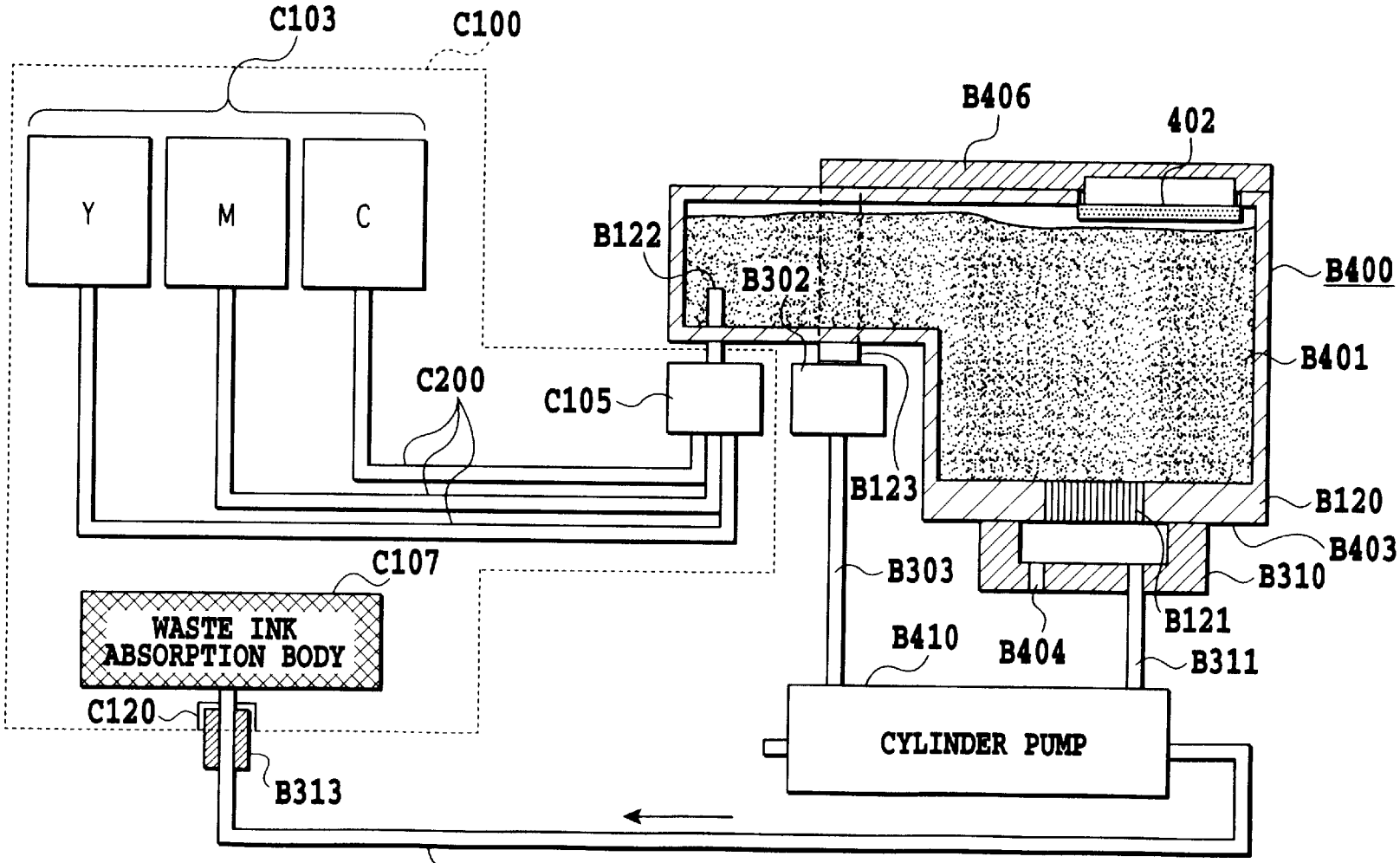
FIG. 15 is an illustration showing a conceptual construction of an ink supply recovery system.

FIG. 15 shows a conceptual construction of an ink supply recovery system.

In FIG. 15, three ink packs (also called as main tanks) C103 filled with three colors of inks of Y (yellow), M (magenta) and C (cyan) are received within a medium pack C100. These three ink packs C103 are connected to three joints (ink joints) C105 through three ink supply passages C200.

In the ink medium pack C100, a waste liquid introducing hole C120 (see FIG. 4) is provided, to which waste liquid introducing hole, a waste liquid joint B131 provided at a tip end of a waste liquid tube B312 on the side of the printer portion B100, is inserted and connected. In the medium pack C100, a waste ink absorbing body C107 is provided for accommodating waste ink from a cylinder pump B410 inflowing through the waste liquid, introducing hole C120.

On a carriage B104, sub-tanks (also occasionally referred to as carriage tanks) B400 separately storing inks of Y, M and C and a printing head B120 having three groups of a plurality of ink ejection openings (nozzles) respectively for ejecting inks supplied from respective carriage tanks B400, are mounted.

Each ink storage portion (ink supply portion) of the sub-tank B400 for each ink is substantially filled up with an ink absorbing body (sponge) B401 which is formed of polypropylene fiber or the like. On the other hand, in each ink storage portion (ink supply portion) of the sub-tank B400 for each ink, a needle (ink introducing portion) B122 projecting downwardly and having a through hole therein is provided. These three needles B122 are connectable with three rubber joints C105 of the medium pack C100 when the carriage B104 is moved to a home position.

On the upper portion of each ink supply portion of the sub-tank B400, a negative pressure introducing portion B406 is formed. As set forth above, the negative pressure introducing portions B406 are respectively provided with a water repellent and oil repellent processed porous membrane (ink full valve) B402 serving as a gas-liquid separation member permitting air to pass through and blocking the ink to pass through. With the porous membrane B402, since the ink is blocked to pass through, resupplying of the ink can be automatically stopped when the liquid surface of the ink in the sub-tank B400 reaches the porous membrane B402.

Each negative pressure introducing portions B406 of the sub-tanks B400 is communicated with a common air suction opening B123 (see FIG. 8)) formed on a lower surface side of the carriage B104, as set forth above. The air suction opening B123 is designed to be connected with suction joint B302 provided on the side of main body of the printer portion B100 when the carriage B104 is moved to the home position, and can be connected with one of cylinder chambers of a cylinder pump B410 of a pump unit B315 via the suction joint B302 and a supply tube B303.

On the side of the printer portion B100, a suction cap B310 is provided for capping a face (ink ejection opening forming surface) B403 of a printing head B120, in which the three groups of a plurality of ink ejection openings (nozzles) B121 for Y, M, C inks are formed, when the carriage B104 is moved to the home position. In the suction cap B310, an atmosphere communication opening B404 is formed. The atmosphere communication opening B404 can be opened and closed by an atmosphere communication valve B405 which will be explained later.

The suction cap B310 is connected to the other cylinder chamber of the cylinder pump B410 through a suction tube B311.

Pump Unit

Detail of the pump unit B315 including the cylinder pump B410 will be explained with reference to FIGS. 16 to 21.

As shown in these drawings, the cylinder pump B410 has a pump cylinder (cylinder body) B304 and a piston B411. The piston B411 includes a piston rod B411*a* and a piston head (hereinafter referred to piston rubber) B412 arranged at the tip end of the piston rod B411*a* and formed of an elastic body, such as rubber or the like.

The pump cylinder B304 and the piston rubber B412 define two pump chambers (air suction chamber B413 and ink suction chamber B414).

Air (first fluid) is introduced into the air suction chamber B413 and an ink (second fluid) flows into the ink suction chamber B414. In the air suction chamber B413, an input and output port B415 communicating with the supply tube B303 is provided. In the ink suction chamber B414, an input port B416 communicating with the suction tube B311 and an output port B417 communicating with the waste liquid tube B312 are provided. On the end surface wall B425 of the ink suction chamber B414, a bore B426 (see FIG. 17), in which the piston rod B411*a* is slidingly inserted, and a bore B427 (see FIG. 18), in which a plurality of slide pins B442 which will be discussed later, are slidingly inserted, are formed.

Figure 16:
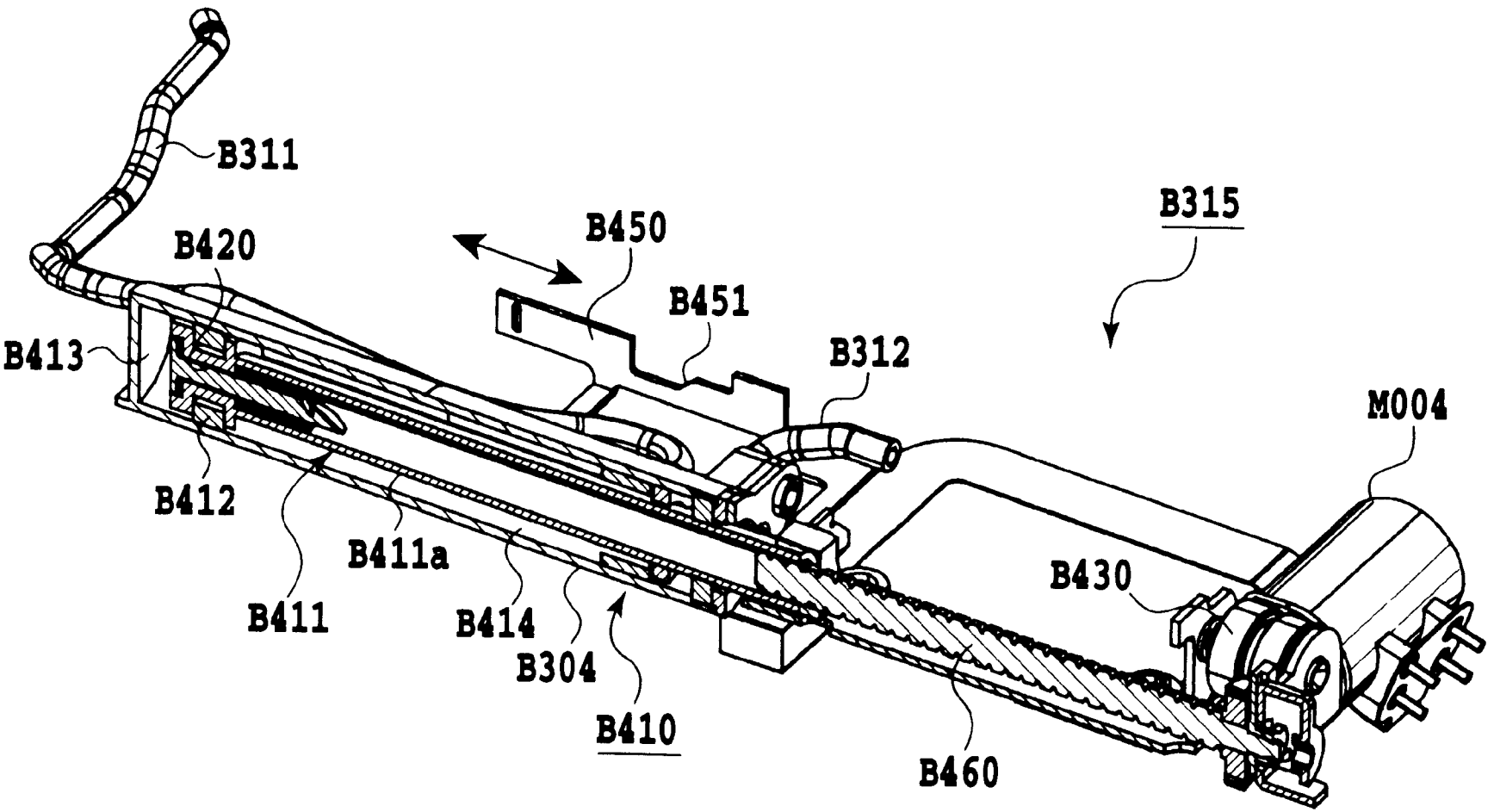
FIG. 16 is a partially cut-out perspective view showing a pump unit.
Figure 17:
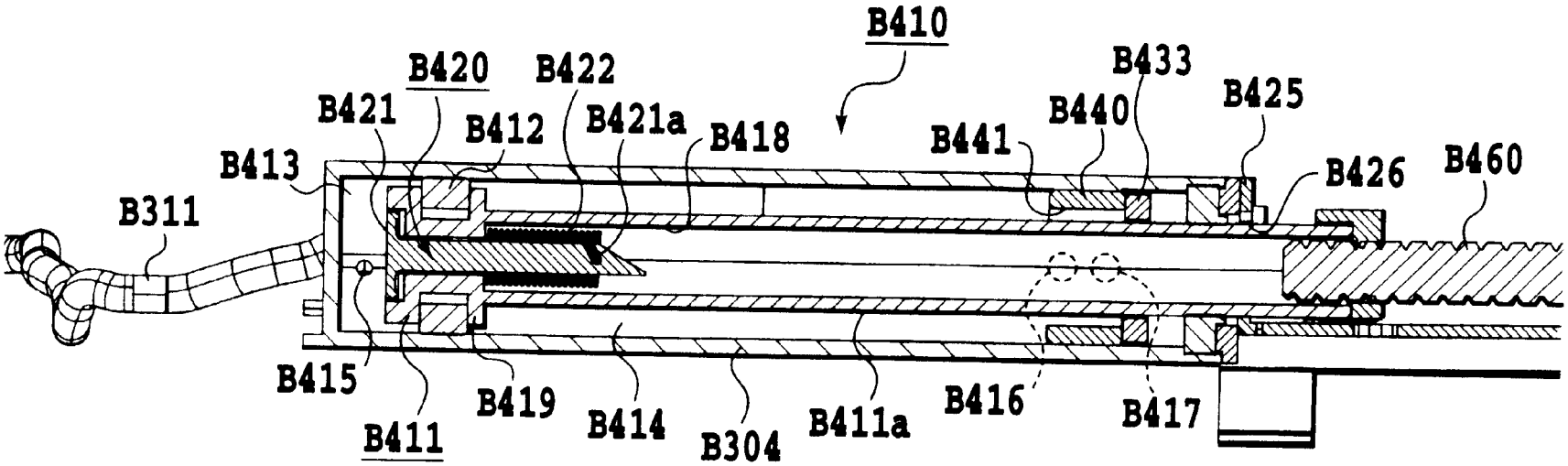
FIG. 17 is a section showing a stand-by state of a cylinder pump.

As shown in FIGS. 16 and 17, the piston B411 is hollow cylindrical shape and can introduce atmospheric air into the hollow portion B418. On the flange portion B419 at the tip end of the piston B411, a relief valve B420 which is actuated when a suction pressure (negative pressure) of the air suction chamber B413 becomes greater than or equal to a predetermined pressure, is provided.

The relief valve B420 is constructed with a valve body B421 and a spring B422 setting a relief pressure. The spring B422 is interposed between a spring engaging portion B421*a* of the valve body B421 and the flange portion B419 of the piston B411 for biasing the valve body B421 with a predetermined relief pressure.

As set forth above, when the suction pressure (negative pressure) of the air suction chamber B413 becomes greater than or equal to the predetermined pressure, the relief valve B420 becomes open to increase pressure in the air suction chamber B413. Therefore, all negative pressure (absolute value) greater than the relief pressure is cut. The relief pressure of the relief valve B420 is set to maintain a pressure lower than or equal to that required for maintaining performance of the porous membranes B402.

In the case of the pit-in ink supply system using the porous membranes B402 in the sub-tank B400, ink supply to the sub-tanks B400 is performed by sucking air in the sub-tanks B400 via the porous membranes B402 by means of the cylinder pump B410. When suction is performed by the cylinder pump B410 in a fully filled condition, leakage of the ink from the porous membranes B402 will never be caused by the function of the porous membranes B402. However, this will affect for durability of the porous membranes B402 to shorten lift of the porous membranes B402. Therefore, in the shown device, by arranging the relief valve B420 within the piston rod B411*a*, not only space saving is attempted, but also operational reliability of the porous membranes B402 is ensured with preventing exertion of excessive ink pressure on the porous membranes B402 in supplying ink.

In the hollow portion B418 of the piston rod B411*a*, a screw rod (pump unit) B460 is inserted in threaded condition. Thus, by rotation of the screw rod B460, the piston B411 is reciprocated in directions along the piston axis. As shown in FIG. 16, the screw rod B460 is connected to a pump motor M004 as a driving source via a gear mechanism B430 to be driven for rotation by the pump motor M004.

Figure 18:
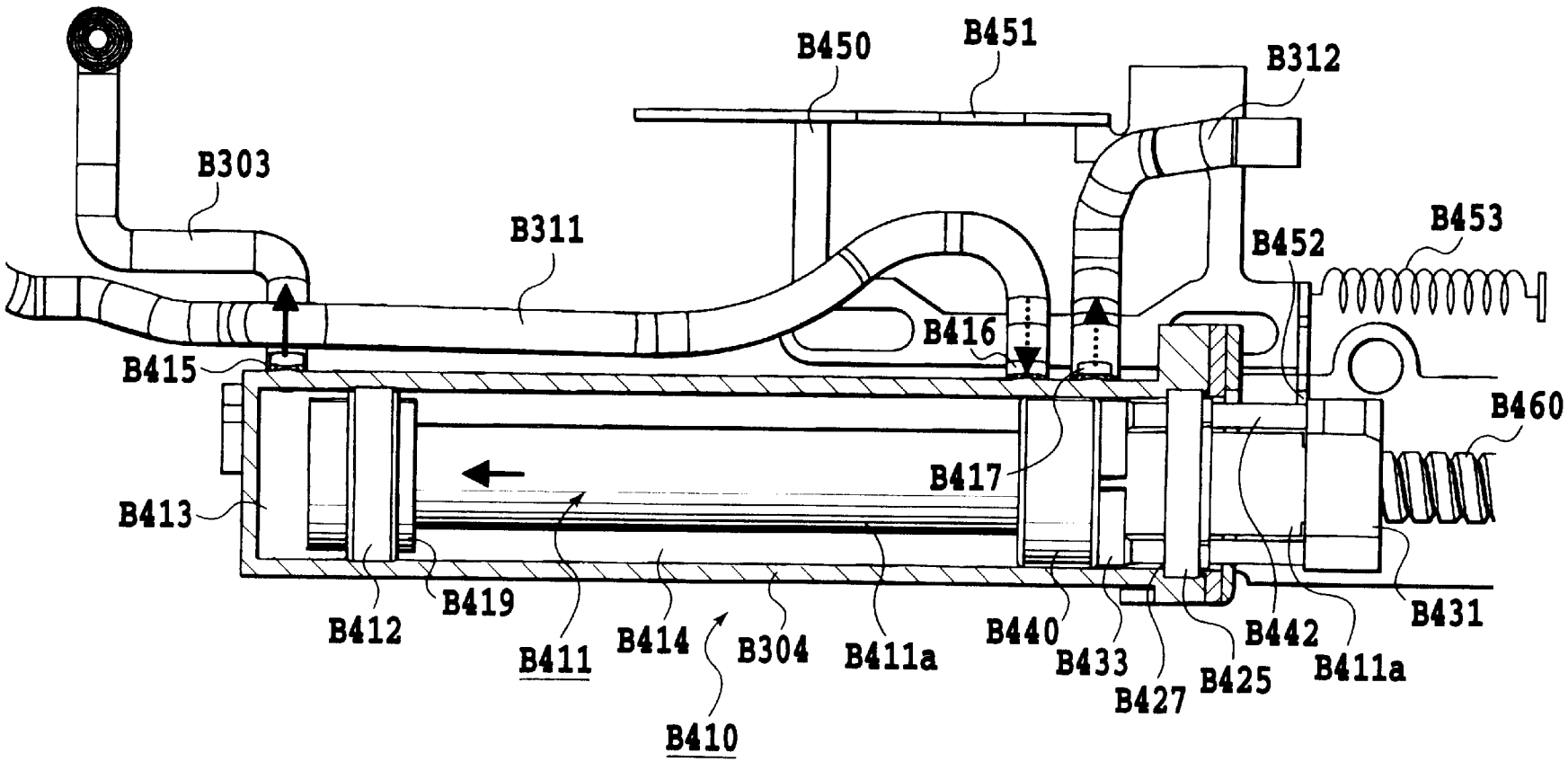
FIG. 18 is a partial section showing the stand-by state of the cylinder pump.

As shown in FIG. 18 and other drawings, on the rear end of the piston B411, a pushing slider B431 is arranged. The pushing slider B431 is also threadingly connected with the screw rod B460. Thus, by rotation of the screw rod B460 the pushing slider B431 can be reciprocated in directions along the piston axis.

In the ink suction chamber B414 of the pump cylinder B304, a switching valve (hereinafter referred to as a valve rubber) B440 as a port switching means formed of an elastic body, such as rubber or the like is arranged for movement in the direction of the piston axis. In the valve rubber B440, a bore B441 (FIG. 17), into which the piston rod B411*a* is inserted, is formed. Therefore, the piston rod B411*a* can move freely relative to the valve rubber B440 through the bore B441. By switching positions of the valve rubber B440, one of the input port B416 connected to the suction tube B311 and the output port B417 connected to the waste liquid tube B312 is opened and the other is closed for controlling open and close conditions of the input port B416 and the output port B417.

As shown in FIG. 18 and other drawings, between a rear end surface of the valve rubber B440 and the pushing slider B431, a plurality of slide pins B442 for pushing the rear end surface of the valve rubber B440 are arranged. On the valve rubber B440 side (tip end side of the slide pins B442, a pushing body B443 having large contact surface is secured for making a pushing force to be exerted on the rear end surface of the valve rubber B440 uniform.

Figure 19:
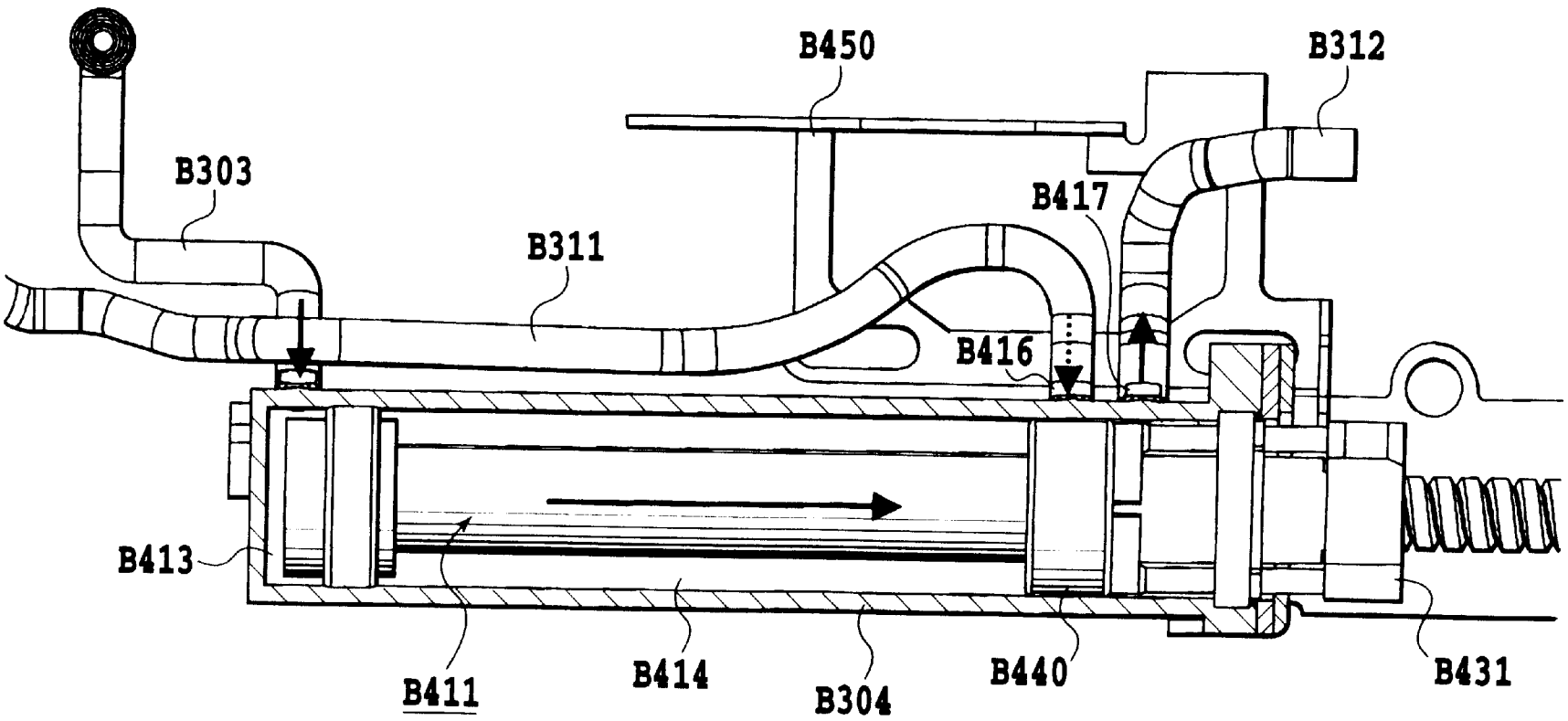
FIG. 19 is a partial section showing a cylinder pump in a condition where a piston is positioned at an ink supply start position.

The pushing force of the pushing slider B431 is used for moving the valve rubber B440 in stand-by condition, as shown in FIG. 18, in a piston expansion direction (toward left in the drawing) and placing in the input port B416 closed and the output port B417 opened condition, as shown in FIG. 19.

Namely, in the stand-by state, the pushing slider B431 is in contact with a plurality of slide pins B442, as shown in FIG. 18. In this condition, the pushing slider B431 is moved in the piston expansion direction (toward left) by rotation of the screw rod B460. Then, a plurality of slide pins B442 and the valve rubber B440 are moved toward left up to the position shown in FIG. 19 by the pushing force of the pushing slider B431.

Figure 20:
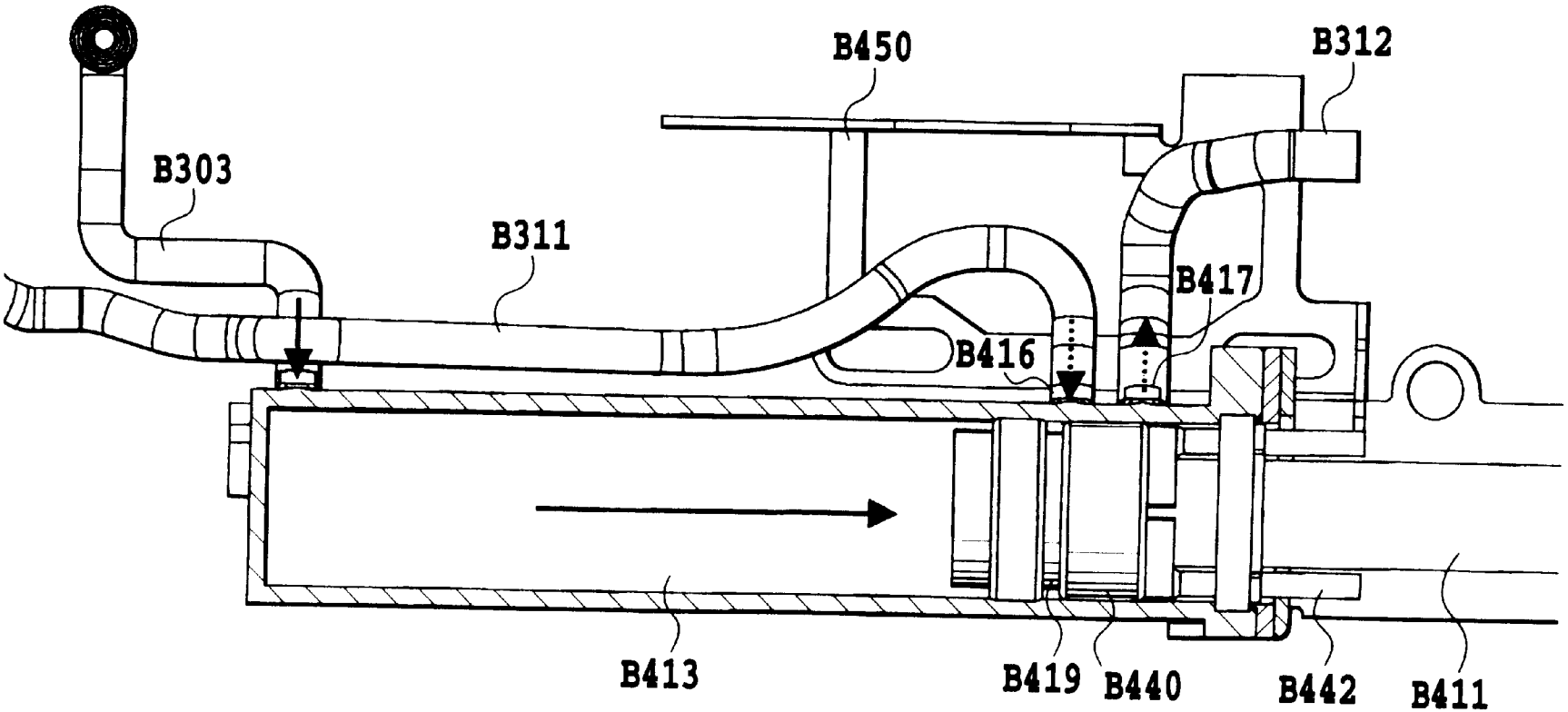
FIG. 20 is a partial section showing a cylinder pump in a condition where the piston is positioned at a valve switching position.
Figure 21:
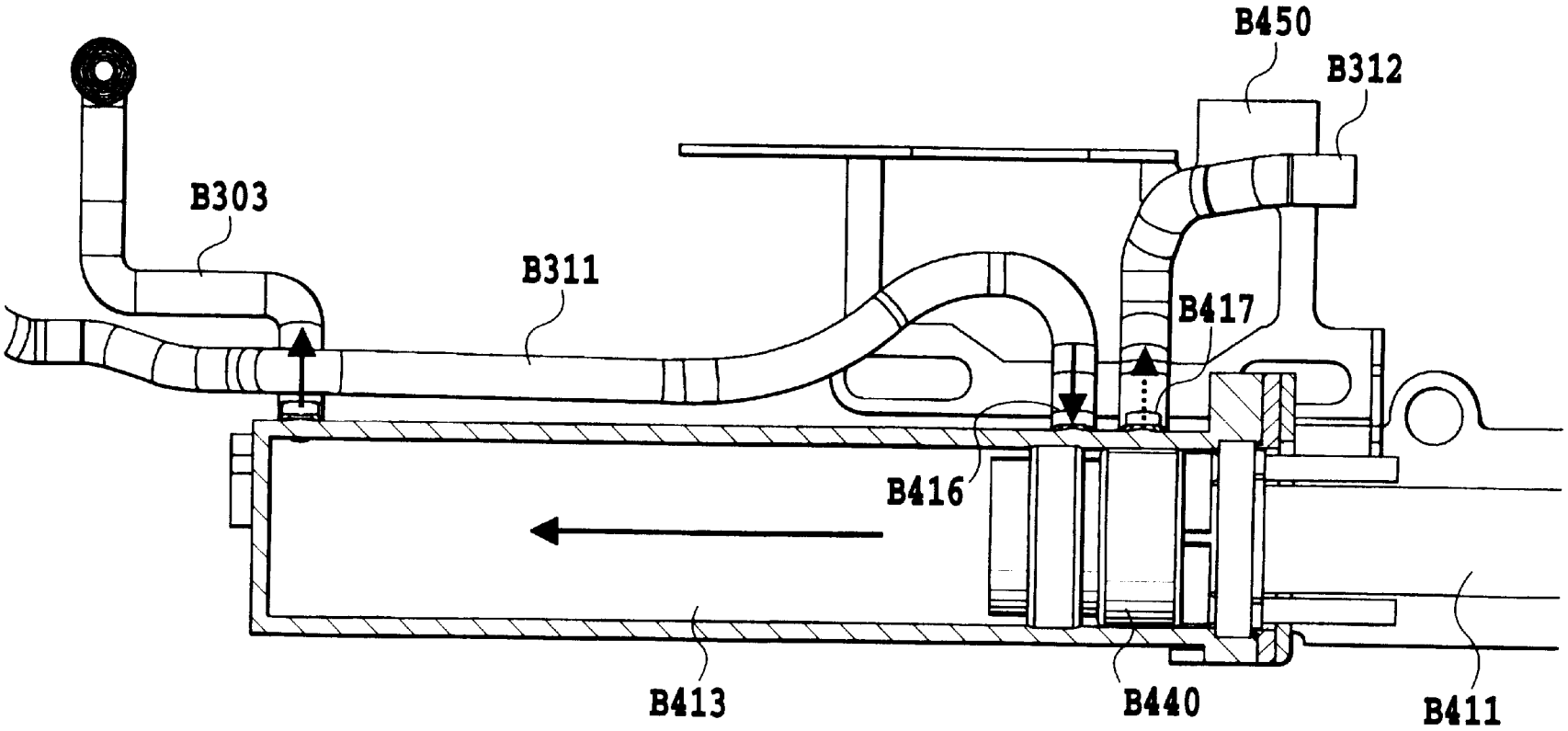
FIG. 21 is a partial section showing a cylinder pump in a condition where the piston is positioned at the ink suction start position.
Figure 22:
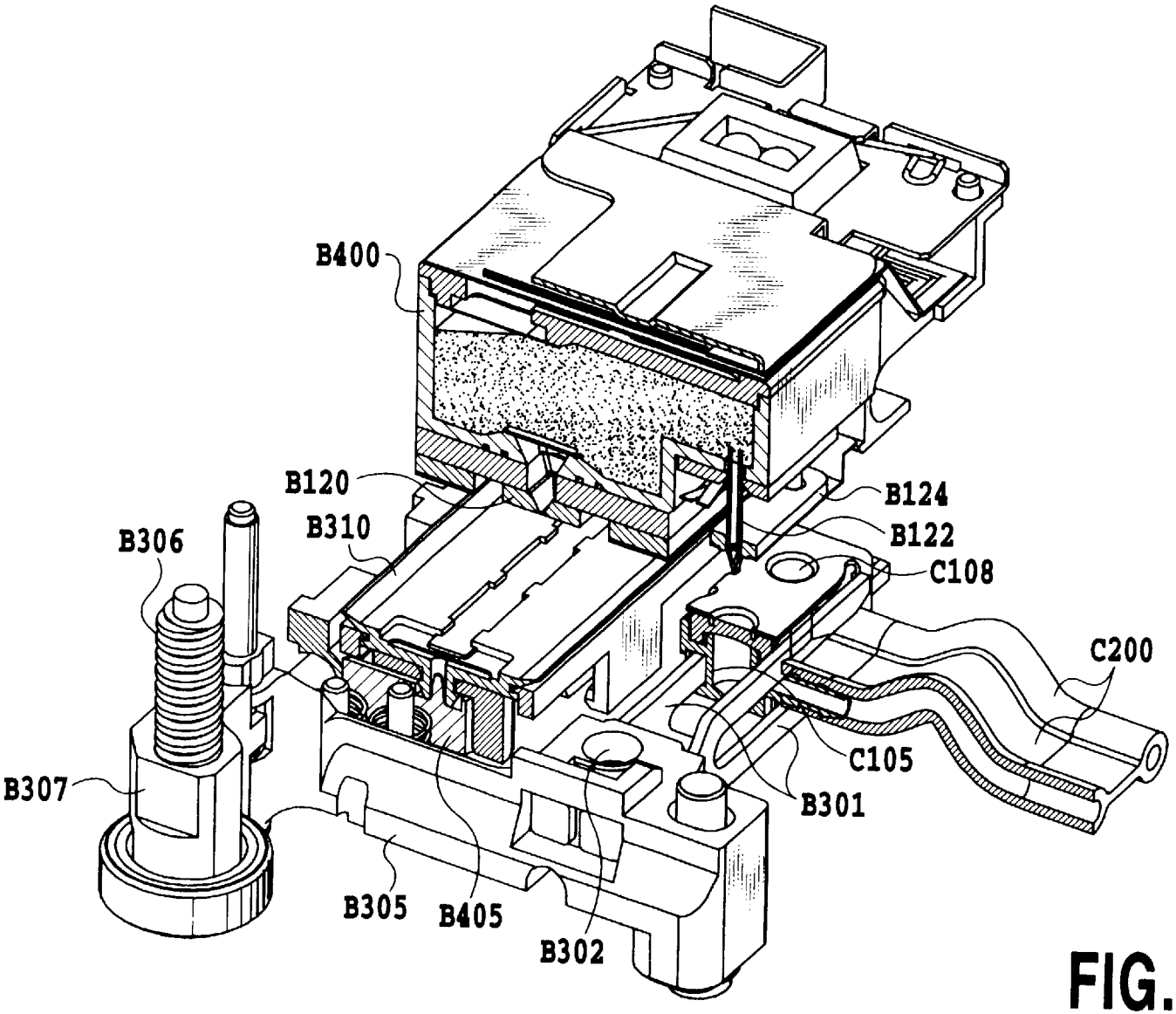

On the other hand, for moving the valve rubber B440 to a piston retracted position (toward right in the drawing), from the position shown in FIG. 19 to the position shown in FIG. 20, and further to the position shown in FIG. 21, a pushing force of the flange portion B419 at the tip end of the piston B411 is used.

Namely, as shown in FIG. 20, for example, after contacting the flange portion B419 at the tip end of the piston B411 with the valve rubber B440, if the piston B411 is moved in the retracting direction, the valve rubber B440 and a plurality of slide pins B442 are moved toward right up to the position shown in FIG. 21 by the pushing force of the flange portion B419.

Switching of the position of such valve rubber B440 is performed at a predetermined timing in one cycle including air suction (ink supply), ink suction and ink discharge by reciprocal movement of the piston B411.

Next, air suction, ink suction and ink discharge operation by the foregoing cylinder pump B410 will be explained briefly.

Air Suction and Ink Discharge Operation

Condition shown in FIG. 19 is an initial condition upon air suction. The piston B411 is advanced up to substantially stroke end on piston expansion side. At this time, the valve rubber B440 is switched to communicate the ink suction chamber B414 with the waste liquid tube B312 side and to shut down the suction tube B311 side.

From the condition shown in FIG. 19, when the piston B411 is moved in the piston retracting direction, i.e. toward right, the air suction chamber B413 is lowered in pressure and ink suction chamber B414 is increased in pressure.

By this, air in the sub-tank B400 is sucked into the air suction chamber B413 via the porous membranes B402, the negative pressure introducing portion B406, the air suction opening B123, the suction joint B B302 and the supply tube B303 (see FIG. 15). As a result, the ink is resupplied from the main tank C103 of the medium pack C100 to the sub-tank B400.

On the other hand, it is assumed that sucked ink from the suction cap B310 sucked in the preceding cycle is stored in the ink suction chamber B414. In this condition, when the piston B411 is moved in the piston retracting direction, the right direction, from the condition shown in FIG. 19, the ink suction chamber B414 is pressurized. The ink stored in the ink suction chamber B414 flows out to the waste ink absorbing body C107 of the medium pack C100 via the waste liquid tube B312 and is absorbed and held by the waste ink absorbing body C107.

Ink Suction Operation

Condition shown in FIG. 21 is an initial condition upon ink suction, in which the piston B411 is moved to substantially stroke end on the piston retracting side. At this time, the valve rubber B440 is switched to the position to communicate the ink suction chamber B414 with the suction tube B311 side and to shut down the waste liquid tube B312 side.

From the condition shown in FIG. 21, when the piston B411 is moved toward left, in the piston expansion direction, the air suction chamber B413 is pressurized, and the ink suction chamber B414 is lowered in pressure.

By this, as shown in FIG. 15, inside of the suction cap B310 connected to the ink suction chamber B414 is lowered in pressure via the suction tube B311 to suck the ink from the ink ejection openings B121 of the printing head B120 into the suction cap B310. The sucked ink flows to the ink suction chamber B414.

On the other hand, during this ink suction operation, the air suction chamber B413 is pressurized. However, at this time, since the suction joint B B302 is removed from the air suction opening B123 of the sub-tanks B400 as will be discussed later, inside of the sub-tanks B400 is never pressurized.

With the foregoing cylinder pump B410, the ink suction chamber B414 through which the piston rod B411*a* extends is adapted for sucking the ink and the other air suction chamber B413 is adapted for sucking air. Accordingly, suction amounts of respective suction chambers B413 and B414 can be set at different values at the same piston stroke. Namely, the suction amount in the ink suction chamber B414 through which the piston rod B411*a* extends is smaller. On the other hand, by varying a diameter of the piston rod B411*a*, a suction volume ratio between the ink suction chamber B414 and the air suction chamber B413 can be easily varied.

Next, a motion mechanism of the wiper C106 of the medium pack C100 will be explained.

As shown in FIGS. 16, 18 to 21, in the vicinity of the cylinder pump B410, a plate cam member B450 for moving a wiper lifter B316 (see FIG. 10) up and down. As shown in FIG. 16, the Plate cam member B450 has a two stage cam portion B451 having two different heights for moving the wiper lifter B316 engaging with the cam portion B451 up and down.

The plate cam member B450 is reciprocally movable in reciprocating directions of the piston B411 of the cylinder pump B410. The plate cam member B450 has a contact portion B452 (FIG. 18) contacting with the pushing slider B431 threadingly engaged with the screw rod B460. The plate cam member B450 is pushed by movement of the pushing slider B431 to move in the advancing direction (toward left) of the piston B411. The plate cam member B450 is moved in the retracting direction (toward right) of the piston B411 by a return force of a spring B453 (see FIGS. 10, 11 and 18).

Joint Lifter Moving Mechanism

Next, a contacting and releasing mechanism for contacting and releasing the rubber joints C105 of the medium pack C100 to and from the needles B122 of the sub-tanks B400, a contacting and releasing mechanism for contacting and releasing the suction joint B302 to and from the air suction opening B123 of the carriage B104, a contacting and releasing mechanism for contacting and releasing the suction cap B310 to and from the face B403 of the printing head B120, and an opening and closing mechanism for opening and closing the atmosphere communication opening B404 of the suction cap B310 by the atmosphere communication valve B405 will be discussed in greater detail.

Figure 23:
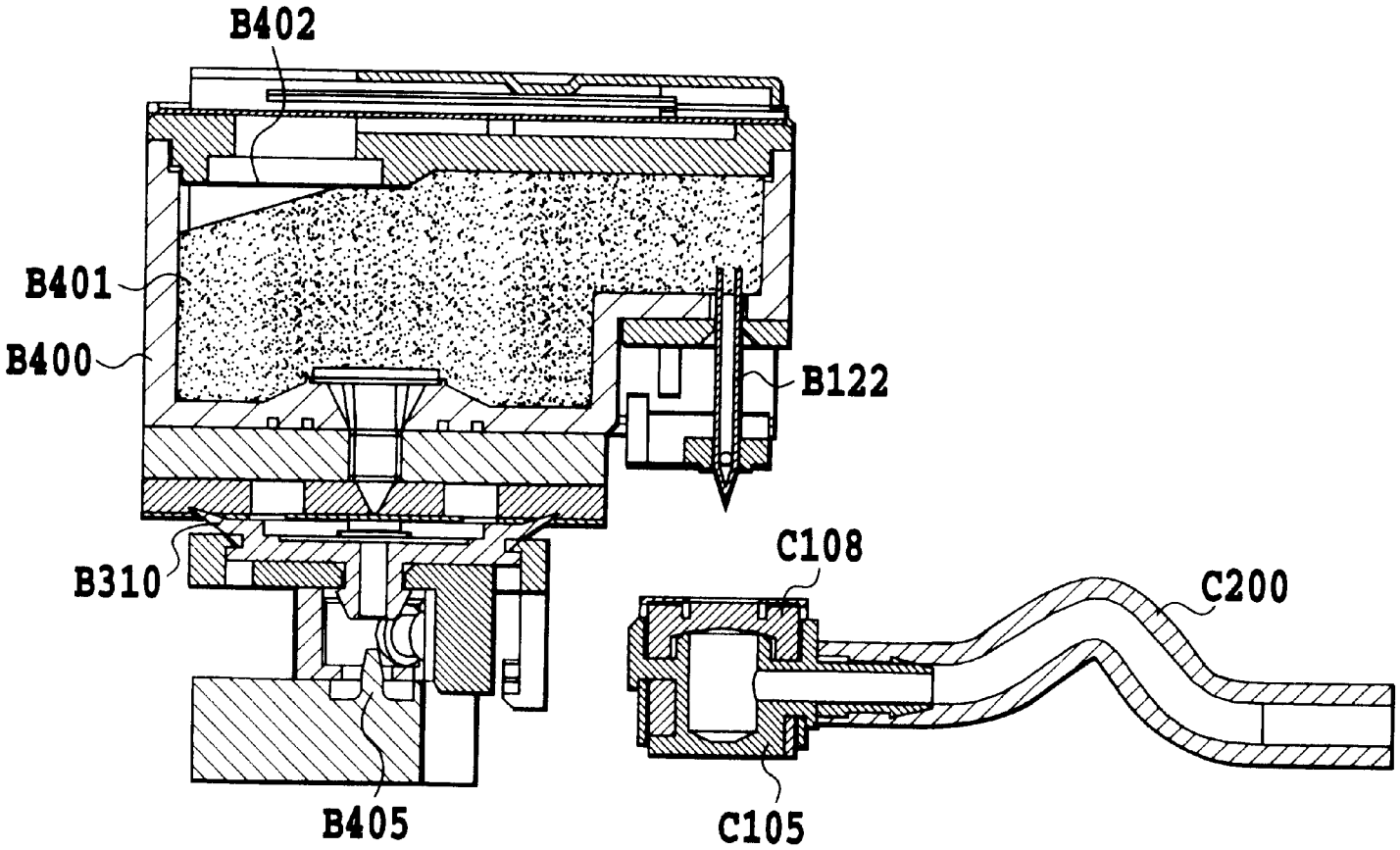
FIG. 23 is a section showing a joint, a suction cap and so on in stand-by condition.
Figure 24:
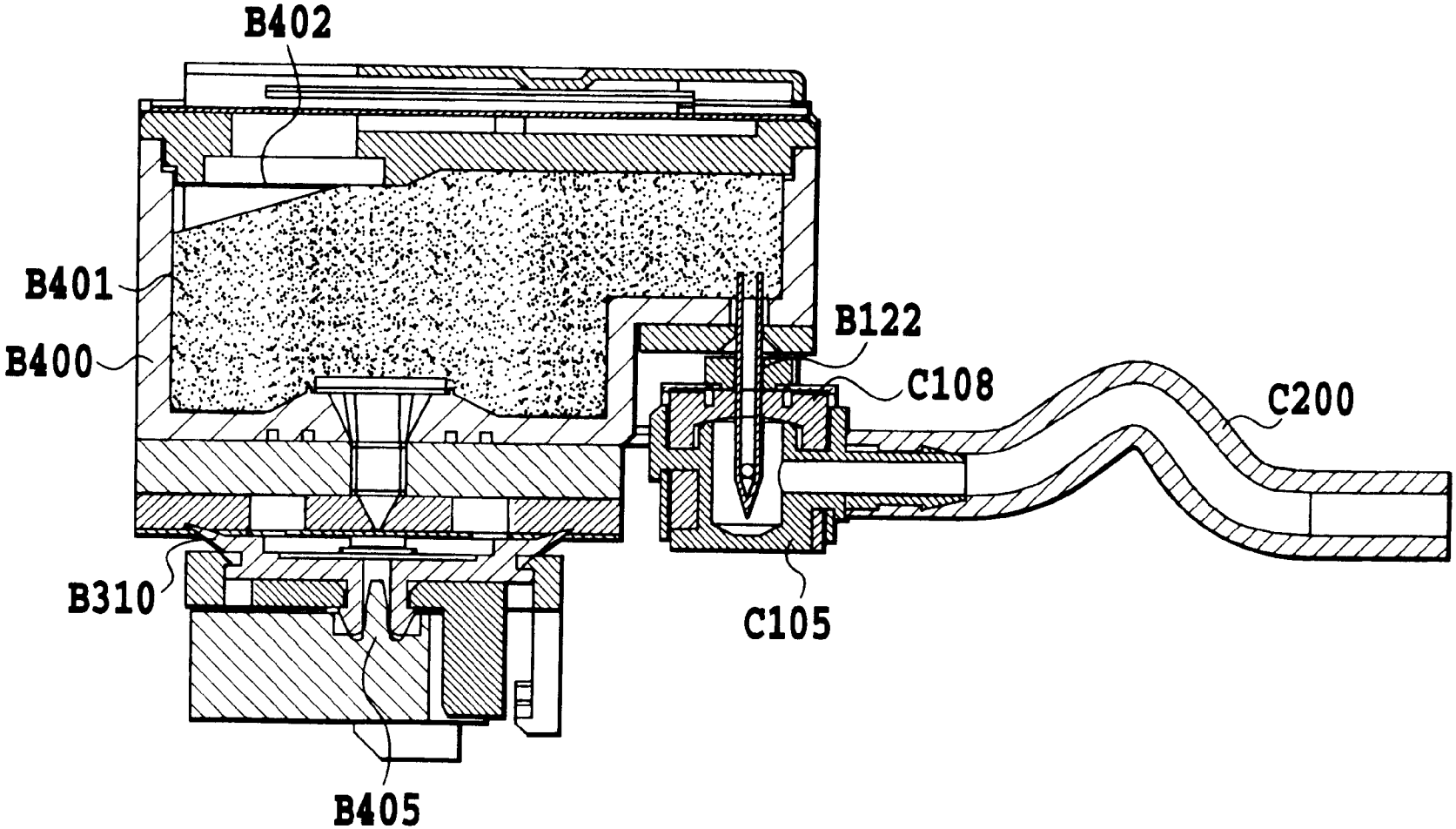
FIG. 24 is a section showing the joint, the suction cap and so on in ink supply condition.
Figure 25:
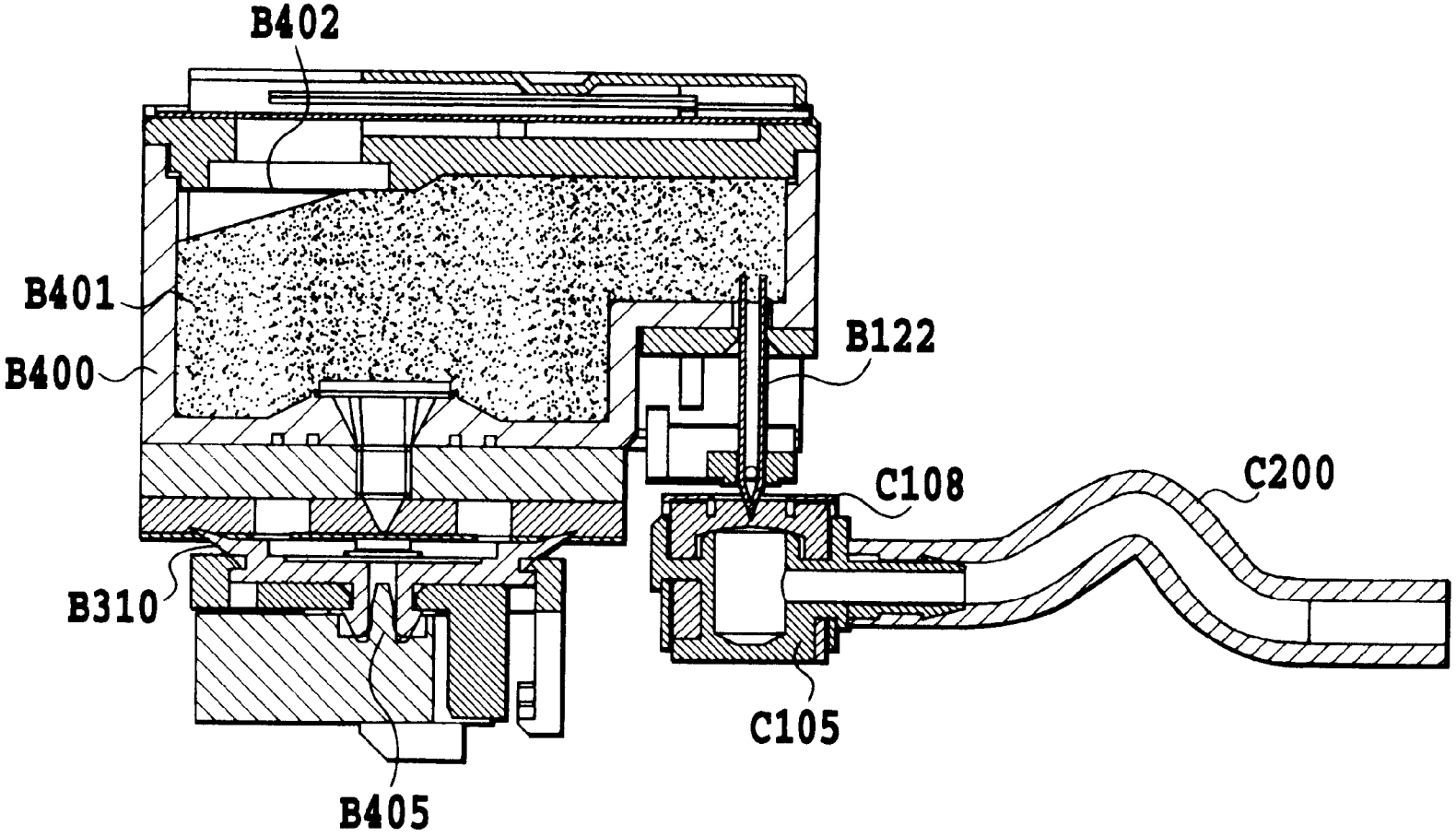
FIG. 25 is a section showing the joint, the suction cap and so on in ink suction condition.
Figure 26:
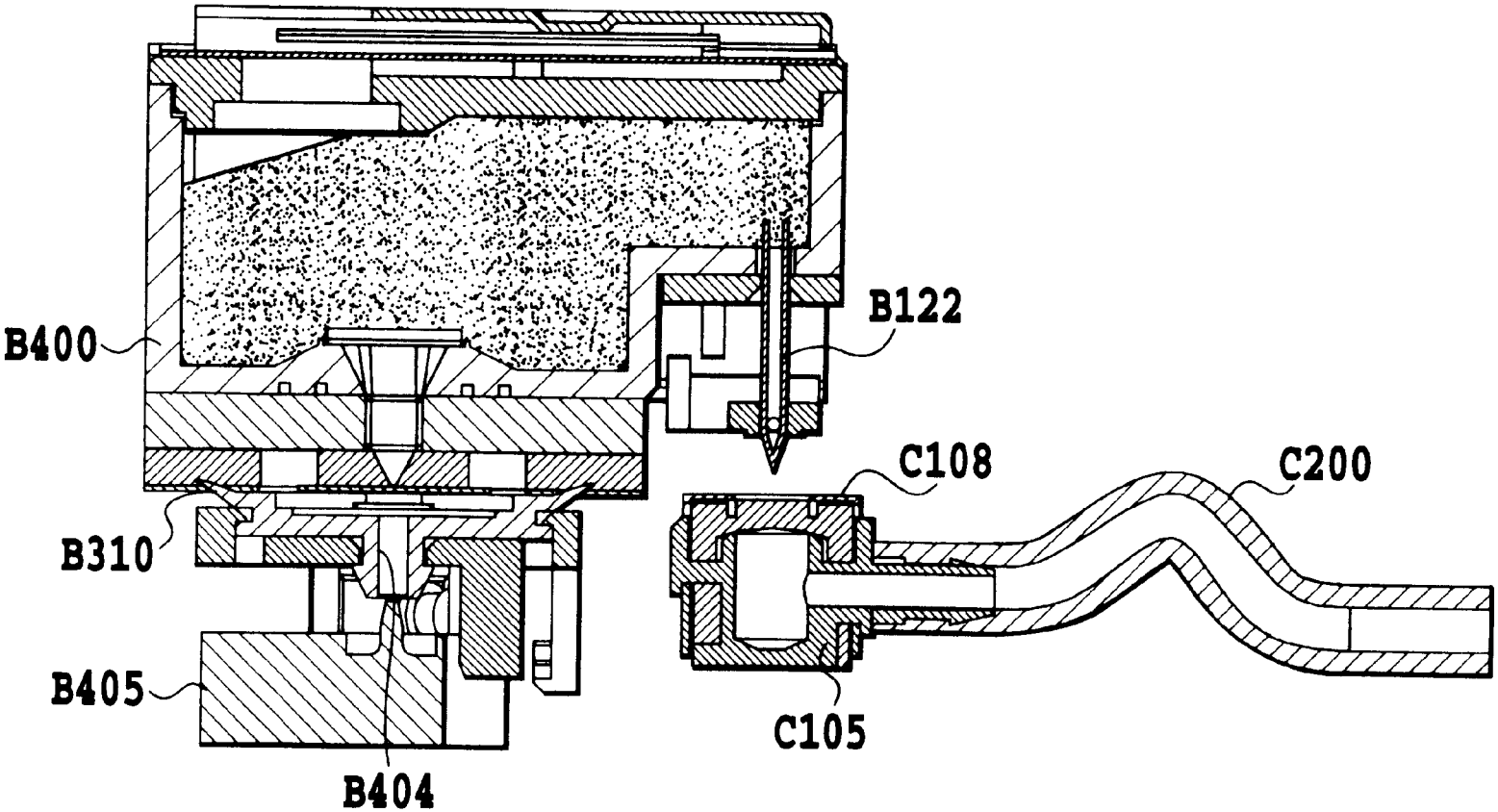
FIG. 26 is a section showing the joint, the suction cap and so on in idle suction condition.
Figure 27:
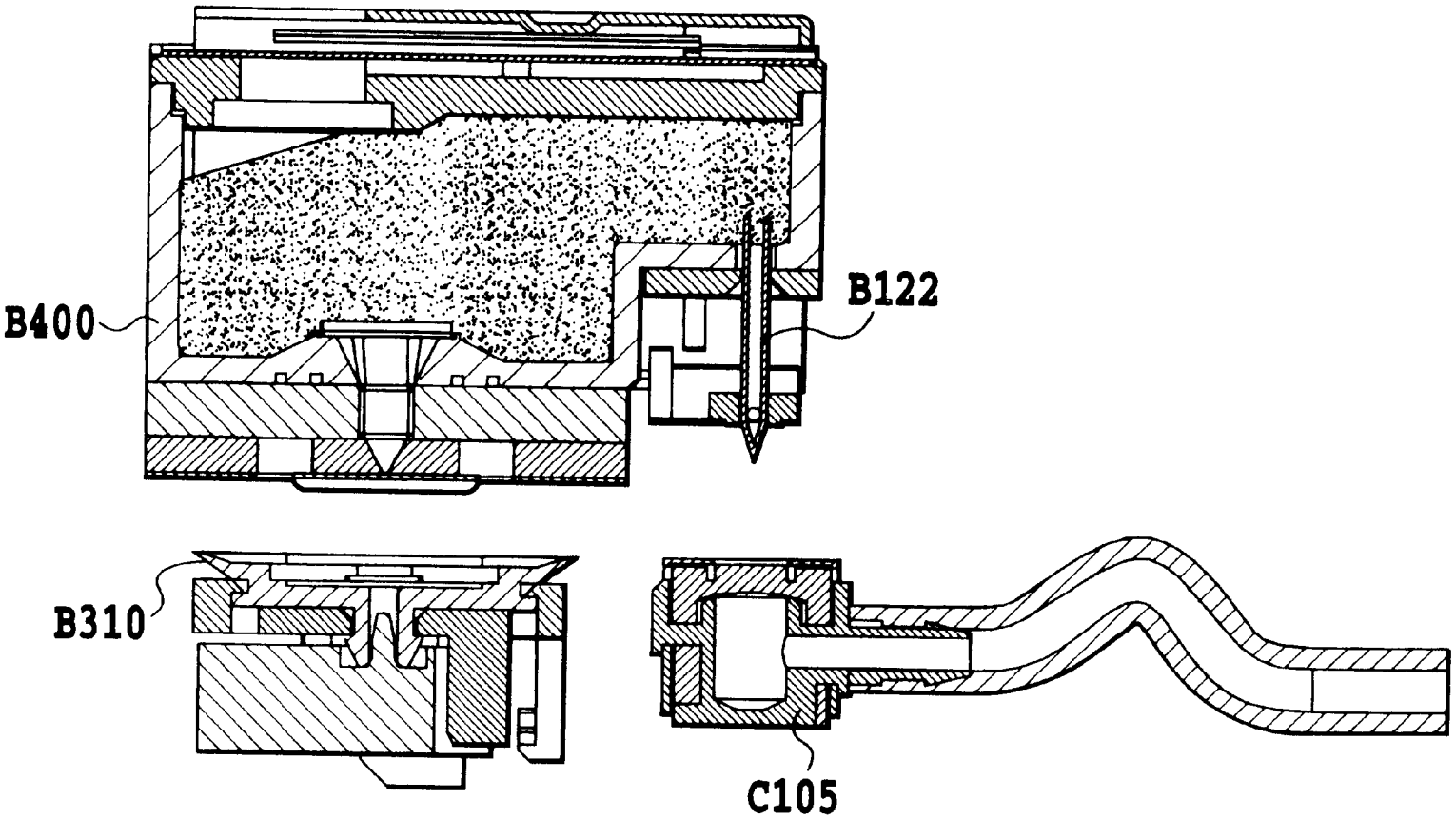
FIG. 27 is a section showing the joint, the suction cap and so on in a printing condition.

It should be noted that FIG. 23 shows stand-by condition, FIG. 24 shows ink supply condition, FIG. 25 shows ink suction condition, FIG. 26 shows idle suction condition, and FIG. 27 shows printing condition.

A joint motor M003 drives a screw rod B306 via an appropriate gear mechanism (not shown). A joint slider B307 is threadingly engaged with the screw rod B306, thus reciprocally moving in accordance with rotation of the screw rod B306. A joint lifter B305 is integrally coupled to the joint slider B307.

To the joint lifter B305, a joint fork B301 is secured. The joint fork B301 can move up and down corresponding to the up-and-down movement of the joint lifter B305. When the medium pack C100 is loaded on the printer portion B100, the rubber joint C105 of the medium pack C100 is supported by the joint fork B301. Accordingly, the rubber joint C105 of the medium pack C100 moves up and down corresponding to the up-and-down movement of the joint fork B301. When the joint fork B301 reaches substantially the upper stroke end, the needle B122 of the sub-tank B400 completely passes through a sealing body (joint rubber) C108 of the rubber joint C105 as shown in FIG. 24 to form an ink supply passage from the main tank C103 of the medium pack C100 to the sub-tank B400 on the side of the carriage B104.

On the upper surface of the joint lifter B305, a suction joint B302 connected to the supply tube B303 for sucking air of the cylinder pump B410 is provided. Accordingly, the suction joint B302 is also moved up and down corresponding to the up-and-down movement of the joint lifter B305. When the suction joint B302 is moved up from a predetermined position, the suction joint B302 is connected to the air suction opening B123 so as to form the air suction passage between the cylinder pump B410 and the sub-tank B400.

To the joint lifter B305, the suction cap B310 and the atmosphere communication valve B405 are connected through an appropriate mechanism. These suction cap B310 and the atmosphere communication valve B405 are moved up and down respectively at predetermined timings during the up-and-down motion of the joint lifter B305.

Control Drive System

Figure 28:
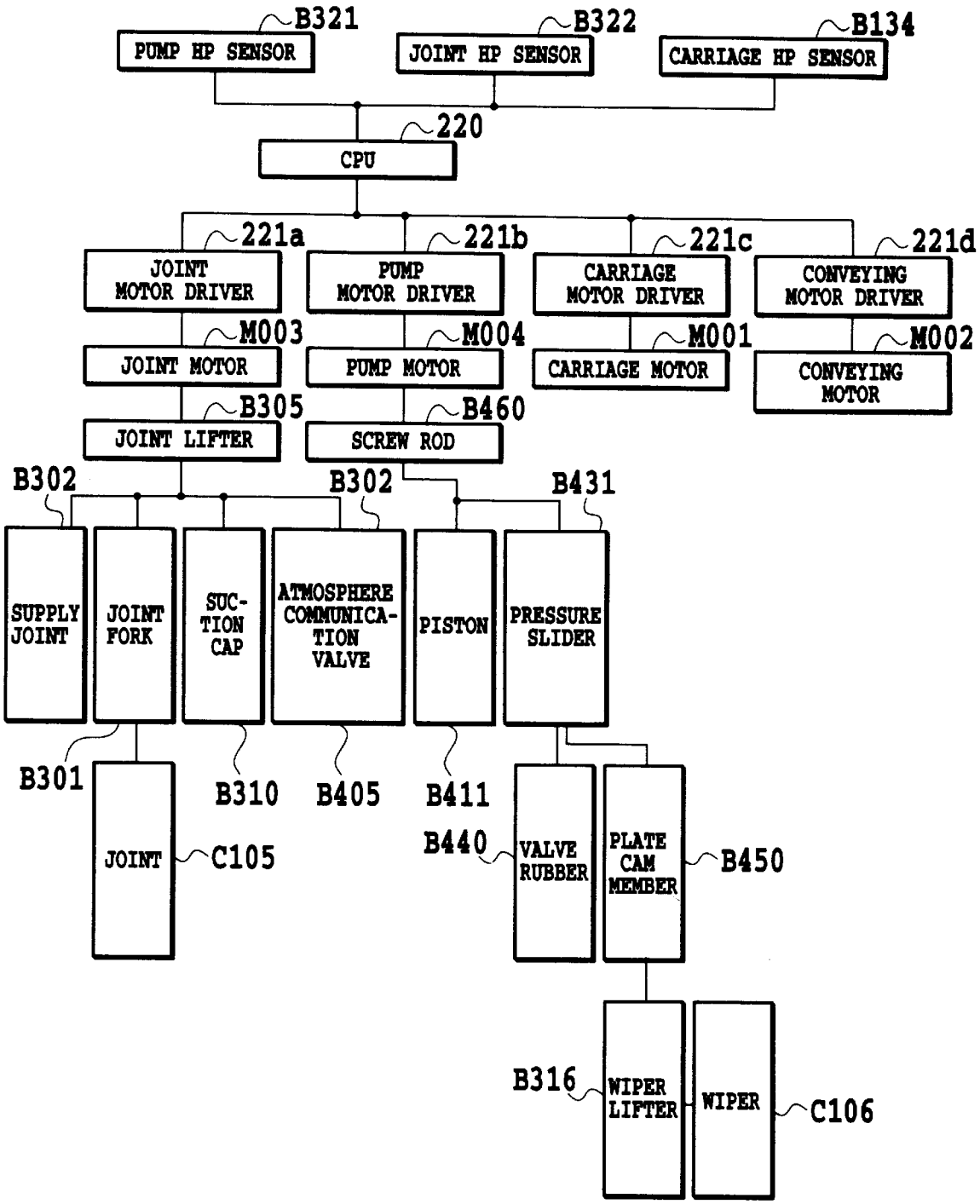
FIG. 28 is a block diagram showing a conceptual construction of a control drive system of the ink supply recovery system.

FIG. 28 is a conceptual block diagram showing schematic construction of a control and drive system relating to an ink supply recovery process.

When the piston B411 of the cylinder pump B410 is positioned at the stand-by position (home position), a pump HP sensor B321 detects the piston B411 at the stand-by position. When the joint lifter B305 is positioned at a home position, a joint HP sensor B322 detects the joint lifter B305 positioned at the home position. When the carriage B104 is positioned at its home position, a carriage HP sensor B134 detects the carriage B104 positioned at the home position. Detection signals of the sensors B321, B322 and B134 are input to CPU 220.

CPU 220 controls driving of a joint motor M003, a pump motor M004, a carriage motor M001 and a feeding motor M002 via a joint motor driver 221*a*, a pump motor driver 221*b*, a carriage motor driver 221*c*, and a feeding motor driver 221*d*, respectively The joint motor M003 is a driving source for driving the joint lifter B305 for up and down movement. During up and down movement of the joint lifter B305, the suction joint B302, the joint fork B301, the suction cap B310 and the atmosphere communication valve B405 are moved up and down at predetermined timings, respectively.

The pump motor M004 is a driving source of the screw rod B460. The piston B411 and the pushing slider B431 are reciprocally moved by rotation of the screw rod B460. On the other hand, by movement of the pushing slider B431, switching of the valve rubber B440 is performed, and in conjunction therewith, the wiper C106 is moved up and down via the plate cam member B450 and the wiper lifter B316.

Operation Sequence

Figure 30:
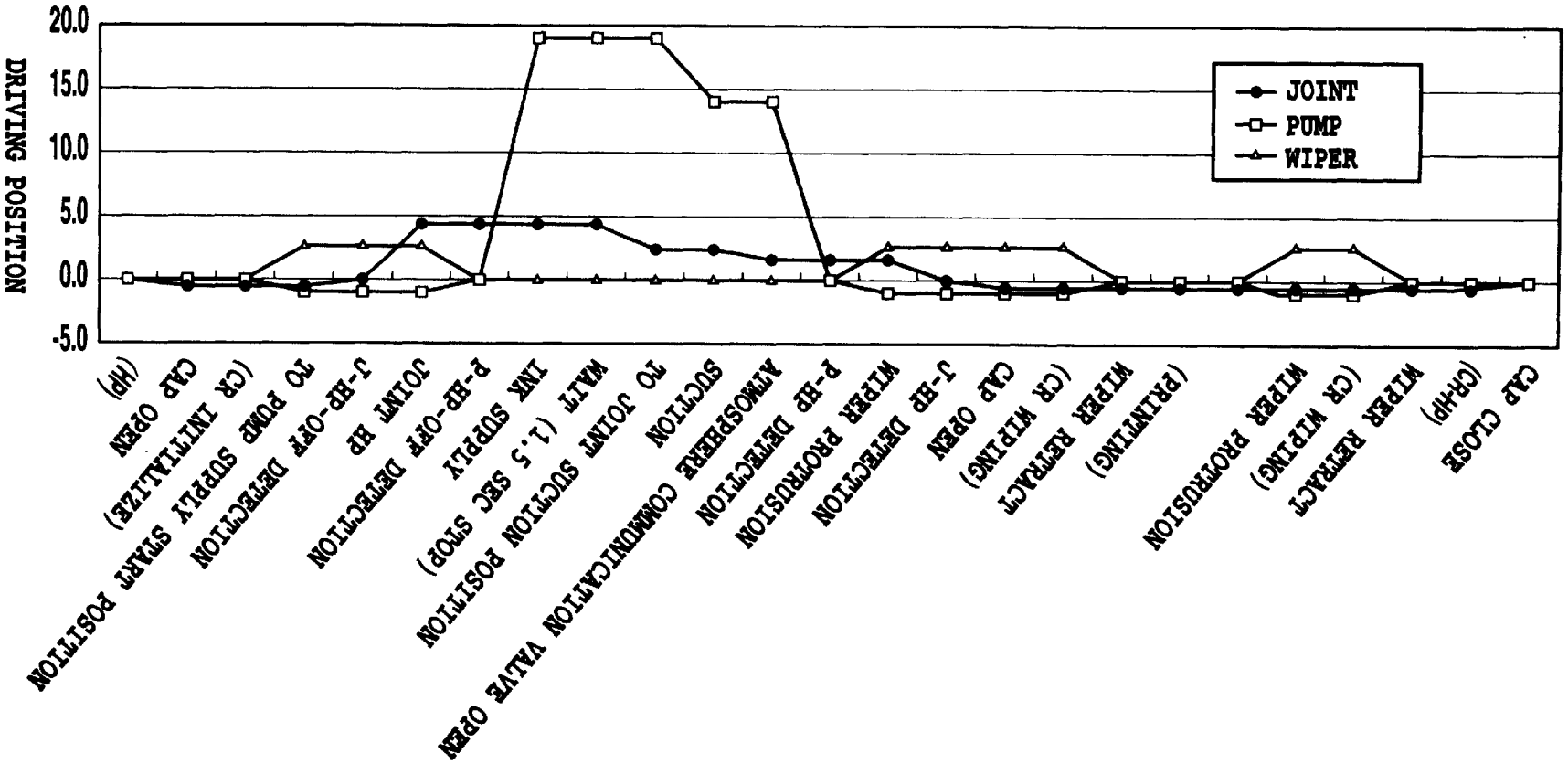
FIG. 30 is an illustration showing variation of driving positions of the joint lifter, the piston and a wiper with time in one cycle of the ink supply recovery process.
Figure 31:
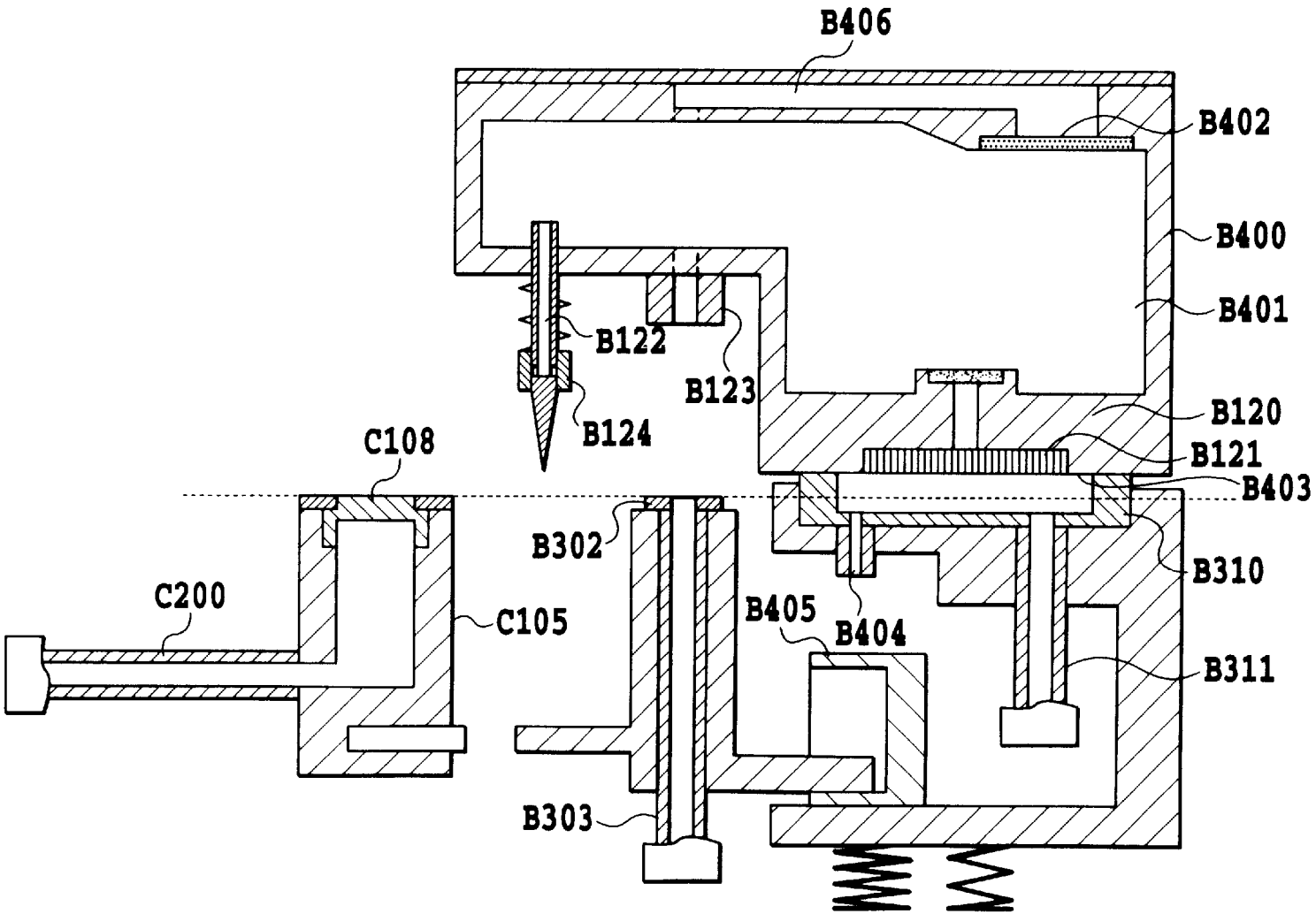
FIG. 31 is a conceptual illustration showing conditions of respective portions of the ink supply recovery system before insertion of the medium pack.
Figure 32:
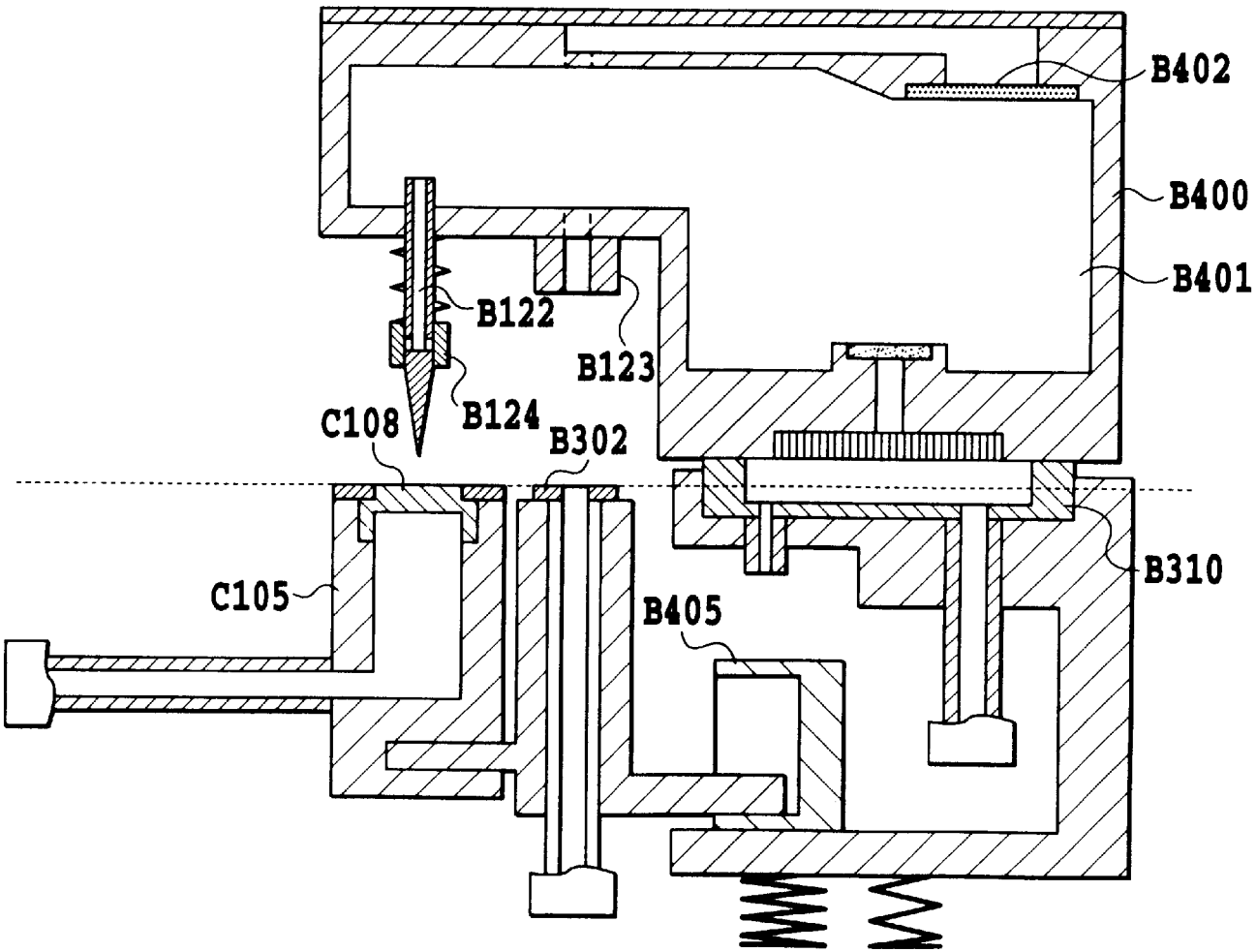
FIG. 32 is a conceptual illustration showing conditions of respective portions of the ink supply recovery system in stand-by condition.

FIG. 29 shows one example of operation sequence of the ink supply recovery process, and FIG. 30 shows driving positions of the joint lifter B305, the piston B411 of the cylinder pump B410 and the wiper lifter B316 in one cycle of the ink supply recovery process, respectively. On the other hand, FIGS. 31 to 39 are illustrations for explaining motion of respective portions in the ink supply recovery process cycle.

Operation sequence of the ink supply recovery process will be explained with reference to FIGS. 31 to 39.

Before Loading Medium Pack

When the medium pack C100 is not loaded on the main body A001, the suction cap B310 is capped on the face B403 of the printing head B120 for preventing drying of the ink within the ink ejection openings B121. On the other hand, at this time, the suction joint B302 is located at a position away from the air suction opening B123 of the sub-tank B400 and the atmosphere communication opening B404 of the suction cap B310 is held open.

(Medium Pack Loaded, Stand-by)

When the medium pack C100 is completely loaded on the main body A001, the rubber joint C105 of the medium pack C100 is supported by the joint fork B301. At this time, three joint rubbers C108 of the rubber joint C105 are located beneath three needles B122 of the sub-tanks B400. The suction joint B302 is located beneath of the air suction opening B123 of the carriage B104.

Also the piston B411 of the cylinder pump B410 is positioned at the stand-by position (home position) shown in FIGS. 16 to 18 and the joint lifter B305 is positioned at the home position (Step S1 in FIG. 29) as well. Further, the carriage B104 is positioned at the home position.

Initialization Carriage

In this condition, when the printing command is output, the joint motor M003 is driven for forward direction to slightly lower the joint lifter B305 and thus also lower the suction cap B310 slightly. As a result, the suction cap B310 is located slightly distant from the face B403 of the printing head B120, and thus once becomes open (step S2 in FIG. 29). On the other hand, at substantially the same timing with step S2, initialization process of the carriage B104 is performed (step S3 in FIG. 29).

Joint Process

Next, the pump motor M004 is driven in forward direction for predetermined number of pulses to rotate the screw rod B460 so that the piston B411 of the cylinder pump B410 is slightly expanded from the position shown in FIG. 18 to the ink supply position illustrated in FIG. 19 (step S4 in FIG. 29). On the other hand, at this time, by the rotation of the screw rod B460, the pushing slider B431 pushes the valve rubber B440 via the slide pins B442. As a result, the valve rubber B440 is moved to the position where the suction tube B311 is closed, as shown in FIG. 19. Accordingly, the ink suction chamber B414 of the cylinder pump B410 is communicated with the waste ink absorbing body C107 of the medium pack C100 via the waste liquid tube B312.

At this time, according to movement of the pushing slider B431, the plate cam member B450 is moved in the direction to expand the piston. By action of the cam portion B451 of the plate cam member B450, the wiper lifter B316 is lifted upwardly so as to lift the wiper C106 of the medium pack C100 for a short period. However, upward movement of the wiper C106 will not affect for motion of other members.

On the other hand, when the joint motor M003 is then driven in reverse direction, the joint lifter B305 starts movement upwardly. When the joint lifter B305 is elevated for a predetermined amount, the joint HP sensor B322 detects the joint lifter B305 moved out of the home position (step S5 in FIG. 29). Further, by the upward movement of the joint lifter B305, the suction cap B310 caps again the face B403 of the printing head B120. In FIGS. 29 and 30, in the case that the drive position of the joint lifter B305 takes a positive value, this means that the suction cap B310 is capping the face B403 of the printing head B120, while when the drive position is a negative value, it means that the suction cap B310 is located away from the face B403 of the printing head B120.

Figure 33:
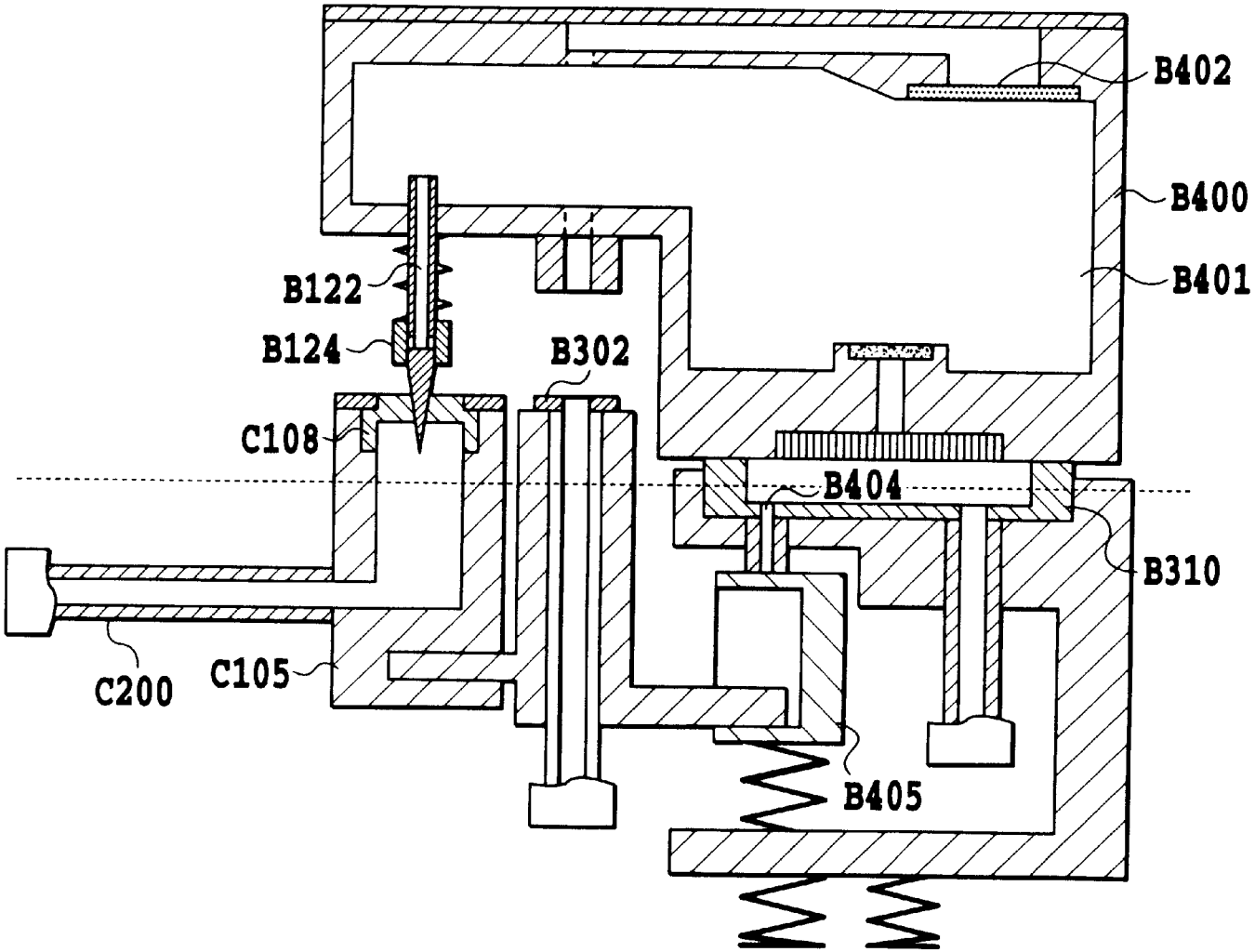
FIG. 33 is a conceptual illustration showing conditions of respective portions of the ink supply recovery system before ink supply.
Figure 34:
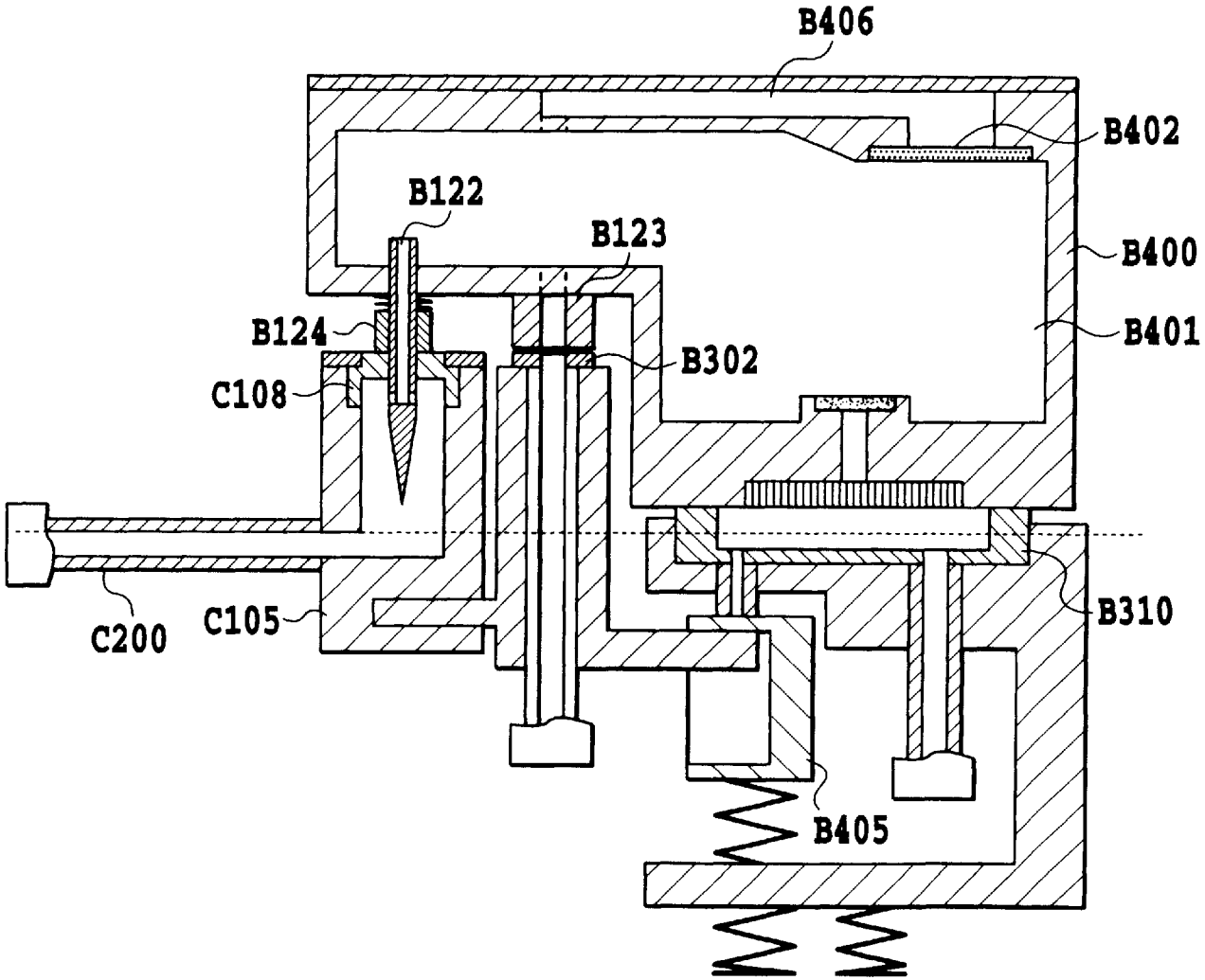
FIG. 34 is a conceptual illustration showing conditions of respective portions of the ink recovery system upon joint connection before ink supply.

While the joint lifter B305 is moving up, as shown in FIG. 33, at first, the atmosphere communication opening B404 of the suction cap B310 is closed by the atmosphere communication valve B405. The joint lifter B305 is further moved up. As a result, as shown in FIGS. 34 and 24, the needle B122 of the sub-tank B400 is completely inserted into the joint rubber C108 of the rubber joint C105, and the suction joint B302 is connected to the air suction opening B123 of the carriage B104. Then, the ink supply passage between the medium pack C100 and the sub-tank B400 and the air suction passage between the sub-tank B400 and the cylinder pump B410 are formed (step S6 in FIG. 29).

Ink Supply, Disposition

In the condition where the ink supply passage and the air suction passage are formed, the pump motor M004 starts revolution in reverse direction. By this, the screw rod B460 is rotated in reverse direction. Thus, the piston B411 of the cylinder pump B410 is retracted toward right from the condition shown in FIG. 19 to the position shown in FIG. 21 across the condition shown in FIG. 20.

During retracting of the piston B411, the pump HP sensor B321 detects the piston B411 of the cylinder pump B410 located out of the home position (step S7 in FIG. 29).

As set forth above, associating with retracting of the piston B411, the air suction chamber B413 is lowered in pressure therein and the ink suction chamber B414 is pressurized.

Figure 35:
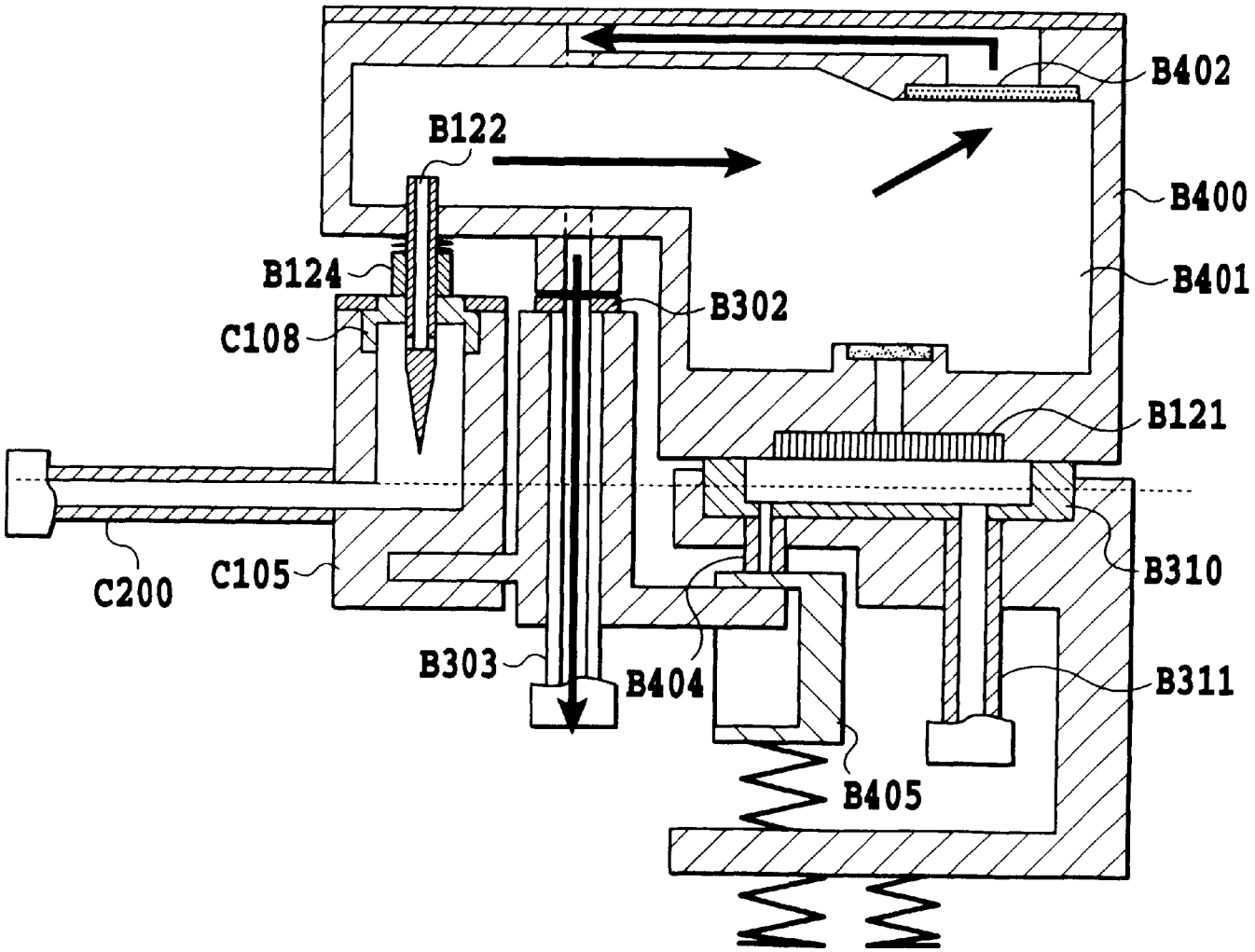
FIG. 35 is a conceptual illustration showing conditions of respective portions of the ink recovery system upon ink supply.

By this, air in the sub-tank B400 is sucked into the air suction chamber B413 through the porous membrane B402, the negative pressure introducing portion B406, the air suction opening B123, the suction joint B302 and the supply tube B303. As a result, as shown in FIG. 35, the ink is resupplied from the main tank C103 of the medium pack C100 to the sub-tank B400 via the ink supply passage C200, the joint C105 and the needle B122 of the sub-tank B400 (step S8 in FIG. 29).

On the other hand, since associating with the retraction of the piston B411, the ink suction chamber B414 of the cylinder pump B410 is pressurized, the ink stored in the ink suction chamber B414 flows out to the waste ink absorbing body C107 of the medium pack C100 via the waste liquid tube B312 and is absorbed and held by the waste ink absorbing body C107.

As set forth above, since the waste ink is disposed to the waste ink absorbing body C107 in the medium pack C100 which is detachably mounted, the ink may not reside in the printer portion B100.

In later half of retraction of the piston B411, switching of the position of the valve rubber B440 is performed as shown in FIGS. 20 and 21. Namely, as shown in FIG. 20, the flange portion B419 at the tip end of the piston B411 contacts with the valve rubber B440 to push the latter to move the valve rubber B440 and a plurality of slide pins B442 toward right up to the position shown in FIG. 21. As a result, as shown in FIG. 21, the input port B416 connected to the suction cap B310 via the suction tube B311 becomes open and the output port B417 connected to the waste ink absorbing body C107 is closed by the valve rubber B440.

It should be noted that after the retraction of the piston B411 of the cylinder pump B410 up to the stroke end on retraction side shown in FIG. 21, a stand-by condition is maintained for a predetermined set period (e.g. 1.5 seconds) (step S9 in FIG. 29).

Suction Recovery

Figure 36:
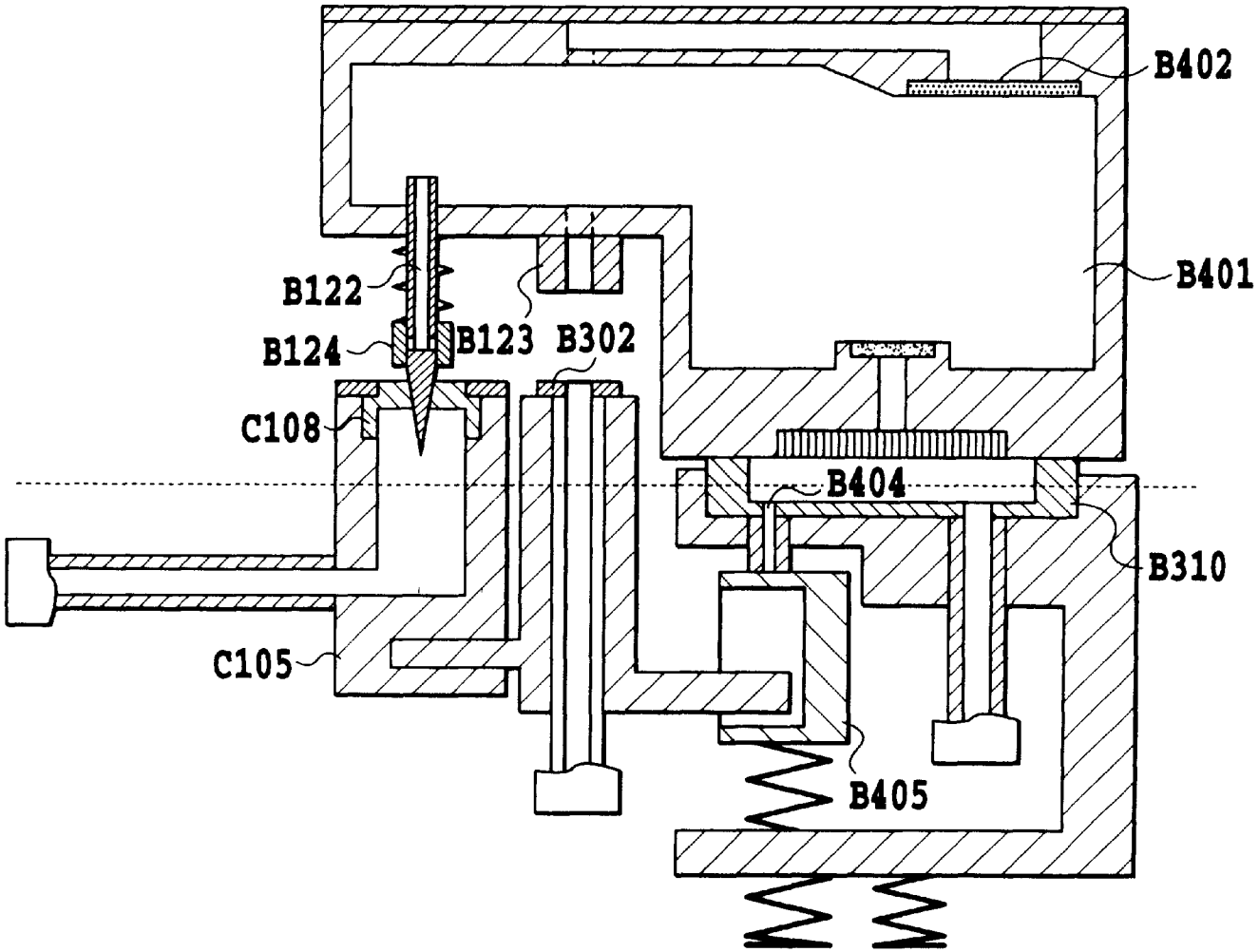
FIG. 36 is a conceptual illustration showing conditions of respective portions of the ink recovery system before ink suction.

Next, the joint motor M003 is driven for revolution in forward direction to lower the joint lifter B305 for a predetermined distance so as to lower the rubber joint C105 and the suction joint B302 to the position where the suction cap B310 sucks the ink, as shown in FIGS. 36 and 25 (step S10 in FIG. 29). Namely, the suction joint B302 is released from the air suction opening B123 of the carriage B104, and in conjunction therewith, the joint rubber C108 of the rubber joint C105 is released from the needle B122 of the sub-tank B400. It should be noted that, at this time, a needle cover B124 is lowered to the position for protecting the opening portion of the needle B122 by a restoration force of the spring (see FIG. 25). On the other hand, in this condition, the atmosphere communication opening B404 of the suction cap B310 is still held closed by the atmosphere communication valve B405. Also, in the cylinder pump B410, the ink suction chamber B414 is communicated with the suction tube B311 as shown in FIG. 21.

In this condition, the pump motor M004 is driven for revolution in forward direction. Thus, the screw rod B460 is rotated to drive the piston B411 of the cylinder pump B410 toward left from the condition shown in FIG. 21 for about one fourth stroke (step S11 in FIG. 29).

Associating with expansion of the piston B411, the air suction chamber B413 is pressurized and the ink suction chamber B414 is lowered in pressure.

Figure 37:
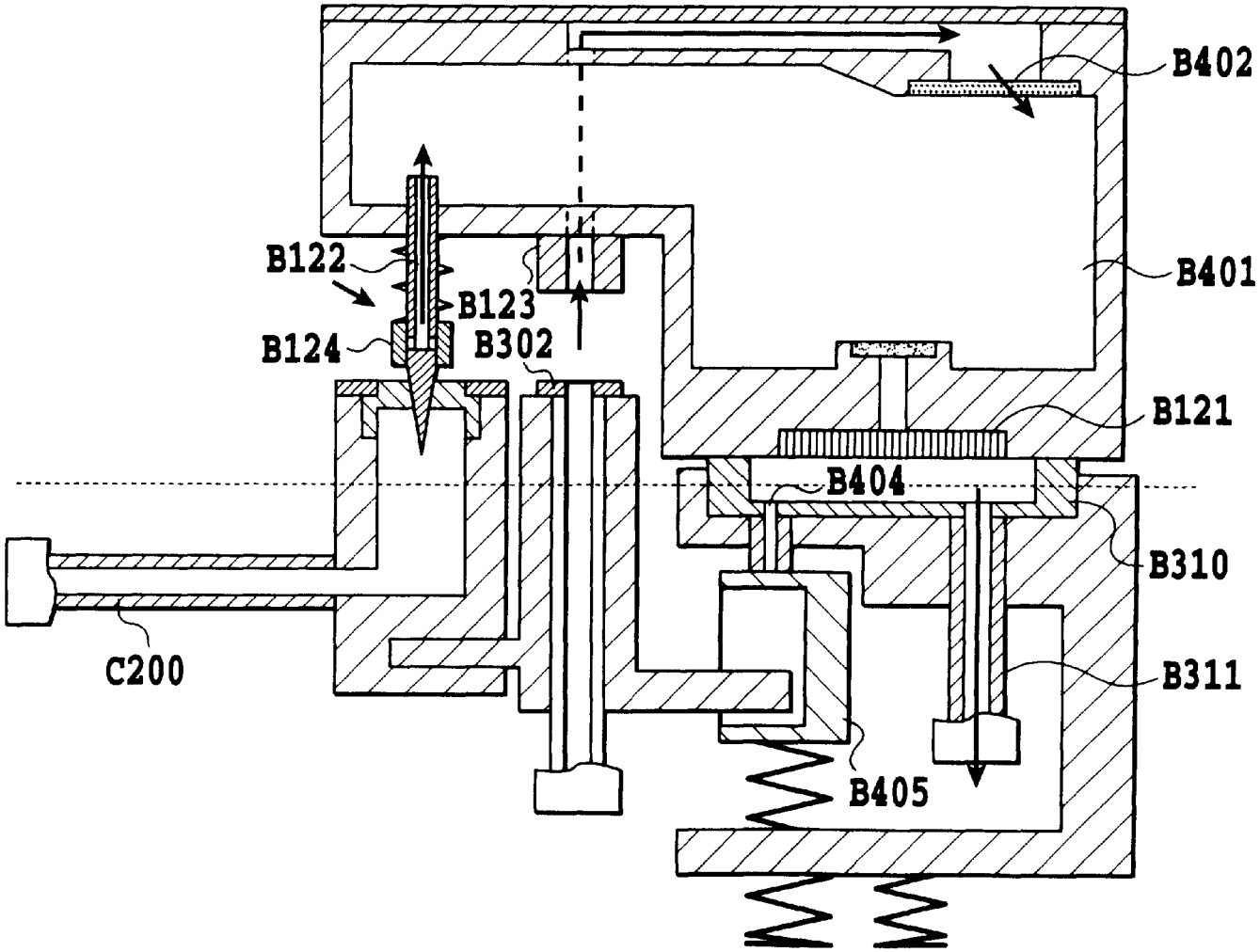
FIG. 37 is a conceptual illustration showing conditions of respective portions of the ink recovery system upon ink suction.

By this, as shown in FIG. 37, inside of the suction cap B310 connected to the ink suction chamber B414 via the suction tube B311 is lowered in pressure. As a result, the ink is sucked from the ink ejection openings B121 of the printing head B120 to be stored within the suction cap B310. Associating with the ink suction operation, air is sucked through the opening of the air suction opening B123 and the needle B122 for introducing the sucked air into the porous membrane B402 and peripheral portion of the needle.

Here, the needle B122 of the sub-tank B400 has a needle hole which also serves as an atmosphere communication hole. Then, if the residual air in the sub-tank B400 is expanded, the supplied ink may be pushed out from the needle B122.

Therefore, immediately after supplying ink to the sub-tank B400, joint connection is released. At this released condition, suction of the ink from the ink ejection openings B121 is performed to suck a predetermined amount of ink to introduce air from the needle hole of the needle B122 to provide an air space within the sub-tank B400. By this, even when the residual air is expanded, only air is discharged from the needle B122 and ink will never flow out.

Idle Suction

Figure 38:
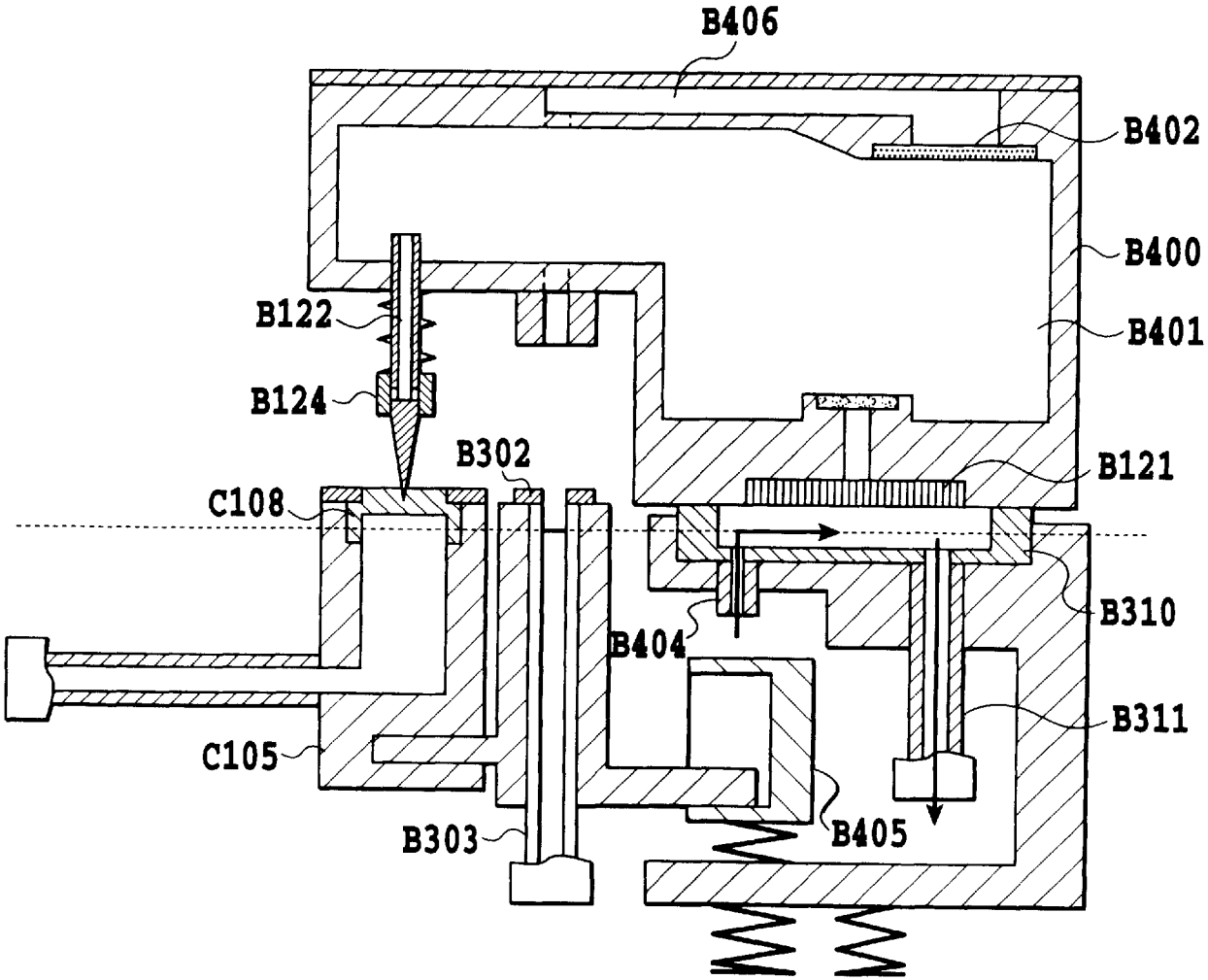
FIG. 38 is a conceptual illustration showing conditions of respective portions of the ink recovery system upon idle suction.

Next, the joint motor M003 is further driven in forward direction, the joint lifter B305 is further lowered for a predetermined distance to lower the atmosphere communication valve B405 to an open position, as shown in FIGS. 38 and 26. By this, the atmosphere communication opening B404 of the suction cap B310 is opened (step S12 in FIG. 29).

In this condition, when the pump motor M004 is further driven in forward direction, the screw rod B460 is rotated to drive the piston B411 of the cylinder pump B410 toward left for expanding from the foregoing about one fourth stroke expanded position to the ink supply start position shown in FIG. 19 across the stand-by position shown in FIG. 18 (steps S13 and S14 in FIG. 29).

By this, the ink suction chamber B414 is further lowered in pressure. As a result, as shown in FIG. 38, the ink stored in the suction cap B310 flows into the ink suction chamber B414 of the cylinder pump B410 via the suction tube B311. Furthermore, the residual ink in the suction tube B311 also flows into the ink suction chamber B414. Thus, by performing idle or empty suction, admixing of colors in each nozzles can be successfully prevented.

It should be noted that at the mid-way of expansion of the piston B411 toward left, the pump HP sensor B321 detects the piston B411 located at the home position when the piston B411 of the cylinder pump B410 is expanded up to the position shown in FIG. 18 (step S13 in FIG. 29).

On the other hand, when the piston B411 of the cylinder pump B410 is expanded from the condition shown in FIG. 18 to the ink supply position shown in FIG. 19, by movement of the pushing slider B431, switching of the valve rubber B440 and upward projecting operation of the wiper C106 of the medium pack C100 via the wiper lifter B316 are performed, as set forth above (step S14 in FIG. 29).

Opening Suction Cap

Figure 39:
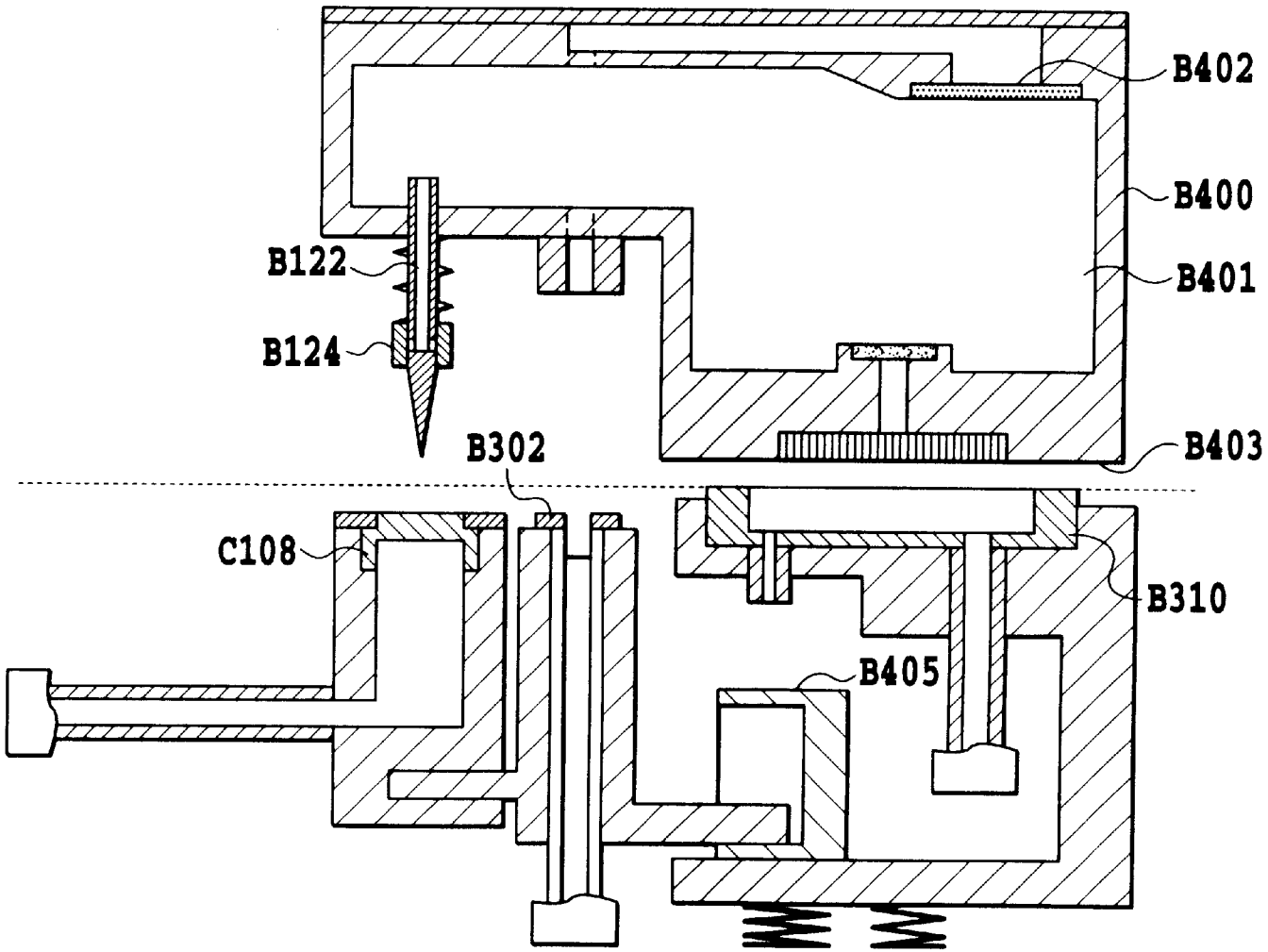
FIG. 39 is a conceptual illustration showing conditions of respective portions of the ink recovery system upon printing.

Next, the joint motor M003 is further driven for revolution in forward direction to lower the joint lifter B305 for a predetermined distance so as to release the suction cap B310 from the face B403 of the printing head B120 and to place the suction cap B310 in open condition as shown in FIG. 39 (steps S15 and S16 in FIG. 29). By lowering the joint lifter B305, the rubber joint C105 and the suction joint B302 are further lowered. On the other hand, during lowering of the joint lifter B305, when the joint lifter B305 reaches the predetermined stand-by position, the joint HP sensor B322 detects the joint lifter B305 located at the home position.

Wiping

In this condition, when the carriage motor M001 is driven, the carriage B104 is moved to the position of the wiper C106 of the medium pack C100. After reciprocating the carriage B104 for one or several times at this wiper position, the carriage is returned to the home position (step S17 in FIG. 29). By this, the ink adhering on the face B403 of the printing head B120 is wiped off by the wiper C106.

Thus, since wiping is performed using the wiper C106 provided on the side of the medium pack C100, scattering of the ink can be prevented on the side of the printer portion B100.

When wiping operation is completed, the pump motor M004 is driven in reverse direction to drive the screw rod B460 to rotate, the piston B411 of the cylinder pump B410 is retracted toward right from the position shown in FIG. 19 to the stand-by position shown in FIG. 18. By rotation of the screw rod B460, the pushing slider B431 is also moved toward right allowing the plate cam member B450 to move toward right by restoring force of the spring B453. As a result, the wiper lifter B316 engaging with the cam portion B451 of the plate cam member B450 is lowered to retract the wiper C106 of the medium pack C100 (step S18 in FIG. 29).

Through the process set forth above, one cycle of ink supply and suction recovery operation is completed to enable printing by the printer portion B100.

Printing

In the printer portion 100, the printing head B120 is driven with moving the carriage B104 and with feeding one sheet of printing medium C104 taken out from the medium pack C100 so as to perform predetermined printing operation as commanded (step S19 of FIG. 29).

In the case that printing is performed continuously subsequently after completion of printing for one sheet, process is returned to step S4 of FIG. 29. Subsequently, by performing process from step S4 to step S19 set forth above, ink supply and suction recovery operation for printing the next page and printing operation for the next page are performed.

As set forth, in this device, since ink supply and suction recovery operation is performed every time of printing for one sheet, high quality printing can be done stably.

On the other hand, upon terminating printing, the process of the following steps S20 to S24 are performed following step S19.

Wiping

After completion of printing, the cylinder pump B410 is placed in stand-by condition shown in FIG. 18. From this condition, the pump motor M004 is driven for revolution in forward direction to rotate the screw rod B460 so as to drive the pushing slider B431 toward left up to the condition shown in FIG. 19. By this, the plate cam member B450 is driven toward left to lift the wiper lifter B316 upward. As a result, the wiper C106 of the medium pack C100 is projected (step S20 in FIG. 29).

Next, the carriage motor M001 is driven to reciprocate the carriage B104 at the wiper position for wiping the ink adhering on the face B403 of the printing head B120 during printing by means of the wiper C106 (step S21 in FIG. 29).

Next, the pump motor M004 is driven for revolution in reverse direction to rotate the screw rod B460 in reverse direction. Thus, the pushing slider B431 is moved from the condition shown in FIG. 19 to the position shown in FIG. 20. By this, the plate cam member B450 is driven toward right to lower the wiper lifter B316 so as to retract the wiper C106 of the medium pack C100 (step S22 in FIG. 29).

Subsequently, when the carriage B104 returning to the home position is detected (step S23 of FIG. 29), the joint motor M003 is driven for revolution in reverse direction to slightly lift up the joint lifter B305, and the suction cap B310 is also lifted up. By this, the face B403 of the printing head B120 is capped by the suction cap B310 (step S24 of FIG. 29).

Preparatory Ejection

It should be noted that while eliminated in the description of the operation sequence above, a preparatory ejecting operation for intentionally ejecting ink from the ink ejection openings B121 of the printing head B120 toward the suction cap B310, may be performed after wiping at step S18 of FIG. 29, for example. On the other hand, as required, the preparatory ejection may be performed at other appropriate timing.

As set forth above, in the foregoing embodiment, the cylinder pump B410 takes a cylinder chamber on one side of the piston B411 as the air suction chamber B413 and a cylinder chamber on the other side as the ink suction chamber B414 for performing suction operation in each cylinder chamber by reciprocating operation of the piston B411. Therefore, the pump structure can be compact to increase freedom in overall arrangement to permit the overall ink supply recovery system to be formed in compact.

Furthermore, since the screw rod B460 is engaged within the piston rod B411*a* to drive the piston B411, a structure for reciprocating the piston rod B411*a* can be made more compact in comparison with the case where the screw rod B460 is engaged with other member connected to the piston rod B411*a*, and thus the overall ink supply recovery system can be made compact.

On the other hand, in the shown embodiment, space saving is achieved by arranging the relief valve B420 within the piston rod B411*a* of the cylinder pump B410 with avoiding exertion of excessive ink pressure on the porous membranes B402 upon supplying of ink. By this, reliability of operation of the porous membranes B402 can be certainly obtained.

Furthermore, in the shown embodiment, the ink suction chamber B414 through which the piston rod B411*a* extends is taken for sucking the ink and the other air suction chamber B413 is taken for sucking air. Accordingly, suction amounts of respective cylinder chambers 413 and 414 can be set at different values at the same piston stroke. Accordingly, by varying a diameter of the piston rod B411*a*, a suction volume ratio of the ink suction chamber B414 and the air suction chamber B413 can be varied easily.

On the other hand, in the shown embodiment, a series of processes of ink supply, ink suction recovery, idle suction and ink disposition can be done by one reciprocating motion of piston B411 of the cylinder pump B410. Therefore, the series of processes can be efficiently carried out in a short period.

As explained above, with the present invention, since the air suction chamber and the ink suction chamber are arranged on opposite sides of the piston in the cylinder chamber and air and ink are sucked in respective suction chambers by reciprocal motion of the piston, compact pump can be provided. By this, freedom in overall arrangement can be increased and overcall ink supply recovery system can be made compact. On the other hand, since sucking and discharging operation in the ink suction chamber can be switched by port switching means provided inside of the cylinder, down-sizing of the pump structure becomes possible to make the overall ink supply recovery system compact.

Also, with the present invention, since a series of processes of ink supply, ink suction recovery, idle suction and ink disposition can be done by one reciprocating motion of piston of the cylinder pump, the series of processes can be efficiently carried out in a short period resulting in improving a printing speed.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink supply recovery system comprising:

a pack body including a main tank connected to an ink joint and storing an ink, and a waste ink receptacle means for receiving waste ink, said pack body being detachably mounted on a printer body, said printer body comprising:

a sub-tank mounted on a carriage, said sub-tank having a negative pressure introducing portion arranged with a porous membrane and an ink intake portion connectable with said ink joint, and taking ink into inside from said ink intake portion by a negative pressure introduced from said negative pressure introducing portion;

a cap for capping ink ejection openings of a printing head ejecting the ink supplied from said sub-tank;

a cylinder pump having:

a reciprocally movable piston, a cylinder body having an air suction chamber, defined on one side of the piston, connectable with said negative pressure introducing portion and an ink suction chamber, defined on another side of said piston, connected with said cap via an input port and connectable with said waste ink receptacle means via an output port, and port switching means for switching said input port and said output port open and close associating with movement of said piston; and drive control means for controlling movement of said piston of said cylinder pump, switching of said port switching means, contacting and releasing of said cap relative to said printing head, contacting and releasing of said ink joint relative to said ink intake portion of said sub-tank, and contacting and releasing between said negative pressure introducing portion of said sub-tank and said air suction chamber.

2. An ink supply recovery system as claimed in claim 1, wherein said drive control means includes means for contacting said cap with said printing head, jointing said ink joint with said ink intake portion of said sub-tank, connecting said negative pressure introducing portion of said sub-tank with said air suction chamber, closing said input port and opening said output port by said port switching means, and in this condition, moving said piston for reducing pressure in said air suction chamber and pressurizing said ink suction chamber so as to perform resupplying of ink from said main tank to said sub-tank and discharging of ink from said ink suction chamber to said waste ink receptacle means.

3. An ink supply recovery system as claimed in claim 1, wherein said drive control means includes means for contacting said cap with said printing head, releasing said ink joint from said ink intake portion of said sub-tank, disconnecting said negative pressure introducing portion of said sub-tank with said air suction chamber, opening said input port and closing said output port by said port switching means, and in this condition, moving said piston for pressurizing said air suction chamber and reducing pressure in said ink suction chamber so as to perform a suction recovery operation for sucking ink from ink ejection openings of said printing head.

4. An ink supply recovery system as claimed in claim 3, further comprising an atmosphere communicating valve for opening and closing an atmosphere communication opening formed in said cap, wherein said drive control means includes means for opening said atmosphere communication valve after a suction recovery operation of ink, and in this condition, moving said piston for pressurizing said air suction chamber and reducing pressure in said ink suction chamber so as to perform an idle suction recovery operation.

5. An ink supply recovery system as claimed in claim 1, wherein said pack body includes a wiper which can be projected and retracted for wiping of an ink ejection opening forming surface of said printing head, said drive control means includes means for performing wiping by moving said carriage in a condition where said wiper is projected.

6. An ink supply recovery system as claimed in claim 1, wherein said ink intake portion is a needle form formed with a through hole.

7. An ink supply recovery system as claimed in claim 1, wherein a piston rod of said piston of said cylinder pump extends outside of a cylinder body through said ink suction chamber.

8. An ink supply recovery system as claimed in claim 1, wherein said port switching means comprises a switching valve disposed within said ink suction chamber.

9. An ink supply recovery system as claimed in claim 1, wherein a printing medium is incorporated in said pack body.

10. An ink supply recovery system as claimed in claim 1, wherein said printing head ejects ink by applying thermal energy to ink.

11. An ink-jet printing apparatus including the ink supply recovery system defined in claim 1 and a drive mechanism for driving said system.

12. An image pick-up device included in the ink-jet printing apparatus defined in claim 11 which also includes a recording mechanism with an image pick-up mechanism.

13. An ink supply recovery method comprising the steps of:

loading a pack body including a main tank connected to an ink joint and storing ink and a waste ink receptacle means on a printer main body, said printer main body including a sub-tank which is mounted on a carriage, has a negative pressure introducing portion arranged with a porous membrane and an ink intake portion, and supplies ink to a printing head, a cap for capping ink ejection openings of said printing head, and a cylinder pump including a reciprocally movable piston, a cylinder body having an air suction chamber defined on one side of said piston and connectable with said negative pressure introducing portion and an ink suction chamber defined on another side of said piston, connected with said cap via an input port and connectable with said waste ink receptacle means via an output port, and port switching means for performing switching open and close of said input port and said output port associating with movement of said piston;

then contacting said cap on said printing head;

jointing said ink joint to said ink intake portion of said sub-tank;

interconnecting said negative pressure introducing portion of said sub-tank and said air suction chamber;

closing said input port and opening said output port by said port switching means; and in this condition moving said piston for reducing pressure in said air suction chamber and pressurizing said ink suction chamber for resupplying ink from said main tank to said sub-tank and discharging ink from said ink suction chamber to said waste ink receptacle means.

14. An ink supply recovery method as claimed in claim 13, said pack body further including a wiper, which is projectable or retractable, for wiping an ink ejection openings forming surface of said printing head, said method further comprising a step of performing wiping by moving said carriage in the condition where said wiper is projected.

15. An ink supply recovery method comprising the steps of:

loading a pack body including a main tank connected to an ink joint and storing ink and a waste ink receptacle means on a printer main body, said printer main body including a sub-tank which is mounted on a carriage, has a negative pressure introducing portion arranged with a porous membrane and an ink intake portion, and supplies ink to a printing head, a cap for capping ink ejection openings of said printing head, and a cylinder pump including a reciprocally movable piston, a cylinder body having an air suction chamber defined on one side of said piston and connectable with said negative pressure introducing portion and an ink suction chamber defined on another side of said piston, connected with said cap via an input port and connectable with said waste ink receptacle means via an output port, and port switching means for performing switching open and close of said input port and said output port associating with movement of said piston;

in this condition, contacting said cap on said printing head;

releasing said ink joint from said ink intake portion of said sub-tank;

disconnecting said negative pressure introducing portion of said sub-tank with said air suction chamber;

opening said input port and closing said output port by said port switching means; and in this condition, moving said piston for pressurizing said air suction chamber and reducing pressure in said ink suction chamber for performing a suction recovery operation for sucking ink from said ink ejection openings of said printing head.

16. An ink supply recovery method as claimed in claim 15, said printer main body further including an atmospheric communication valve for opening and closing an atmosphere communication opening formed in said cap, said method further comprising the steps of:

opening said atmosphere communication valve after said suction recovery operation of said ink; and in this condition, moving said piston for pressurizing said air suction chamber and reducing pressure in said ink suction chamber so as to perform an idle suction recovery operation.

17. An ink supply recovery method as claimed in claim 15, said pack body further including a wiper, which is projectable or retractable, for wiping an ink ejection openings forming surface of said printing head, said method further comprising a step of performing wiping by moving said carriage in the condition where said wiper is projected.

* * * * *

UNITED STATES PATENT AND TRADEMARK OFFICE

CERTIFICATE OF CORRECTION

PATENT NO. : 6,612,683 B2
DATED : September 2, 2003
INVENTOR(S) : Takahashi et al.

It is certified that error appears in the above-identified patent and that said Letters Patent is hereby corrected as shown below:

Title page,
Item [57], ABSTRACT,
Line 12, “close associating” should read -- closed associated --.

Column 5,
Line 65, “lifer,” should read -- lifter, --.

Column 7,
Line 55, “follows” should read -- follow --.

Column 8,
Line 46, “an” should read -- a --.

Column 9,
Line 57, “thus generated” should read -- thus-generated --.

Column 10,
Line 23, “the both” should read -- both --; and
Line 63, “couterrotates,” should read -- counterrotates, --.

Column 11,
Line 25, “B100:” should read -- B100; --.

Column 13,
Lines 13 and 64, “temporary” should read -- temporarily --; and
Line 62, “direction)”,” should read -- direction)”), --.

Column 14,
Line 41, “to” should read -- into --;
Line 51, “Therefor,” should read -- Therefore, --; and
Line 60, “alike” should read -- like --.

Column 16,
Line 20, “Detail” should read -- Details --; and
Line 43, “is” should read -- is of --.

Column 18,
Line 34, “BB302” should read -- B302 --.

UNITED STATES PATENT AND TRADEMARK OFFICE

CERTIFICATE OF CORRECTION

PATENT NO. : 6,612,683 B2
DATED : September 2, 2003
INVENTOR(S) : Takahashi et al.

It is certified that error appears in the above-identified patent and that said Letters Patent is hereby corrected as shown below:

Column 19,
Line 3, Line 34, “BB302” should read -- B302 --.

Column 21,
Line 65, “for” should read -- the --.

Column 26,
Line 42, “overcall” should read -- overall --.

Column 28,
Lines 34 and 41, “including” should read -- including: --.

Column 29,
Liens 10 and 17, “including” should read -- including: --.

Signed and Sealed this

Seventeenth Day of August, 2004

JON W. DUDAS
*Acting Director of the United States Patent and Trademark Office*